US006932430B2

(12) United States Patent
Bedford et al.

(10) Patent No.: US 6,932,430 B2
(45) Date of Patent: Aug. 23, 2005

(54) COMBINED TENSION AND BACK STOP FUNCTION FOR SEATING UNIT

(75) Inventors: Adam C. Bedford, Rockford, MI (US); Robert J. Battey, Middleville, MI (US); David A. Bodnar, Ada, MI (US); Jonathan B. Hadley, Holland, MI (US); Jeffrey A. Hall, Grand Rapids, MI (US); Kurt R. Heidmann, Grand Rapids, MI (US); Eric Johnson, Hudsonville, MI (US); Gary Lee Karsten, Wyoming, MI (US); Gordon J. Peterson, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/792,309

(22) Filed: Mar. 3, 2004

(65) Prior Publication Data

US 2004/0245827 A1 Dec. 9, 2004

Related U.S. Application Data

(63) Continuation-in-part of application No. 10/455,076, filed on Jun. 5, 2003.

(51) Int. Cl.[7] ..... A47C 3/026; A47C 1/024; A47C 1/038

(52) U.S. Cl. ..... 297/300.2; 297/285; 297/300.3; 297/300.7; 297/300.8; 297/301.5; 297/301.6; 297/301.7

(58) Field of Search ..... 297/285, 286, 297/289, 300.6, 300.7, 300.8, 301.5, 301.6, 301.7

(56) References Cited

U.S. PATENT DOCUMENTS

| | | | | |
|---|---|---|---|---|
| 2,087,254 A | * | 7/1937 | Herold | 297/301.6 X |
| 2,316,628 A | | 4/1943 | Schaffner | |
| 2,711,211 A | | 6/1955 | Tidcombe | |

(Continued)

FOREIGN PATENT DOCUMENTS

| | | |
|---|---|---|
| WO | WO 82/01760 | 5/1982 |

*Primary Examiner*—Rodney B. White
(74) *Attorney, Agent, or Firm*—Price, Heneveld, Cooper, DeWitt & Litton LLP

(57) ABSTRACT

A seating unit includes a base, a seat, a back, and a control operably supporting the seat and the back on the base for movement between upright and recline positions. The control includes a spring providing a biasing supporting force to the back during recline, and further includes a booster mechanism for increasing the supporting force, and still further includes a stop member and a selector device for activating and deactivating the booster mechanism. The selector device is easily movable with a low effort that is independent from friction generated by internal components of the booster mechanism. The stop member is linearly slidably mounted atop a control housing for selectively engaging the booster mechanism and the link for movement between a disengaged position, a booster-engaged position, a partial-recline position, and a recline-prevented position.

20 Claims, 63 Drawing Sheets

U.S. PATENT DOCUMENTS

| | | | | | |
|---|---|---|---|---|---|
| 3,434,756 | A | | 3/1969 | Walkinshaw | |
| 4,318,556 | A | | 3/1982 | Rowland | |
| 4,709,962 | A | | 12/1987 | Steinmann | |
| 4,768,244 | A | | 9/1988 | Riedl | |
| 4,935,977 | A | | 6/1990 | Yamada | |
| 4,966,411 | A | | 10/1990 | Katagiri et al. | |
| 5,022,709 | A | | 6/1991 | Marchino | |
| 5,026,117 | A | * | 6/1991 | Faiks et al. | 297/300.7 X |
| 5,160,184 | A | * | 11/1992 | Faiks et al. | 297/300.7 X |
| 5,269,497 | A | | 12/1993 | Barth | |
| 5,282,285 | A | | 2/1994 | de Gelis et al. | |
| 5,316,371 | A | | 5/1994 | Bishai | |
| 5,385,389 | A | | 1/1995 | Bishai | |
| 5,658,049 | A | | 8/1997 | Adams et al. | |
| 5,762,399 | A | | 6/1998 | Liu | |
| 5,931,531 | A | | 8/1999 | Assman | |
| 5,979,984 | A | | 11/1999 | DeKraker et al. | |
| 6,000,756 | A | | 12/1999 | Hybarger et al. | |
| 6,033,020 | A | | 3/2000 | Ito | |
| 6,116,695 | A | | 9/2000 | Heidmann et al. | |
| 6,378,943 | B1 | | 4/2002 | Beggs et al. | |
| 6,585,320 | B2 | * | 7/2003 | Holbrook et al. | 297/300.4 |
| 2002/0043867 | A1 | | 4/2002 | Lessmann | |

* cited by examiner

COMBINED TENSION AND BACK STOP FUNCTION FOR SEATING UNIT

CROSS REFERENCE TO RELATED APPLICATIONS

This application is a continuation-in-part of co-assigned co-invented application Ser. No. 10/455,076, filed Jun. 5, 2003, entitled COMBINED TENSION AND BACK STOP FUNCTION FOR SEATING UNIT, the entire contents of which are incorporated herein in their entirety. This application is further related to an application Ser. No. 10/455,487, filed on Jun. 5, 2003, entitled SEATING WITH COMFORT SURFACE, and also to an application Ser. No. 10/455,503, filed Jun. 5, 2003, entitled CONTROL MECHANISM FOR SEATING UNIT, and also to an application Ser. No. 10/241,955, filed Sep. 12, 2002 entitled "SEATING UNIT WITH MOTION CONTROL", the entire contents of each of which are also incorporated herein by reference.

BACKGROUND

The present invention relates to a seating unit having an adjustable back tension function and an adjustable back stop function.

Comfort, simplicity, and adjustability continue to be highly-demanded features in seating. Specifically, it is desirable to provide a control that is easy to operate, simple to manufacture and assemble, has relatively low cost and relatively few components, and that has a modern thin sleek appearance. It is further desirable that the structure complement the ability to provide weight-activated support upon recline so that heavier seated users feel secure upon recline even without adjustment. In regard to adjustability, it is desirable to provide controls that are easy and intuitive to operate. For example, many chairs having a reclineable back also have an adjustable spring for varying the back support provided upon recline, but most controls work against the spring to compress the spring during adjustment. This takes considerable effort, even if a mechanical advantage is provided, since the springs are substantial and there is significant energy input required to compress the spring. Even adjustments that decompress the spring require effort to overcome frictional forces that prevent unexpected decompression. Further, seated users constantly find themselves searching among several different controls trying to find the correct control for the particular adjustment that they desire. Still further, once the proper control is selected, the user still has to figure out which way to adjust the control to achieve the desired effect. It is desirable to invent a more integrated control mechanism that provides a logical and intuitive combination of chair adjustments, where increasingly supportive adjustments cause an increasing level of back support, even though the increasing support is provided by different mechanisms.

In addition to the above, it is desirable to provide a chair that is optimally designed to use recyclable parts, and that uses components that can be easily separated for recycling and/or repair. Expanded thermoset foam products are usually classified as not recyclable, and further they are generally considered to be unfriendly to the environment as compared to steel, remeltable thermoplastic, and more natural materials. Eliminating thermoset foam would be a significant step toward making a chair 100% recyclable. However, the comfort and cost advantage must be maintained for competitive reasons.

Accordingly, an apparatus solving the aforementioned problems and having the aforementioned advantages is desired.

SUMMARY OF THE PRESENT INVENTION

In one aspect of the present invention, a seating unit includes a base, a seat, a back, and a control operably supporting the seat and the back on the base for synchronous movement as the back is moved between upright and recline positions. The control includes a housing, a first mechanism providing a biasing supporting force to the back during recline, and a booster spring mechanism for increasing the supporting force. An on/off selector device for selectively activating and deactivating the booster spring mechanism includes a stop member slidably mounted to the housing and that is movable to a disengaged first position for deactivating the booster spring mechanism and an engaged second position for activating the booster spring mechanism. The booster spring mechanism is operably connected to the back for rotation therewith during recline of the back. The booster spring mechanism defines an axis of rotation and includes an arm extending from the axis of rotation that freely rotates when the stop member is in the disengaged first position, but that engages the stop member to tension the booster spring mechanism upon recline of the back.

In another aspect of the present invention, a seating unit has a base, a seat, and a back adapted to pivot between upright and reclined positions. An energy mechanism biases the back toward the upright position. A first adjustment mechanism adjusts a first control member on the chair, and a second mechanism for adjusting a second control member on the chair. An improvement includes a single actuator operably coupled to both the first adjustment mechanism and the second mechanism for selectively operating both said mechanisms together or one at a time.

In another aspect of the present invention, a seating unit includes a base, a back, and an underseat control operably coupled to and supporting the back for movement between upright and reclined positions. The control includes a housing. An adjustable component and an actuator adjust the adjustable component. The actuator includes a handle for operating the stop member and an over-torque mechanism connecting the handle to the adjustable feature. The over-torque mechanism is configured to release and prevent damage to the stop member and to the actuator and to the adjustable component when a damaging excessive force is transmitted by the handle but when the stop member is prevented from moving. In a narrower form, the over-torque mechanism operates when the handle is rotated in either of two different directions.

In another aspect of the present invention, a back for a seating unit includes a back frame with side frame members. Flexible primary supports extend between the side frame members and are configured to flex to provide comfortable support to a seated user. A covering extends between the side frame members and covers the side frame members and the flexible support members. A lumber device is located behind the covering in a lumbar area of the side frame members and includes flexible secondary supports that extend between the side frame members to supplement a supporting force of the primary support wires in a selected location, and includes a tube of fabric encapsulating a longitudinal portion of the secondary support wires.

In another aspect of the present invention, a seating unit includes a back frame having a top frame section extending across the back frame, a headrest mount adjustably attached to the back and defining a horizontal pivot axis, and a headrest adjustably attached to the headrest mount. The headrest mount includes first and second elongated structural components that engage upper and lower surfaces of the top frame section in a clamping arrangement that distributes stress from the headrest across the top frame section.

These and other aspects, objects, and features of the present invention will be understood and appreciated by those skilled in the art upon studying the following specification, claims, and appended drawings.

BRIEF DESCRIPTION OF DRAWINGS

FIGS. 67 and 68 showing assembly of upright members together, FIG. 69 showing the full assembly.

DETAILED DESCRIPTION OF PREFERRED EMBODIMENTS

Figure 1:
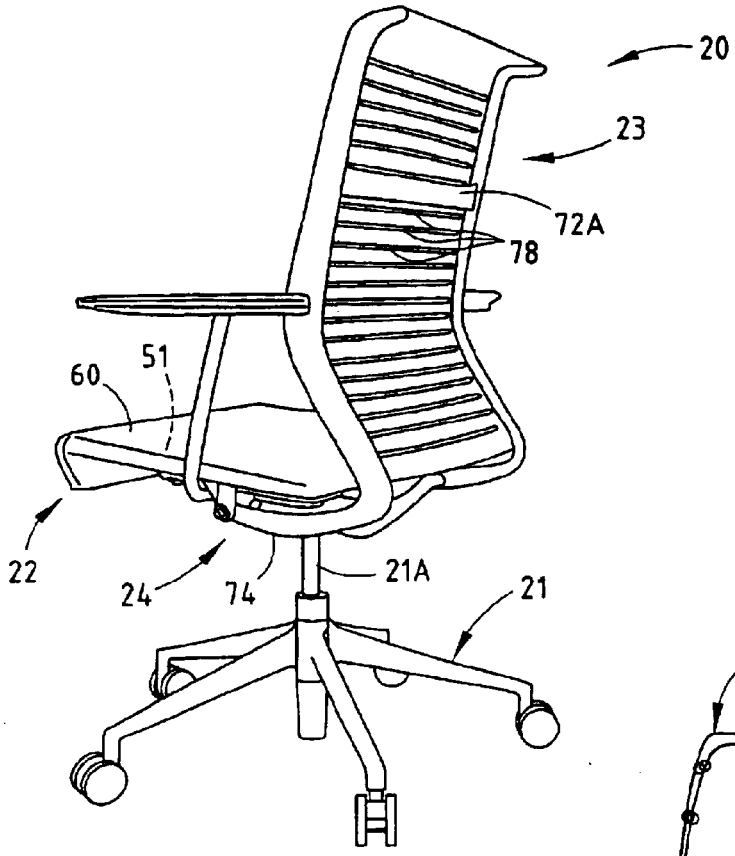
FIG. 1 is a perspective view of a seating unit embodying the present invention.

A chair 20 (FIG. 1) embodying the present invention includes a base 21, a seat 22, and a back 23, with the seat 22 and back 23 being operably supported on the base 21 by an underseat control mechanism 24 for synchronous movement upon recline of the back 23. Upon recline, the control mechanism 24 moves and lifts the seat 22 upwardly and forwardly, such that the back 23 (and the seated user) is automatically provided with a weight-activated back-supporting force upon recline. Advantageously, heavier-weight seated users receive greater back-supporting force, thus eliminating (or at least reducing) the need for them to adjust a tension device for back support when reclining in the chair. The seat 22 (and also the back 23) includes a highly comfortable support surface formed by a locally-compliant support structure (hereafter called "a comfort surface") that adjusts to the changing shape and ergonomic support needs of the seated user, both when in an upright position and in a reclined position. Specifically, the comfort surface changes shape in a manner that retains the seated user comfortably in the chair during recline, yet provides an optimal localized ergonomic support to the changing shape of the seated user as the user's pelvis rotates during recline. In addition, the chair 20 avoids placing an uncomfortable lifting force under the seated user's knees and thighs, by well-distributing such forces at the knees and/or by flexing partially out of the way in the knee area. Further, comfort surfaces of the seat 22 and back 23 create a changing bucket shape (FIGS. 2A and 2B) that "grips" a seated user and also actively distributes stress around localized areas, such that the seated user feels comfortably retained in the seat 22, and does not feel as if they will slide down the angled/reclined back and forward off the seat during recline, as described below.

The illustrated control mechanism 24 also has several advantages and inventive aspects. The control mechanism 24 includes a "booster" mechanism 25 (FIG. 19) that can be engaged (with low effort) to provide an even greater back support upon recline, if the seated user desires the additional support upon recline. Advantageously, the control mechanism 24 has a thin profile and is very cost-effective to manufacture and assemble, such that it can be well integrated into chair designs having a thin side profile. The combination of the comfort surface on the seat 22 and back 23 (FIG. 1) with the control mechanism 24 provides a surprising and unexpected result (as understood in "patent law" terminology) in the form of a very comfortable and supportive "ride" in all positions of the chair, including upright and recline positions. The comfortable "ride" is at least partially due to the fact that, while the seat lifts upon recline to provide a weight-activated back support force, the seat 22 and back 23 surfaces dynamically change shape to relieve pressure behind the seated user's knees. Also, the comfort surfaces of the seat 22 and back 23 also create a changing bucket (see FIGS. 2A and 2B) to support the pelvis as it "rolls" and changes shape during recline, which counteracts the gravitational forces causing the seated user's body to want to slide down the reclined/angled surface of the back 23 and slide forward off the seat 22. Also, the booster mechanism 25 on the control mechanism 24 is very easy to engage or disengage, (almost like a switch that flips on or off) making it more likely to be used. Also, this allows the booster mechanism 25 to be operated by an automatic control and/or by remote devices, including electronically, mechanically, and in other ways. Advantageously, all major components of the chair 20, including the control mechanism 24, are separable and recyclable, thus facilitating repair, and promoting components and processes that are friendly to the environment, while maintaining low cost, efficient assembly, relatively few complex parts, and other competitive advantages.

The seat 22 (FIGS. 3–4) includes a molded perimeter frame 30 made of nylon or the like. The illustrated frame 30 is semi-rigid, but is able to flex and twist a limited amount so that the frame 30 gives and moves with a seated user who is reaching and stretching for items while doing work tasks. The frame 30 includes a U-shaped rear with horizontal side sections 31 connected by a transverse rear section 32, and further includes a U-shaped front 33 that connects a front of the side sections 31. It is contemplated that the perimeter frame 30 can be a single-piece molding, or a multi-piece assembly. The illustrated frame 30 defines a continuous loop, but it is contemplated that the frame could also be U-shaped with an open front, for example. The U-shaped front 33 includes side sections 34 that connect to an end of the side sections 31 and extend downward and rearward, and further includes a transverse section 35 that connects the side sections 34. The U-shaped front 33 forms a "U" when viewed from a front, and angles downward and rearward, such that it leaves an upwardly open area in a front of the perimeter frame 30 at a location corresponding to the underside of a seated user's knees. This allows the perimeter frame 30 to avoid putting pressure on the bottom of a seated user's knees upon recline, even though the seat 22 is raised, as described below.

The side sections 31 include a series of notches 36 (six such notches are illustrated) at about 3 to 7 inches rearward of a front end of the side sections 31, or more preferably 4 to 6 inches. The notches 36 create a flex point, which causes a front section 37 of the side sections 31 to flex downwardly when pressure is placed on the front end of the side sections 31. For example, front section 37 will flex when the front of the seat 22 is lifted against the knees of a seated user and the user is lifted, which occurs during recline of back 23.

In a modified seat subassembly, the notches 36 are eliminated, and the section 37 is made semi-flexible. Also, it has been found very useful to provide triangular abutment ribs 36' integral to the section 37 and having a face 36" that, after limited angular flexure, is adapted to abut a front of the support 38. Thus, after the limited angular flexure, the triangular rib 36" increases the resistance to further angular bending of front section 37.

A pair of tracks 38 is attached to the bottoms of the side sections 31 rearward of the notches 36. The pair of tracks 38 is adapted to slidably engage a seat support structure for providing a depth-adjustable feature on the chair 20. Nonetheless, it is noted that the present inventive concepts can be used on chairs not having a depth-adjustment feature.

Figure 3:
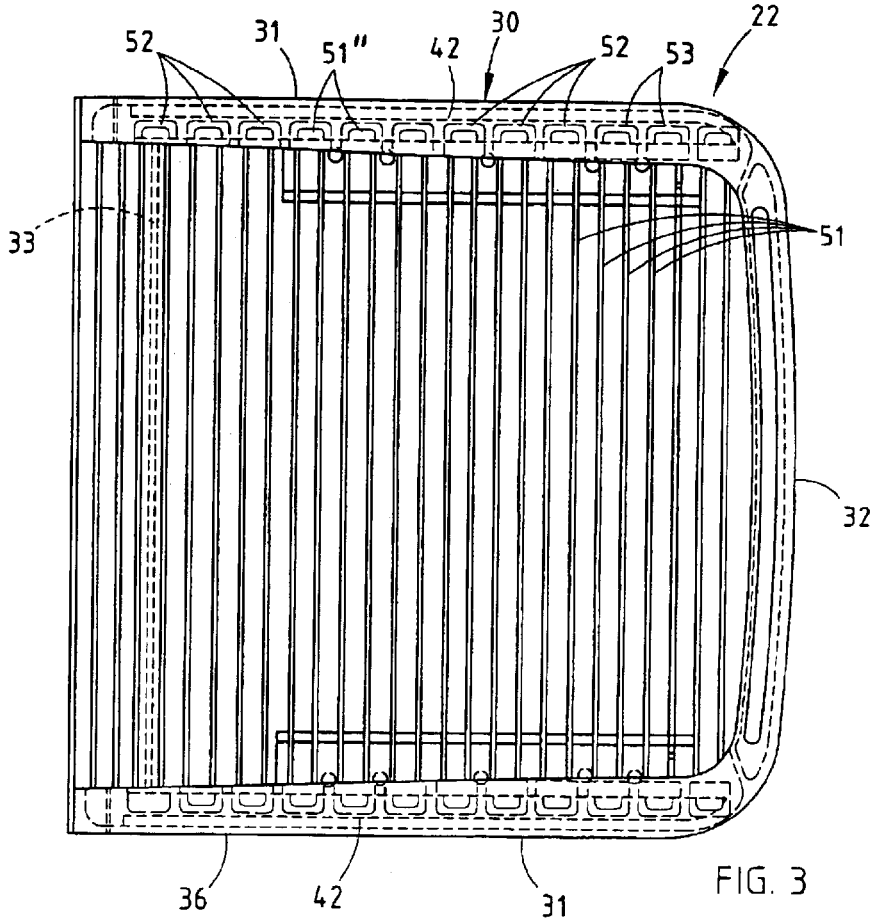
FIGS. 3–4 are plan and side views of the seat of FIG. 1.
Figure 4:
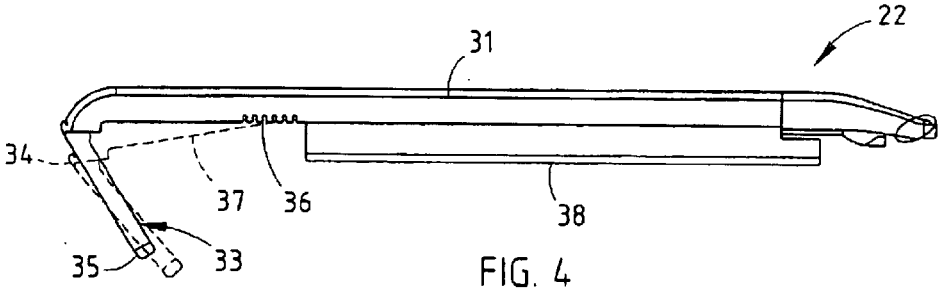
Figure 4A:
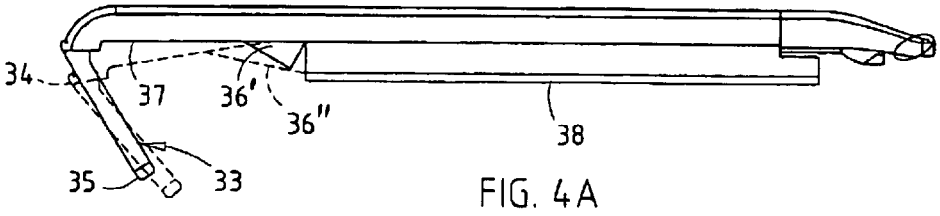
FIG. 4A being a variation of FIG. 4.
Figure 5:
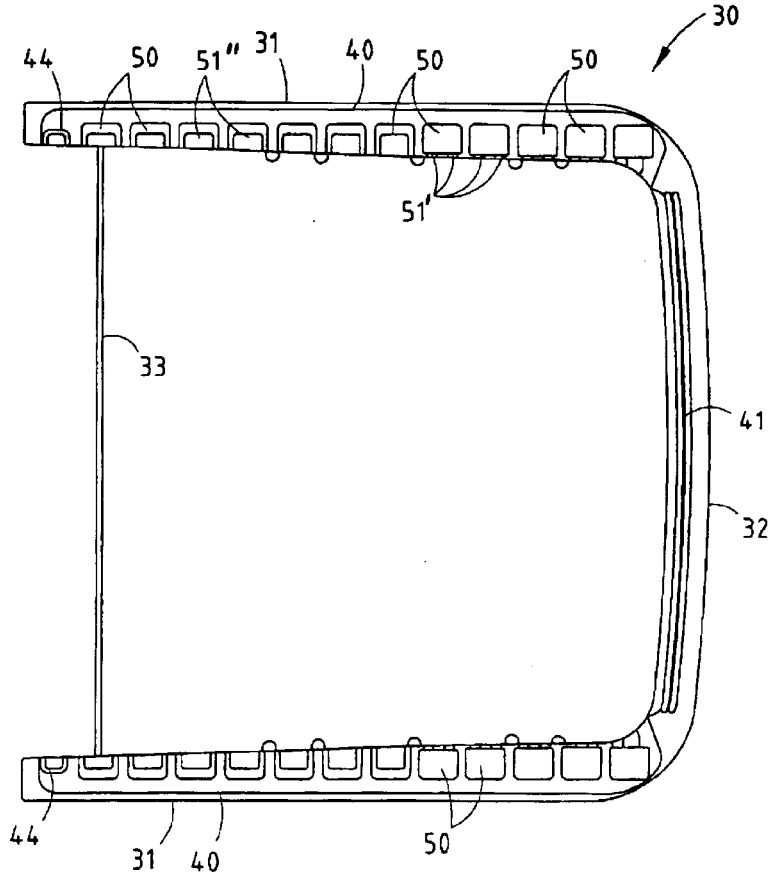
FIGS. 5–6 are plan and side views of the seat frame of FIG. 3.
Figure 6:
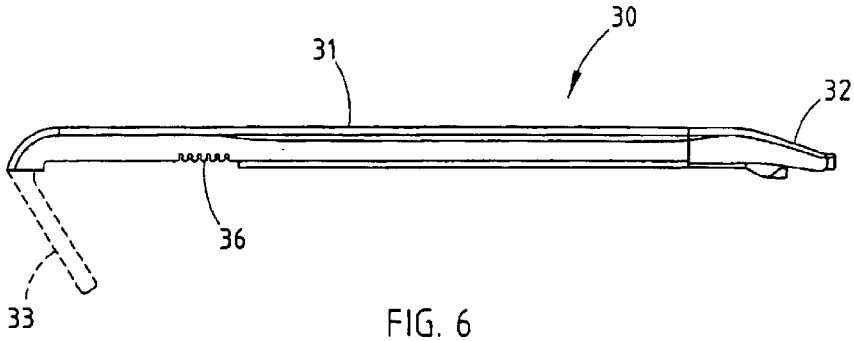
Figure 12:
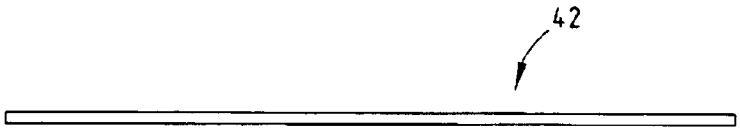

The side sections 31 of perimeter frame 30 (FIG. 5) each include longitudinally-extending recesses 40, respectively, in their top surfaces for receiving steel rods 42 (FIGS. 3 and 12). The steel rods 42 resiliently support and stiffen the side sections 31, particularly in the area of notches 36. As illustrated (in FIGS. 3–4), the recesses 40 are primarily located rearward of the notches 36, but also include a front portion that extends forward past the notches 36 to provide added resilient support for side sections 31 at the notches 36. It is noted that the rods 42 can be different shapes or sizes, or multiple rods can be used. Also, different materials can be used in the rods 42, if desired, such as plastic or composite materials. However, the illustrated rods 42 are linear and made of a "hard-drawn spring-steel" for optimal strength, low weight, long life, and competitive cost. Further, they are mechanically attached into position in their front and rear. It is contemplated that the rods 42 could also be insert-molded, snapped in, or otherwise secured in place.

The comfort surface of the seat 22 (FIG. 3) (and of the back) are formed by individual support members 45 with parallel long sections 51 and U-shaped end sections 52 that slidably engage pockets 50 in the side sections 31. There are thirteen pockets 50 illustrated, but it is contemplated that more or less could be included depending on the chair design and functional requirements of the design. Further, the multiple pockets 50 could be replaced with continuous long channels formed longitudinally along the side sections 31, if desired. Each pocket 50 includes inwardly facing pairs of apertures 51' (FIG. 5) with an "up" protrusion 51" formed between the apertures 51'. The end sections 52 of the front eight support members 45 are positioned in and directly slidably engage the front eight pockets 50 for limited inward and outward movement, while the end sections 52 of the rear five support members 45 are carried by bearings 53 in the rear five pockets 50, as discussed below. The inboard surface of the pockets 50 (i.e. the "up" protrusion 51" formed between the apertures 51') forms a stop for limiting inward sliding movement of the end sections 52 of the support members 45. By doing this, it limits the downward flexing of the long sections 51 with a "sling"-type action when a person sits on the comfort surface of the seat 22. Notably, this results in a "soft" stopping action when a seated user reaches a maximum flexure of the long sections 51. Part of the reason for the "soft" stopping action is the inward flexure of the side sections 31 as the end sections 52 bottom out in the pockets 50, but also part of the "soft" stopping action is due to the independent action of the individual support members 45 and due to the paired arrangement of the long sections 51 on the support members 45. By this arrangement, a seated user remains comfortable and does not feel a sharp and sudden stop that is uncomfortable, even though the seat 22 is held to a maximum depression.

Figure 11:
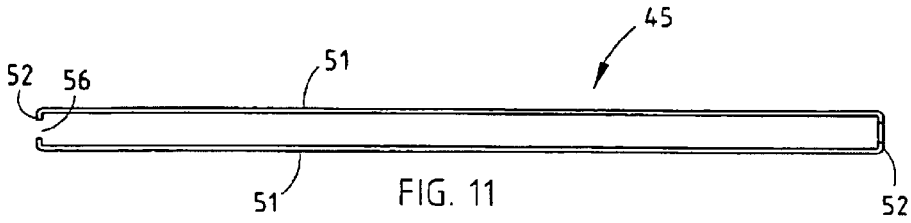
FIGS. 11–12 are plan views of two different wires used in the seat shown in FIG. 3.

Support members 45 (FIG. 7) are hard-drawn spring steel rods (FIG. 11) having a circular cross section. The rods (i.e. support members 45) are bent into a rectangular loop shape with relatively sharply bent corners, and include parallel/linear long sections 51 and flat/short end sections 52. The illustrated end sections 52 have relatively sharply bent corners, such that they form relatively square U-shaped configurations. Also, one of the illustrated end sections 52 has opposing ends of the wire that abut, but that are unattached. It is contemplated that the abutting ends in the one end section 52 could be welded together if needed, but this has not been found necessary in the present chair 20, particularly where bearings 53 are used, as discussed below. It is also contemplated that individual linear rods could be used instead of the support members 45 being a rectangular loop shape with parallel long sections 51, if desired. In such event, the end sections 52 could be hook-shaped or L-shaped so that they engage the "up" protrusion in the pockets 50 for limited inwardly movement when a person sits on the seat 22. However, the interconnection of adjacent pairs of long sections 51 by end sections 52 can provide an additional stability and "coordinated" cooperative movement in the pairs that is believed to have beneficial effects. In particular, the rear five support members 45 with bearings 53 undergo considerable movement and flexure as a seated user reclines and/or moves around in the chair 20, such that bearings 53 with coupled wire sections 51 have been found to be desirable with those five support members 45.

Figure 8:
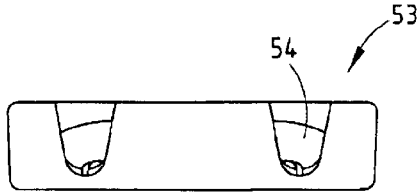
FIGS. 8–10 are side, top, and end views of a bearing shoe used to slidably support an end of one of the wires shown in FIG. 7.
Figure 9:
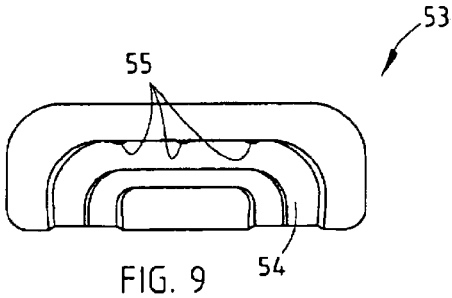
Figure 10:
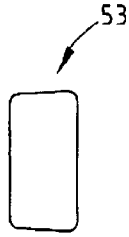

As noted above, the rearmost five support members 45 (FIG. 7) include bearing shoes 53 (also called "bearings" herein) (FIGS. 8–10) that are attached to the end sections 52. The bearing shoes 53 are made of acetal polymer and are shaped to operably fit into the pockets 50 for oscillating (inward and outward) sliding movement in a transverse direction as a seated user moves around in the chair 20 and as the long sections 51 of the support members 45 flex. The bearing shoes 53 include a U-shaped channel 54 shaped to mateably receive the U-shaped end sections 52. The bearing shoes 53 can include a friction tab at locations 55 for snap-attachment to the U-shaped end sections 52, if desired, though a friction tab is not required per se when a top cap is provided that captures the bearing shoes 53 in the pockets 50. Notably, the bearing shoes 53 retain together the end sections 52 having the wire ends that touch each other even where the abutting ends of the wire are not attached directly together by welding.

Figure 7:
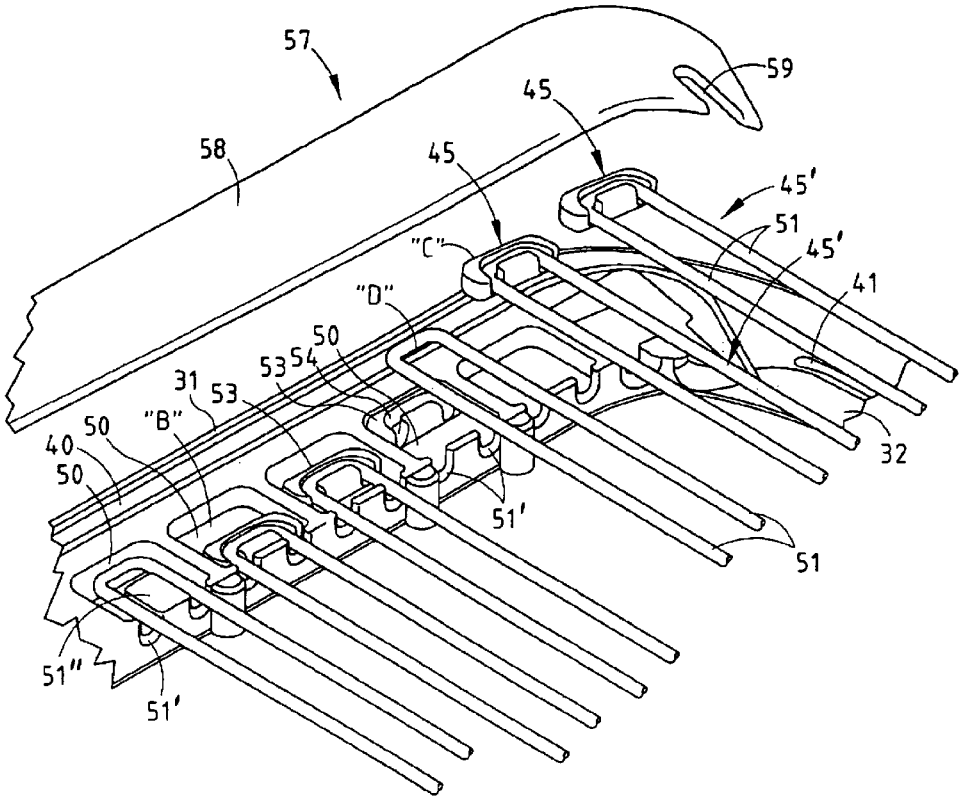
FIG. 7 is a partially exploded perspective view of a corner section of the seat in FIG. 3.
Figure 13:
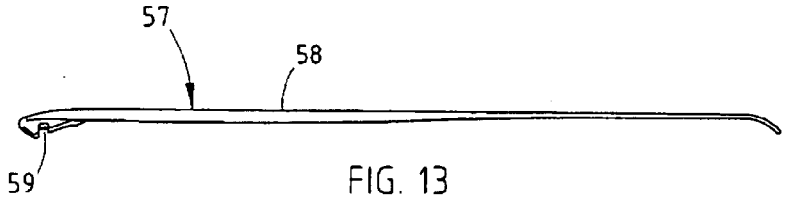
FIGS. 13–14 are side and plan views of a cover for side sections of the seat frame shown in FIGS. 5–6.
Figure 14:
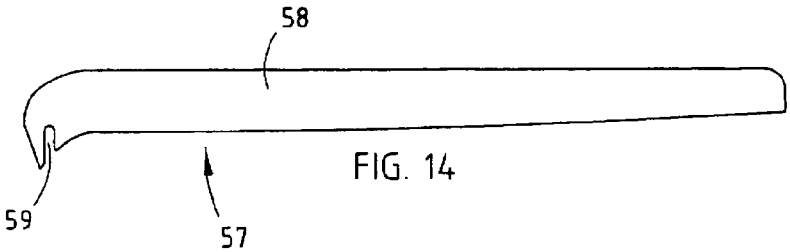

Right and left top caps 57 (FIGS. 13–14) are screw-attached, heat-staked, or otherwise attached to the side sections 31. The top caps 57 (FIG. 7) include a body 58 shaped to cover the pockets 50 and operably hold the bearing shoes 53 in place. A rear of the body 58 extends laterally and potentially includes a slot 59 to better cover a rearmost one of the pockets 50 while still allowing the rearmost wire long section 51 to freely flex (FIG. 7). It is contemplated that the side sections 31 and top caps 57 will both be made of nylon, and the bearing shoes 53 made of acetal, because these materials have a very low coefficient of friction when engaged with each other. Further, the apertures 51' (FIG. 7) are oversized to be larger than a diameter of the long sections 51 of the rod support members 45, such that there is no drag during flexure of the support members 45 and concurrent movement of the bearing shoes 53 in the pockets 50.

The illustrated seat 22 (FIG. 1) is covered with a fabric 60, and potentially includes a top thin foam or non-woven PET fiber cushion under the fabric 60 on both the seat 22 and the back 23. However, it is contemplated that the seat 22 and/or back 23 may not require a foam cushion because, based on testing, the present seat 22 is so comfortable that a cushion is not necessary. Further, the space between the wire sections 51 allows the construction to breathe, so that a seated user does not become sweaty while resting on the present chair 20, which can also be a competitive advantage. A thin topper cushion or webbing could also be used under the fabric for aesthetics, if desired.

Figure 2:
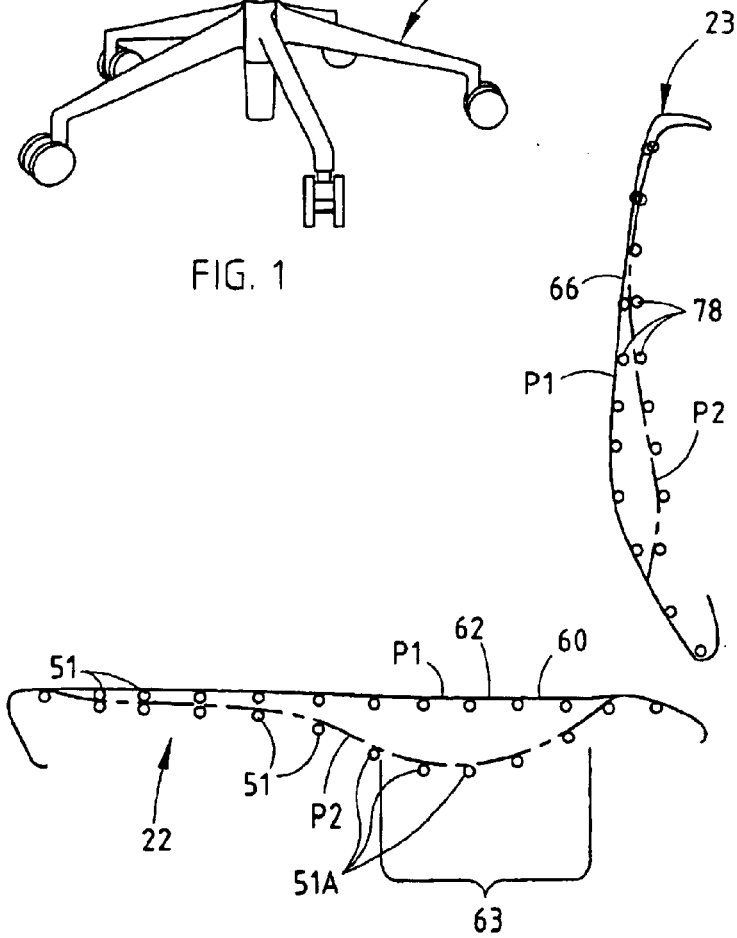
FIG. 2 is a schematic cross-sectional view showing the position of the transverse wires in the seat and back of FIG. 1, the wire support members being shown in solid lines without a seated user and being shown in phantom lines with a seated user in an upright position.

The present arrangement of seat 22 offers several advantages. Assembly is easy, and it is difficult to incorrectly assemble the seat. By the present arrangement, each different pair of wire sections can be flexed different amounts, and further, each long section 51 in a given support member can be flexed more or less (and can be flexed in a different direction) than the other long section 51 in the pair. The pockets 50 engage the bearing shoes 53 and limit their movement, such that they in turn limit flexure of the wire long sections 51 to a maximum amount so that the support surface cannot flex "too far". Based on testing, the maximum limit of flexure provided by the pockets 50 is a soft limit, such that a seated user does not feel an abrupt stop or "bump" as the maximum flexure is achieved. It is noted that the present wire long sections 51/52 are all the same diameter and shape, but they could be different diameters, stiffnesses, or shapes. The individual wire long sections 51 travel to support a seated user's body along discrete and independent lines of support, with the wire long sections 51 moving in and out to meet the body and support the user. Specifically, as a seated user reclines, the wires move and flex to create a shifting new "support pocket" for the seated user. FIG. 2 shows the comfort surface 60 of the seat 22 as being relatively flat (i.e. position P1, see solid lines) when there is no seated user resting on the seat 22. (i.e. The wire long sections 51 of the support members 45 of the seat 22 are located in a generally horizontal common plane.) When a seated user sits in the chair 20 in an upright position, the comfort surface 60 flexes to a new shape (i.e. position P2, see phantom lines), which includes an "upright position" support pocket 63 formed by (and which receives and supports) the protruding bone structure, muscle, and tissue of a seated user's hips. As the seated user reclines the back 23 toward a fully reclined position (FIG. 2A), the comfort surface 60 flexes to a new shape (i.e. position P3, see dashed lines), which includes a newly formed "recline position" support pocket 65 formed by (and which receives and supports) the protruding portion, muscle, and tissue of a seated user's hips. Notably, the support pocket 65 formed in the seat 22 while in the recline position (FIG. 2B) is located rearward of the support pocket 63 formed in the seat 22 when in the recline position (see FIG. 2B, where a shape of the seat in the upright and reclined positions is overlaid to better show the shape change). This is caused by a rolling motion of the hips during recline. The long sections 51 of rod support members 45 are independent and provide a localized freedom and dynamic of movement able to comfortably accommodate the rolling activity of the hips of a seated user in a novel and unobvious way not previously seen in task chairs.

Figure 2A:
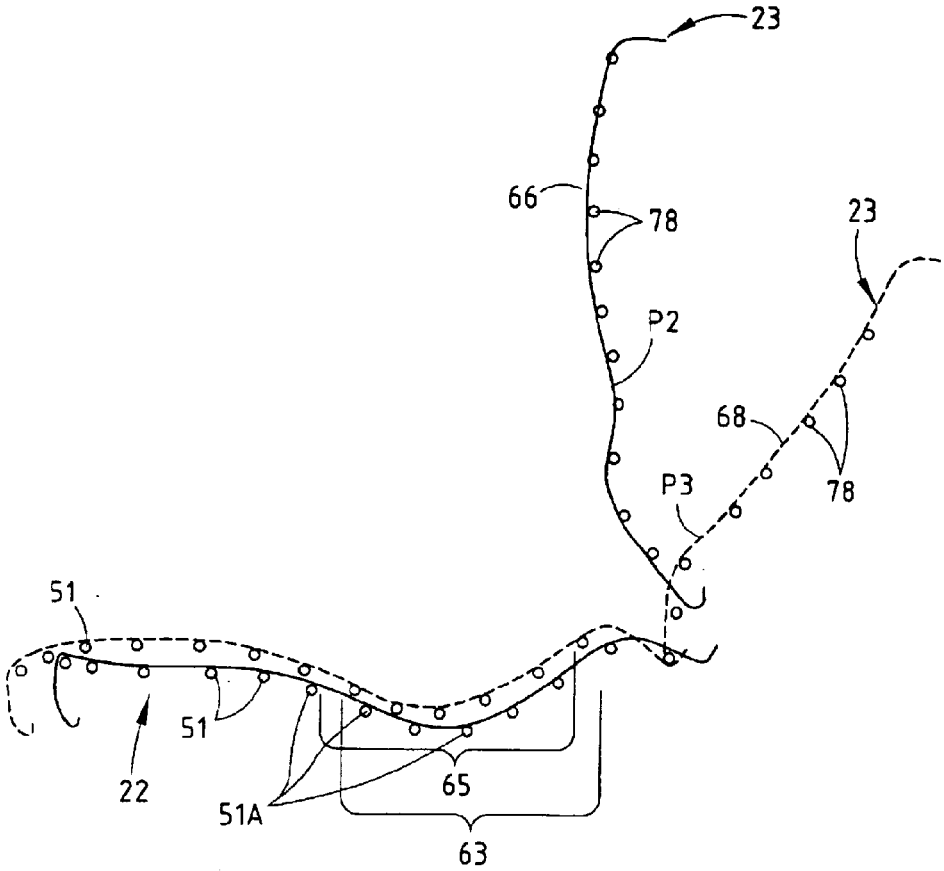
FIG. 2A is a view similar to FIG. 2, but showing the chair with a seated user in the upright position in phantom lines and in a reclined position in dashed lines.

The back 23 (FIG. 2) also undergoes a shape change, as shown by the comfort surface 66 in the unstressed position P1 (unstressed, no seated user), the flexed comfort surface 66 in the upright stressed position P2 ("upright position" with seated user), and the flexed reclined comfort surface 66 in the reclined stressed position P3 ("recline position" with seated user) (FIG. 2A).

The pairs of long wire sections 51 act in a coordinated distributed dynamic fashion (primarily in a vertical direction) that provides an optimal comfort surface. This is a result of the constrained/limited movement of the bearing shoes 53 on adjacent pairs of the long sections 51 of the rod support members 45 and also is a result of the fabric 60 as it stretches across and covers the long sections 51. Nonetheless, it is noted that an extremely comfortable support can be achieved even without the fabric 60, because the long sections 51 flex in a manner that does not pinch or bind the seated user as the shape of the support pocket for their body changes.

It is noted that the long sections 51 in the seat 22 flex and move to provide support primarily vertically, but that some of the long sections 51 may have a horizontal or angled component of movement and/or may provide a horizontal or angled component of force to a seated user. In particular, the long sections 51 located at a front of the "recline" support pocket 65 (see wires 51A) tend to engage any depression in the flesh of a seated user at a front of the seated user's protruding hip area (i.e. behind the seated user's thighs and in front of the seated user's "main" hip area) which tends to securely hold the seated user in the seat 22. This occurs regardless of the location of the depression in the flesh of a particular seated user, due to the plurality of independently flexible long sections 51 in the seat 22. This added holding power appears to be important in preventing seated users from feeling like they will slide down an angled back (such as during recline) and forward and off the seat. The present inventors believe that this benefit, though subtle, is a very important and significant advantage of the chair 20. Notably, even with a fabric cover, there may be a horizontal component of force provided by the long sections 51, limited only by the movement of the long section 51 under the fabric, the stretchability of the fabric, the movement of bearing shoes 53, and the forces generated by the rolling action of the seated user's hips.

Figure 2B:
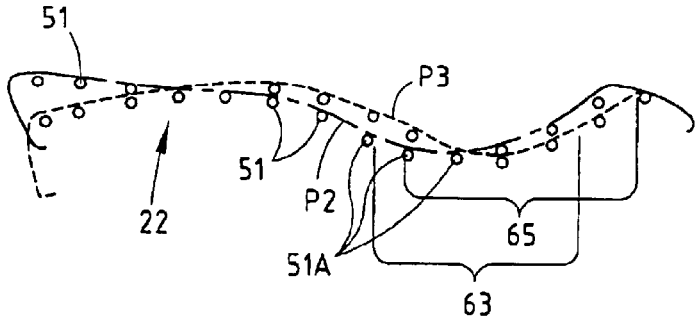
FIG. 2B is a schematic view similar to FIG. 2A, but with the change in shape of the seat being overlaid to eliminate forward shifting movement of the seat during recline.

The operation of the seat 22 is illustrated in FIGS. 2–2B. FIG. 2 shows flexure of a center of the long sections 51 of the support member 45 between the unstressed state (i.e. no seated user, see solid lines P1), and a stressed state (i.e. with a seated user, see phantom lines P2) (both in an upright position of the chair 20). FIG. 2A shows the chair 20 with a seated user in the chair 20 in the upright position (solid lines) and a reclined position (dashed lines). FIG. 2B is a schematic view intended to show the change of shape in the comfort surface of the seat 22 between the upright position (see solid lines P2) and the reclined position (see dashed lines P3). In FIG. 2B, the seat 22 is compared as if it did not move forward upon recline, to better show the change in shape of the "pocket" in the seat 22 where the seated user's hips are located. Nonetheless, it is noted that the seat 22 does move forward during recline in the resent chair 20.

FIG. 7 shows some of the support members 45 with long sections 51 unstressed (i.e. that are located in an outboard position in their respective pocket 50), and shows some of the rod support members 45 with wires 51 flexed (i.e. see the bearing shoes 53 at location "B" that are located in an inboard position in their respective pocket 50). FIG. 7 also shows some of the bearing shoes 53 exploded out of the pockets 50 and pre-attached to ends of the rod support members 45 (see location "C"). The bearing shoes 53 are ready to drop downward into the pockets 50, which illustrates a first assembly technique. FIG. 7 also shows one of the bearing shoes 53 positioned in a pocket 50, with the associated rod support member 45 being positioned above it and ready to be moved downward into engagement with the recess in the bearing shoe 53 (see location "D"), which illustrates a second assembly method.

Figure 15:
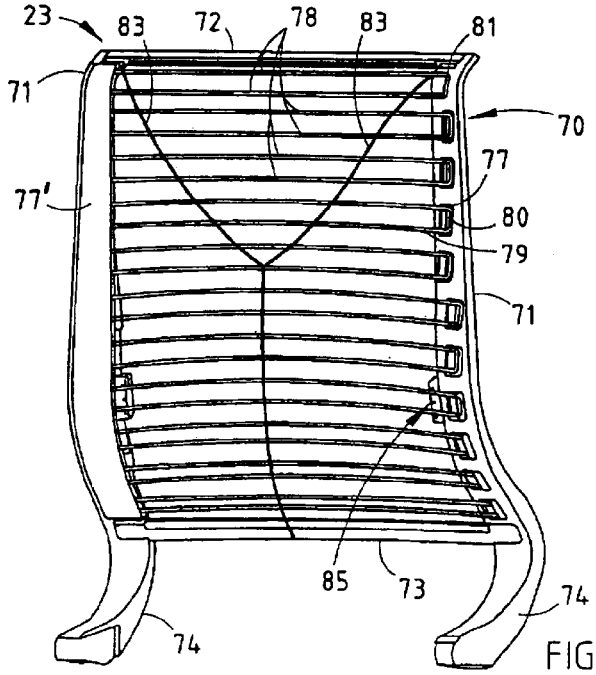
FIGS. 15–16 are front and rear perspective views of the back shown in FIG. 1.
Figure 16:
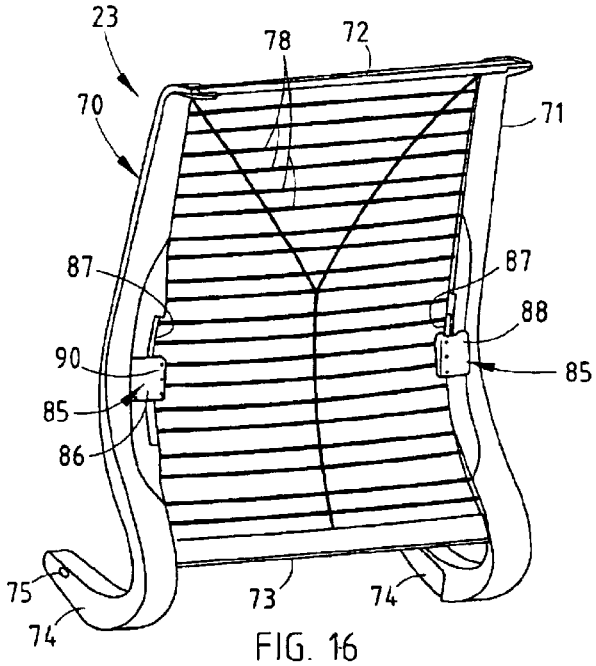

The back 23 (FIGS. 15–17) is similar to the seat 22. Thus, a detailed description of the back 23 is not required for an understanding by a person skilled in this art, since it would be quite redundant. Nonetheless, a description follows that is sufficient for an understanding of the present invention as used on backs, in view of the discussion regarding seat 22 above.

Briefly, the back 23 (FIGS. 15–17) includes a back perimeter frame 70 composed of L-shaped side frame members 71. Top and bottom transverse frame members 72 and 73 are attached to the side frame members 71 to form a semi-rigid perimeter. The frame 70 can be one-piece or multi-piece. An additional transverse frame member 72A (FIG. 1) can also be added, if needed, for strength and stability. The side frame members 71 include forwardly-extended lower sections 74 extending below the bottom transverse frame member 73. The lower sections 74 are pivoted to a seat support 122 of the control mechanism 24, at location 75, and are pivoted to a flexible arm part of the control mechanism 24 at location 141, as described below.

Similar to the seat 22, the back side frame members 71 include pockets 77 (see seat frame pockets 50), covers 77' covering the pockets 77 (only a left cover 77' is shown), and support members 78 (similar to seat support members 45) are provided as hard-drawn spring steel wires with long sections 79 (similar to seat long sections 51). Several of the support members 78 have ends that are operably supported by bearing shoes 80 (similar to bearing shoes 53). Notably, the illustrated back support members 78 come in two different lengths because the back 23 has a smaller top width and a larger bottom width. (See FIG. 15 and notice the change in position of the pockets 77 at a middle area on the side frame members 71.) The top half of the side frame members 71 includes a plurality of U-shaped pockets 81 for receiving a wire 79 without a bearing shoe 80. A top edge of the top frame member 72 is U-shaped and bent rearwardly for increased neck support and comfort to a seated user. Wire strips 83 extend from the top corners of the back frame 70 to a center point located between a seated user's shoulders, and then extend downward into connection to a center of the bottom transverse member 73. When tensioned, the wire strips 83 cause the comfort surface of the back (i.e. support members 78) to take on an initial concave shape (sometimes referred to as a "PRINGLES®(potato chip shape"). This concave shape increases the comfort by providing a more friendly "pocket" in the back 23 for a seated user to nest into when they initially sit in the chair 20. This same pretension on the wires 78 can be caused by tensioning the upholstery cover on the back between upper and lower edges of the upholstery. Thus, wire 83 can be eliminated, if desired.

Figure 17:
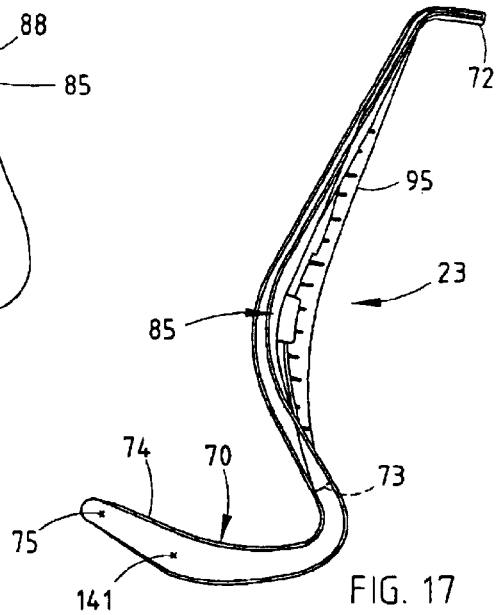
FIG. 17 is a side view of the back shown in FIG. 15.

An adjustable lumbar support 85 (FIGS. 15–17) is provided on the back that includes a pair of bodies 86 slidably connected to an inboard rib 87 on each of the side frame members 71. The bodies 86 may (or may not) be connected by a cross member. The bodies 86 are located behind the wires 79 adjacent the side frame members 71 and the wires 79. Handles 88 extend from a rear of the bodies 86 for grasping by a seated user reaching behind the back 23. The bodies 86 each include a flange 90 that engages a section of the wires 79 as the wire extends in an inboard direction out of the pockets 77. By adjusting the bodies 86 vertically, the flanges 90 move behind different wires 79, causing a different level of support (since an effective length of the supported wires are shortened). Alternatively, the flange 90 can physically engage and bend the wires 79 when vertically adjusted, if desired. FIG. 17 also shows a maximum of rearward flexure of the wires 79, as shown by the line 95.

Figure 18:
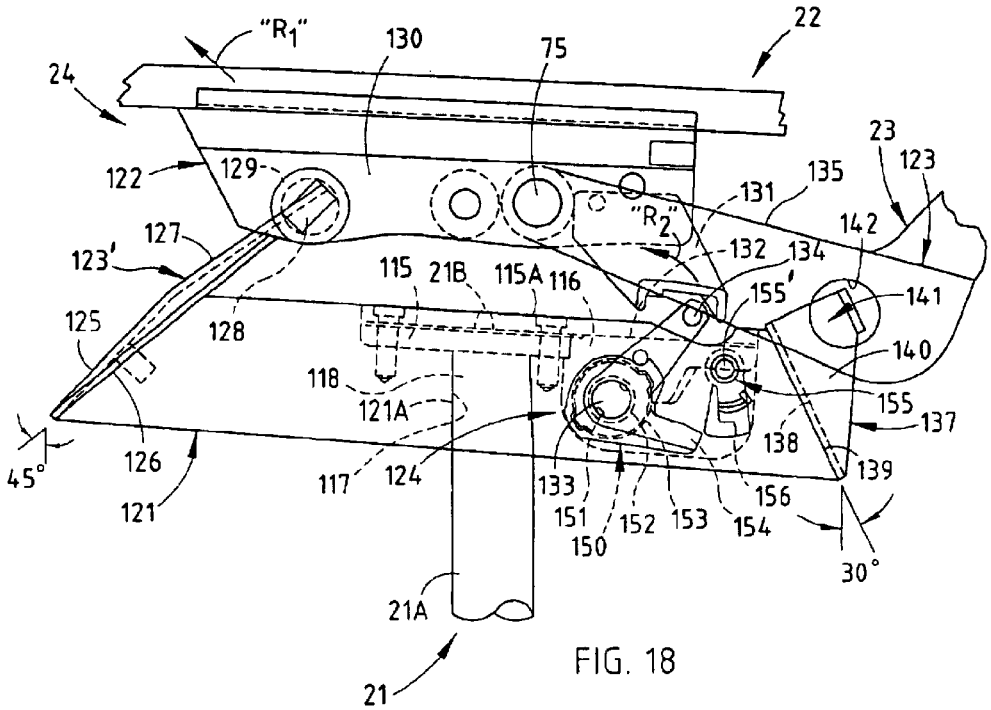
FIG. 18 is a side view of the underseat control shown in FIG. 1.

The present control mechanism 24 (FIG. 18) includes a stationary base support 121 forming a part of the base 21. The seat 22 includes a seat support 122, and the back 23 includes a back support 123. The seat and back supports 122 and 123 are operably attached to the base support 121 as follows. The base support 121 includes an upwardly-facing recess 115 covered in part by plate 115A. The recess 115 forms a first pocket 116 for receiving the booster mechanism 25. The recess 115 also forms a tapered second pocket 117 that extends vertically down through the base support 121 for receiving the tapered top section 118 of a height adjustable post 21A. The illustrated base 21 (FIG. 1) includes a hub at a bottom of the post 21A, radially extending side sections extending from the hub, and castors at ends of the side sections for supporting the chair 20. A lockable pneumatic spring is incorporated into the post 21A for providing counterbalancing support during height adjustment. The post 21A (FIG. 18) includes a vertically-actuated release button 21B positioned at a top of the base support 121. In this location, the release button 21B can be actuated by a handle (not shown) operably attached to a top or side of the base support 121, with the handle being pivotally or rotationally movable to selectively cause the handle to depressingly engage the release button 21B and release the pneumatic spring for height adjustment of the chair. Though one particular base is illustrated, it is specifically contemplated that a variety of different chair bases can be used in combination with the present chair 20.

The seat support 122 (FIG. 36) is operably supported on the base support 121 by a front leaf spring 123' and by a pivot mechanism 124 spaced rearward of the leaf spring 123'. Specifically, the front leaf spring 123' includes a center portion 125 supported on and attached to an angled front surface 126 (oriented at about 45°) of the base support 121 by threaded fasteners, and includes arms 127 having barrel-shaped or spherically-shaped bearings 128 on each end that slidably and rotatably fit into cylindrical recesses 129 in side members 130 of the seat support 122. The bearings 128 are barrel-shaped instead of cylindrically-shaped, so that the bearings 128 permit some non-axial rotation and axial sliding as the arms 127 flex, thus helping to reduce high stress areas and accommodating a wider range of movement during recline. However, it is contemplated that different bearing arrangements are possible that will still meet the needs of the present inventive concepts.

Figure 36:
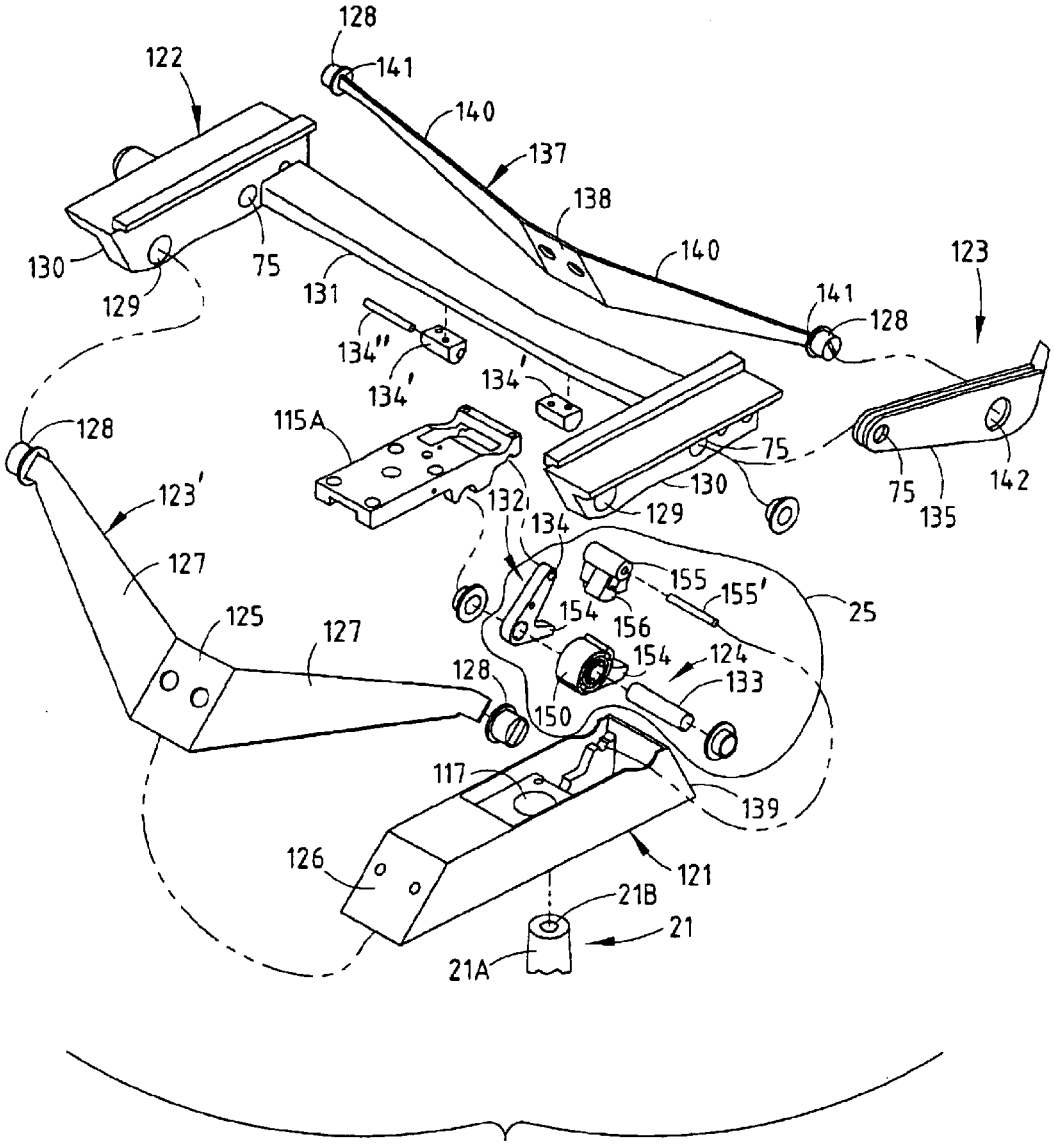
FIG. 36 is an exploded perspective view of FIG. 33.
Figure 34:
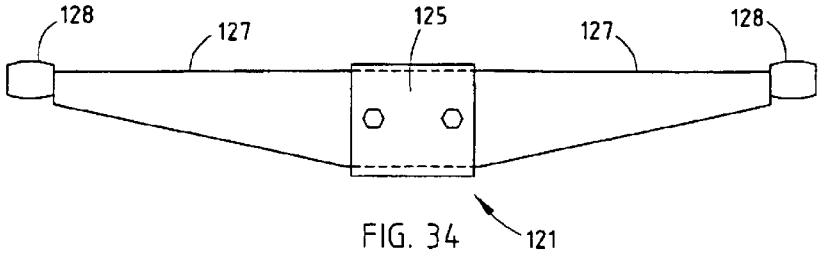
FIGS. 34–35 are front and top fragmentary views of the control shown in FIG. 33, the top view being taken perpendicular to a face of the compliant support.
Figure 35:
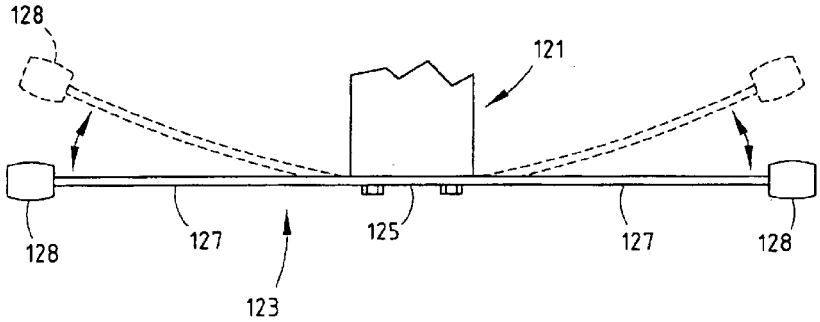

The side members 130 are rigidly interconnected by a cross beam 131 (FIG. 36). The pivot mechanism 124 includes one (or more) pivoted arms 132 that are pivotally supported at one end on the base support 121 by a pivot pin 133, and pivotally connected to a center of the cross beam 131 at its other end 134 by pivot pin 134" and pin bearings 134'. Pin bearings 134' are attached to cross beam 131, such as by screws. The pivot pin 133 is keyed to the arm 132, so that the pivot pin 133 rotates upon movement of the seat (i.e. upon recline). Thus, the direction and orientation of movement of the seat support 122 (and seat 22) is directed by the linear movement of the bearing ends 128 as the arms 127 of leaf spring 123' flex (which is at a 45° angle forward and upward, see R1 in FIG. 38), and by the arcuate movement of the pivoted arm 132 on the pivot mechanism 124 as the pivot arm 132 rotates (which starts at a 45° angle and ends up near a 10° angle as the back 23 approaches a full recline position, see R2 in FIG. 38). The distance of travel of the front of the seat 22 is preferably anywhere from about ½ to 2 inches, or more preferably is about 1 inch upward and 1 inch forward, but it can be made to be more or less, if desired. Also, the vertical component of the distance of travel of the rear of the seat is anywhere from about ½ to 1 inch, but it also can be made to be more or less, as desired. Notably, the vertical component of seat movement is the component that most directly affects the potential energy stored during recline in the chair 20. Restated, the greater the vertical component of the seat (i.e. the amount of vertical lift) during recline, the more weight-activated support will be received by the seated user during recline.

Figure 38:
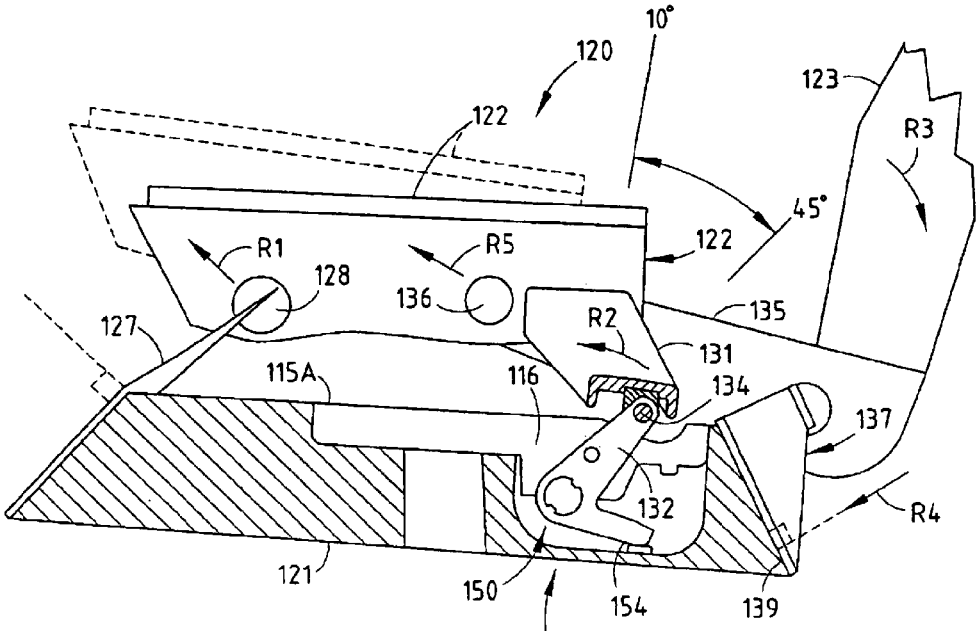
FIGS. 38–39 are cross sections taken along the line XXXIX in FIG. 33, and are side views of the control, seat, and back, FIG. 38 being in an upright position and FIG. 39 being a recline position, FIGS. 38–39 being similar to FIG. 18, but being simplified to show operation of the pivot link during recline.
Figure 39:
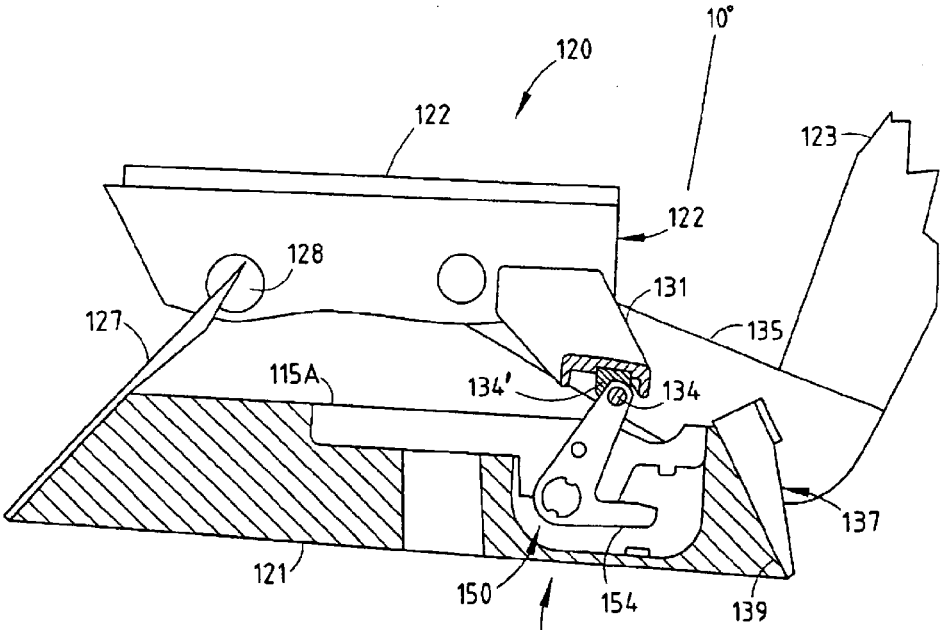

The back-supporting upright 123 (FIG. 36) includes side sections 135 pivoted to the side members 130 of the seat support 122 at pivot location 75, which is about halfway between the location of pivot 129 and the pivot 134. The illustrated pivot location 75 is about equal in height of the bearings 128 (see FIG. 19), although it could be located higher or lower, as desired, for a particular chair design. A rear leaf spring 137 (FIG. 36) includes a center portion 138 attached to a forwardly angled surface 139 on a rear of the base support 121, and includes arms 140 with barrel-shaped or spherically-shaped bearings 141 that pivotally and slidably engage a cylindrical recess 142 in the side sections 135 of the back upright 123. The rear surface 139 is oriented at about a 30° forward angle relative to vertical, which is an angle opposite to the rearward angle of the front surface 126. As a result, as the side sections 135 of the rear spring 137 are flexed during recline, the rear bearings 141 are forced to move forward and downward in a direction perpendicular to the rear angled surface 139 (see directions R3 and R4, FIG. 38). Thus, the pivot 75 drives the seat 22 forward along lines R1 and R2 upon recline, and in turn a reclining movement of the back 23 causes the seat support 122 to move forward and upward. As noted above, the movement of the seat support 122 is controlled in the front area by the flexure of the ends of the front spring 123, which moves the bearings 128 in a linear direction at a 45° angle (up and forward in direction "R1"), and is controlled in the rear area by the pivoting of the pivoted arm 132, which is arcuate (up and forward along path "R2"). The pivot arm 132 is at about a 45° angle when in the upright rest position (FIGS. 19 and 38), and is at about a 10° angle when in the full recline position (FIG. 39), and moves arcuately between the two extreme positions upon recline. The movement of the seat support 122 causes the pivot location 136 (FIG. 38) to move forwardly along a curvilinear path. As a result, the back upright 123 rotates primarily rearward and downward upon recline (see line R3), but also the lower side section 74 moves forward with a coordinated synchronous movement with the seat 22, as shown by arrows R1–R2 (for the seat 22) and R3–R5 (for the back 23) (FIG. 38).

Specifically, during recline, a rear of the seat support 122 initially starts out its movement by lifting as fast as a front of the seat support 122. Upon further recline, the rear of the seat support 122 raises at a continuously slower rate (as arm 132 approaches the 10° angle) while the front of the seat support 122 continues to raise at a same rate. The back 23 (i.e. back upright 123) moves angularly down and forward upon recline. Thus, the seat support 122 moves synchronously with the back upright 123, but with a complex motion. As will be understood by a person skilled in the art of chair design, that a wide variety of motions are possible by changing the angles and lengths of different components.

Figure 37:
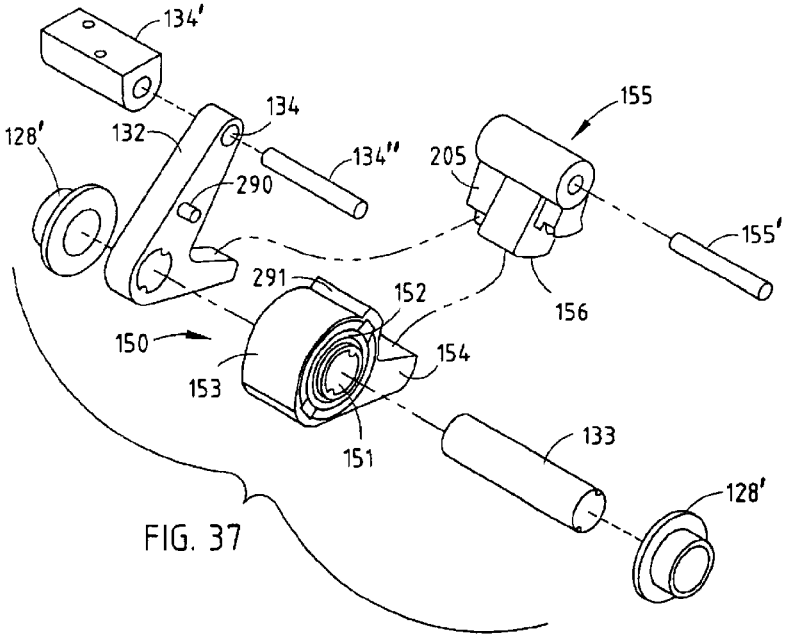
FIG. 37 is an enlargement of the energy boost mechanism shown in FIG. 36.

The booster mechanism 25 (FIG. 19) includes a torsion spring 150 mounted on the pivot pin 133 to seat support 121. The torsion spring 150 includes an inner ring 151 (FIG. 37) keyed to the pivot pin 133, a resilient rubber ring 152, and an outer ring 153 with an arm 154 extending radially outwardly. A stop member 155 is pivoted to the base support 121 by a pivot pin 155' (and is keyed to pivot pin 155') and includes a stop surface 156 that can be moved to selectively engage or disengage the arm 154. When the stop member 155 is moved to disengage the stop surface 156 from the arm 154 (FIG. 19), the torsion spring 150 freewheels, and does not add any bias to the control 120 upon recline. However, when the stop member 155 is moved to engage the stop surface 156 with the arm 154 (FIG. 20), the outer ring 153 is prevented from movement upon recline. This causes the torsion spring 150 to be stressed and tensioned upon recline, since the pivot pin 133 does rotate upon recline, such that the torsion spring 150 "boosts" the amount of energy stored upon recline, . . . thus adding to the amount of support received by a seated user upon recline. It is contemplated that the torsion spring 150 will be made to add about 15% to 20% of the biasing force upon recline, with the rest of the biasing force being supplied by the bending of the leaf springs 123 and 137 and by the energy stored by lifting the seat support and the seated user upon recline. However, the percentage of force can, of course, be changed by design to meet particular functional and aesthetic requirements of particular chair designs.

Figure 19:
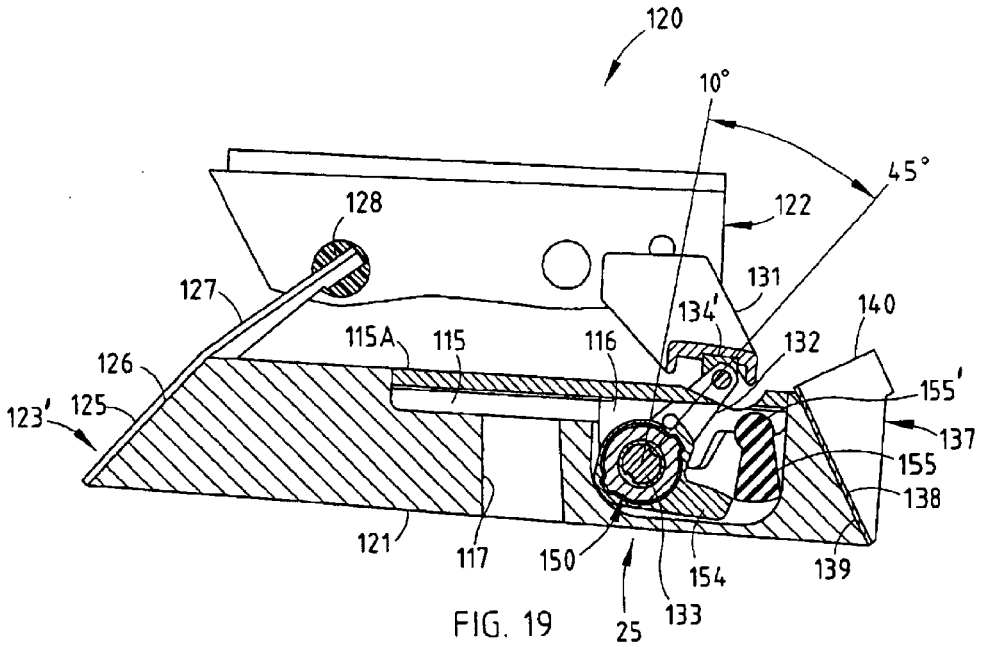
FIGS. 19–20 are cross-sectional views similar to FIG. 18, but showing cross-sectioned components, FIG. 19 being taken along line XIX in FIG. 33 and showing the booster mechanism disengaged, and FIG. 20 showing the booster mechanism engaged.
Figure 20:
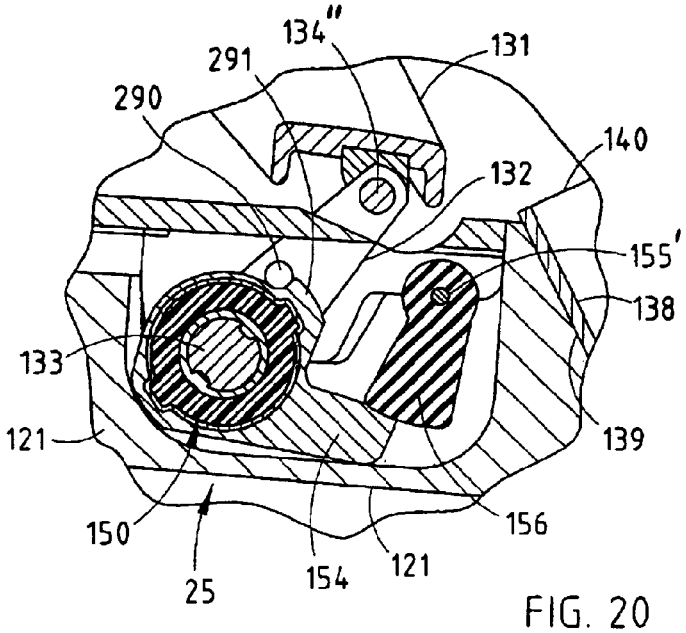

In operation, when the booster mechanism 25 is "off" (FIG. 19), the arm 154 moves freely as a seated user reclines in the chair. Thus, during recline as the seat rises and lifts the seated user, the flexible arms 127 and 140 of leaf springs 123' and 137 flex and store energy. This results in the seated user receiving a first level of back support upon recline. When additional support is needed (i.e. the equivalent of increased spring tension for back support in a traditional chair), the booster mechanism 25 is engaged by rotating stop member 155 (FIG. 20). This prevents the arm 154 from moving, yet pivot pin 133 is forced to rotate by the arm 154. Therefore, during recline, the rubber ring 152 of the torsion spring 150 is stretched, causing additional support to the seated user upon recline. In other words, the support provided to the back 23 during recline is "boosted" by engagement of the booster mechanism 25.

Figure 25:
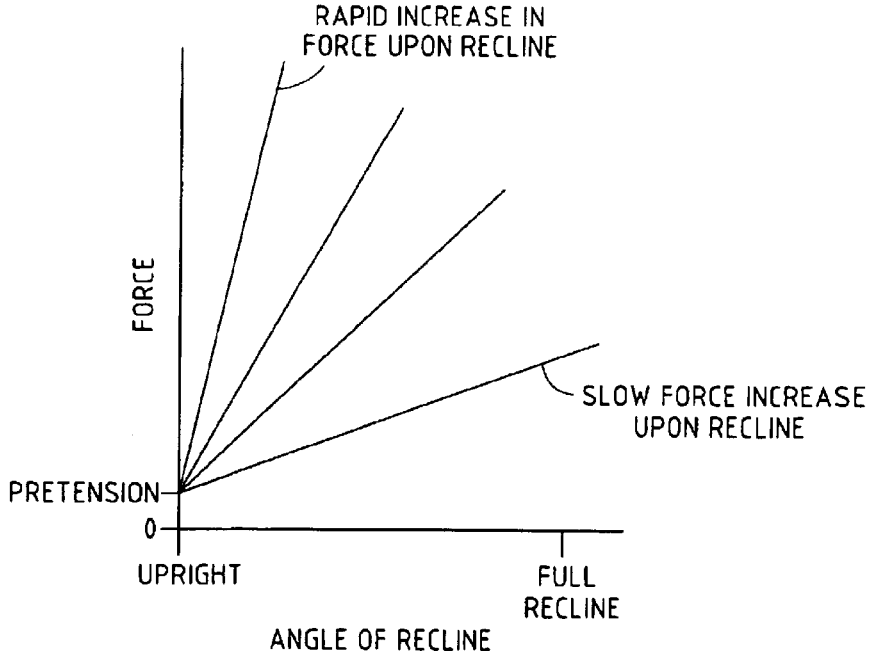
FIG. 25 is a graph showing different strength booster mechanisms on a chair where they provide selectively increasing amounts of energy as each successive one is engaged.

It is contemplated that several separate torsion springs 150 can be added to the axle of pivot pin 133, and that they can be sequentially engaged (such as by having their respective stop members 155 engage at slightly different angles). This would result in increasing back support, as additional ones of the torsion springs were engaged. (See FIG. 25.) In another alternative, it is contemplated that a single long rubber ring 152 could be used and anchored to the pivot pin 133 at a single location, and that several different outer rings 153 and arms 154 (positioned side-by-side on a common axle) could be used. As additional arms were engaged, the torsional force of the torsion spring would increase at a faster rate during recline. It is also conceived that the stop 155 could have steps, much like the stop 205 (FIG. 21), such that the "booster" torsion spring 150 engages and becomes active at different angular points in time during recline. There are also several other arrangements and variations that a person of ordinary skill will understand and be able to make from the present disclosure. These additional concepts are intended to be covered by the present application.

A stop pin 290 (FIG. 37) is provided on the arm 132, and an abutment 291 is provided on the outer ring 153 of torsion spring 150. The engagement of the components 290 and 291, and also the engagement of the arm 132 with the base support 121 results in a positive location of the back 23 in the upright position. The rubber ring 152 can be pretensioned by engagement of the pin 290 and abutment 291 during assembly of the chair. This preload in rubber ring 152 must be overcome prior to initiation of recline of the back 23. This results in the elevated pretension (see FIG. 24) whenever the stop member 155 is engaged (see FIG. 20). In an alternative construction, a stop pin 290' is located on the arm 132 and positioned to abut a surface on the chair control base support 121 as a way of setting the upright position of the back 23.

A back stop 205 (FIG. 21) is formed on the stop member 155. The back stop 205 is keyed directly to the pivot pin 155' so that it moves with the pivot pin 155'. There is no torsion spring element on the illustrated back stop 205. The arm 132 includes a lever 202 with an abutment surface 203. A back stop 205 is pivoted to pivot pin 155' at a location adjacent to the booster stop member 155. The back stop 205 includes a first abutment surface 206 and a second abutment surface 207.

Figure 21:
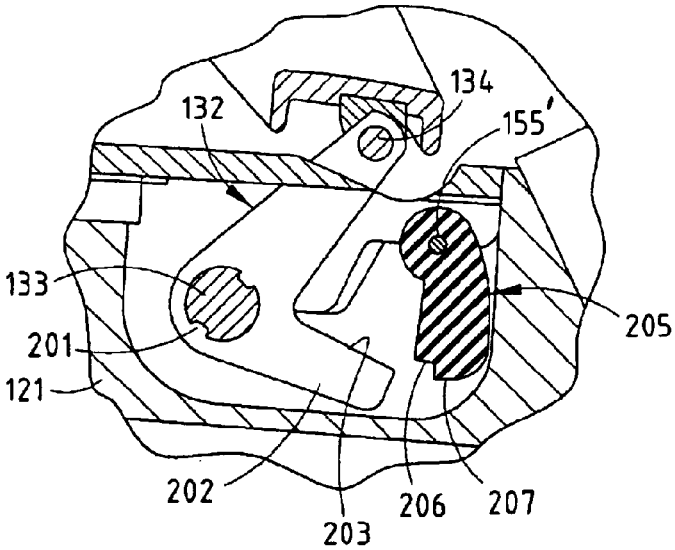
FIGS. 21–23 are cross-sectional views similar to FIG. 18, but showing cross-sectioned components, FIG. 21 being taken along line XXI in FIG. 33 and showing the back stop mechanism disengaged, and FIG. 22 showing the back stop mechanism engaged to a first level for partial back recline, and FIG. 23 showing the back stop mechanism engaged to a second level for no back recline.
Figure 22:
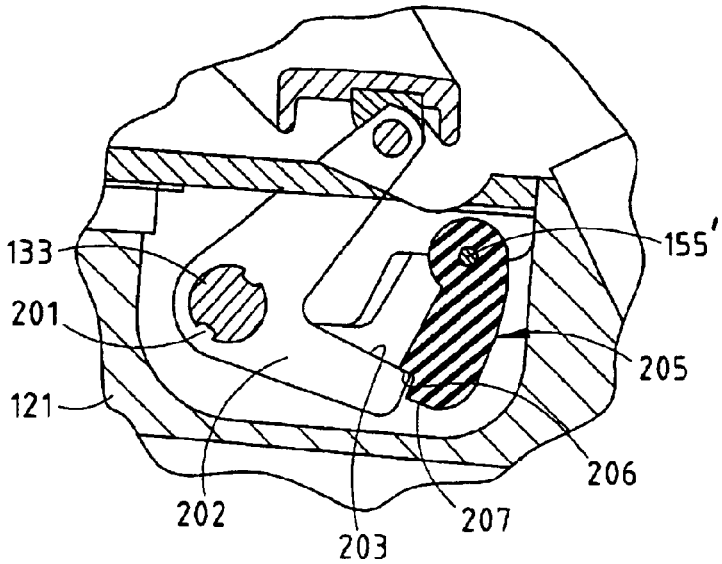
Figure 23:
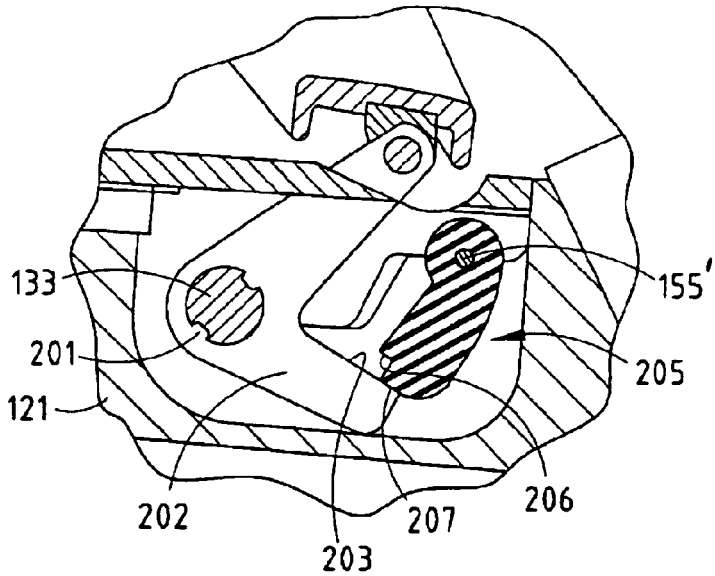

A manual control mechanism 220 (FIG. 26) includes a selector device 227 mounted to base support 121 under the seat-supporting structure 122. The selector device 227 is operably connected to pivot pin 155' as noted below for moving the booster stop 155 and back stop 205. The back stop 205 does not engage the abutment surface 203 of lever 202 when the manual control mechanism 220 for booster mechanism 25 and back stop 205 is in a "home" disengaged position (FIGS. 19 and 21). The stop member 155 of booster mechanism 25 engages and activates the torsion spring 150 when the selector device 227 is moved to a first adjusted position (FIG. 20). In the first position, the abutment surface 203 is not yet engaged (FIG. 20). However, when the control 220 is moved to a second adjusted position (FIG. 22), the back stop abutment surface 206 engages the abutment surface 203 of the lever 202, and the back 23 is limited to only ⅓ of its full angular recline. (The back stop 205 can of course have additional intermediate steps, if desired.) When the selector device 227 is moved to a third adjusted position (FIG. 23), the back stop abutment surface 207 engages the abutment surface 203 of the lever 202, and the back 23 is limited to zero recline. The effect of these multiple positions of selector device 227 are illustrated by the lines labeled 211–214, respectively, on the graph of FIG. 24.

Figure 24:
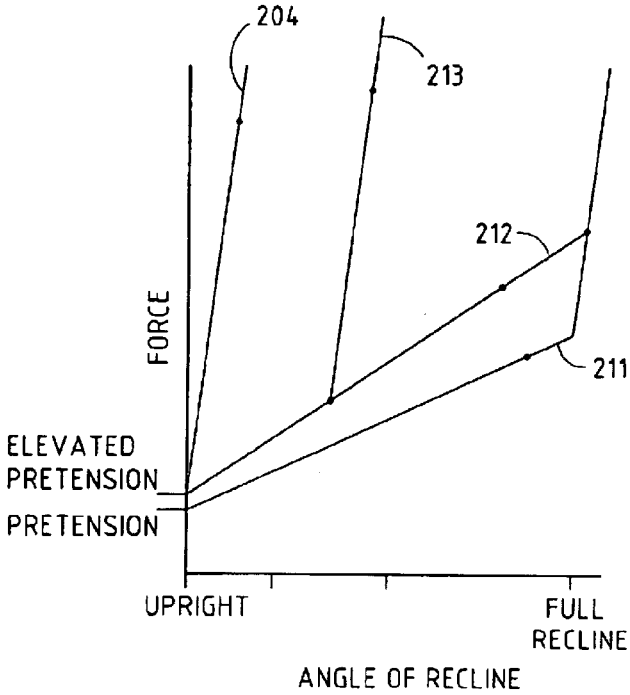
FIG. 24 is a force-deflection graph showing different lines of back support force versus deflection, depending upon whether the booster is disengaged or engaged, and whether the back stop is engaged for partial recline or to prevent any recline.

The combination of the booster mechanism 25 and the back stop 205 results in a unique adjustable control mechanism, as illustrated in FIG. 24. Literally, the device combines two functions in a totally new way—that being a single device that selectively provides (on a single member) a back stop function (i.e. the back stop mechanism 202/205) and also a back tension adjustment function (i.e. the booster mechanism 150/155).

It is contemplated that the pivot pin 155' can be extended to have an end located at an edge of the seat 22 under or integrated into the seat support 122. In such case, the end of the pivot pin 155' would include a handle for grasping and rotating the pivot pin 155'. However, the selector device 227 of the manual control mechanism 220 (FIGS. 26–27) can be positioned anywhere on the chair 20.

A manual control mechanism 220 (FIG. 26) includes a Bowden cable 251 having a sleeve 221 with a first end 221' attached to the base support 121, and an internal telescoping cable 222 (FIG. 27) movable within the sleeve 221. A wheel section 223 is keyed or otherwise attached to the pivot pin 155' of the back booster and back stop mechanism, and an end 224 of the cable 222 is attached tangentially to a perimeter of the wheel section 223. (Alternatively, if the diameter of the pivot pin 155' is sufficiently large, the cable end 224 can be connected tangentially directly to the pivot pin 155'.) Optionally, a spring 225 can be used to bias the wheel section 223 in direction 225', pulling the cable in the first direction 225'. However, spring 225 is not required where the cable 222 is sufficient in strength to telescopingly push as well as pull. The cable sleeve 221 includes a second end attached to the seat support 122, such as on the end of a fixed rod support 226 extending from the seat support 122. A selector device 227 is attached near an end of the rod support 226 for operating the cable 222 to select different back supporting/stopping conditions.

Figure 28:
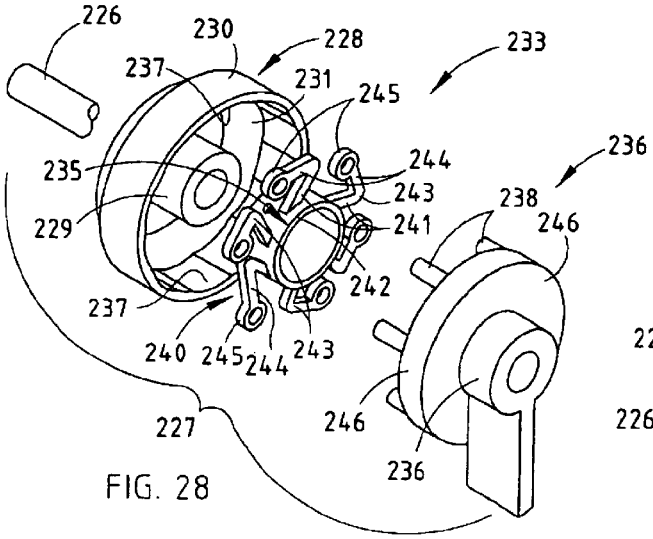
FIG. 28 is an exploded perspective view of the manual control of FIG. 26.

The selector device 227 (FIG. 28) operates very much like a gearshift found on a bicycle handle bar for shifting gears on the bicycle. The selector device 227 is also not unlike the lumbar force-adjusting device shown in patent 6,179,384 (minus the gears 56 and 56'). It is noted that a patent entitled "FORCE ADJUSTING DEVICE", issued Jan. 30, 2001, U.S. Pat. No. 6,179,384, discloses a clutch device of interest, and the entire contents of U.S. Pat. No. 6,179,384 are incorporated herein by reference in its entirety for the purpose of disclosing and teaching the basic details of a sprag clutch and its operation.

Figure 29:
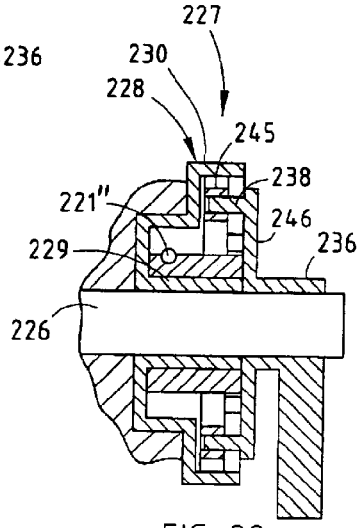
FIGS. 29–30 are cross-sectional views of the hand control of FIG. 28, FIG. 29 being fully assembled, and FIG. 30 being exploded apart.
Figure 30:
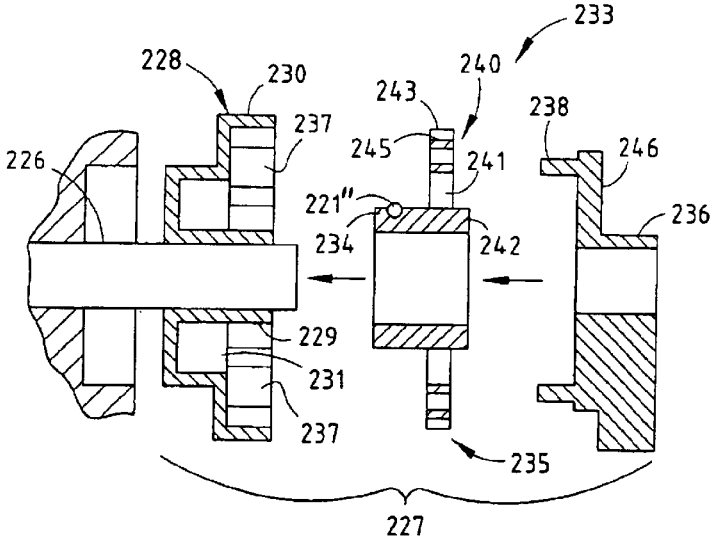

The illustrated selector device 227 (FIGS. 28–30) includes a housing 228 fixed to the rod support 226 with an inner ring section 229 attached to the rod, and an annular cover 230 rising from the ring and forming a laterally-open cavity 231 around the ring 229. Detent recesses 237 are formed around an inside of the cover 230. A one-piece plastic molded rotatable clutch member 233 including a hub 242 is positioned in the cavity 231 and includes a first section 234 attached to the cable end 221". The rotatable clutch member 233 further includes a clutch portion 235 integrally formed with hub 242. A handle 236 is rotatably mounted on an end of the support 226 and includes protrusions 238 that engage the clutch 235 to control engagement with the detent recesses 237 as follows.

Figure 31:
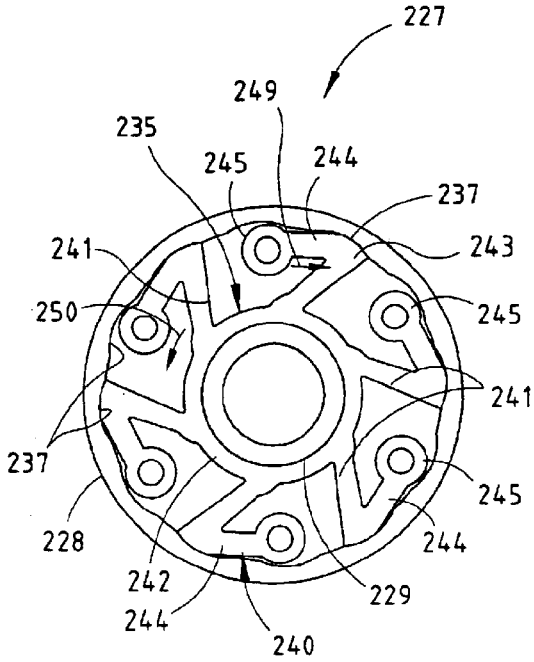
FIG. 31 is an enlarged fragmentary view of the clutch and its engagement with the exterior housing, showing the clutch in a locking position.
Figure 31A:
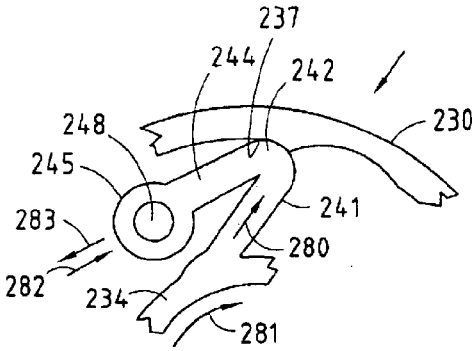
FIGS. 31A and 31B are enlarged fragmentary views of a portion of FIG. 31, FIG. 31A showing a locked position and FIG. 31B showing a released position.
Figure 31B:
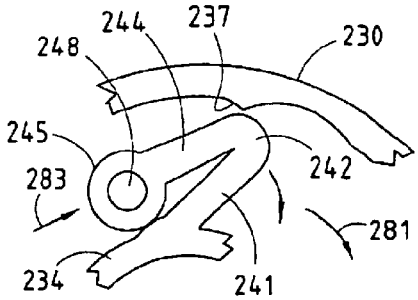
Figure 32:
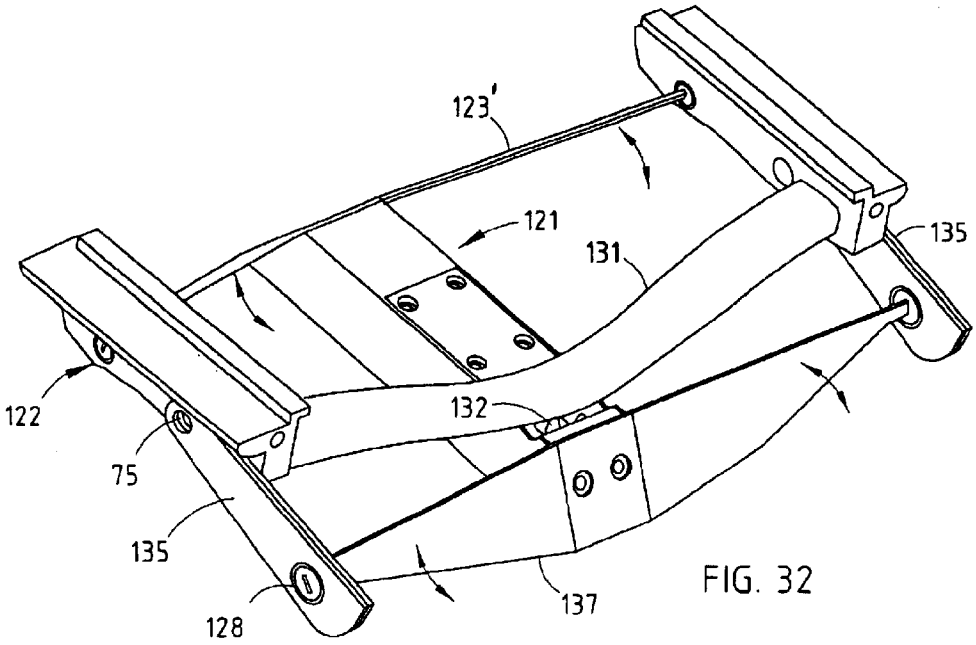
FIGS. 32–33 are front and rear partial perspective views of the base and control of FIG. 18.
Figure 33:
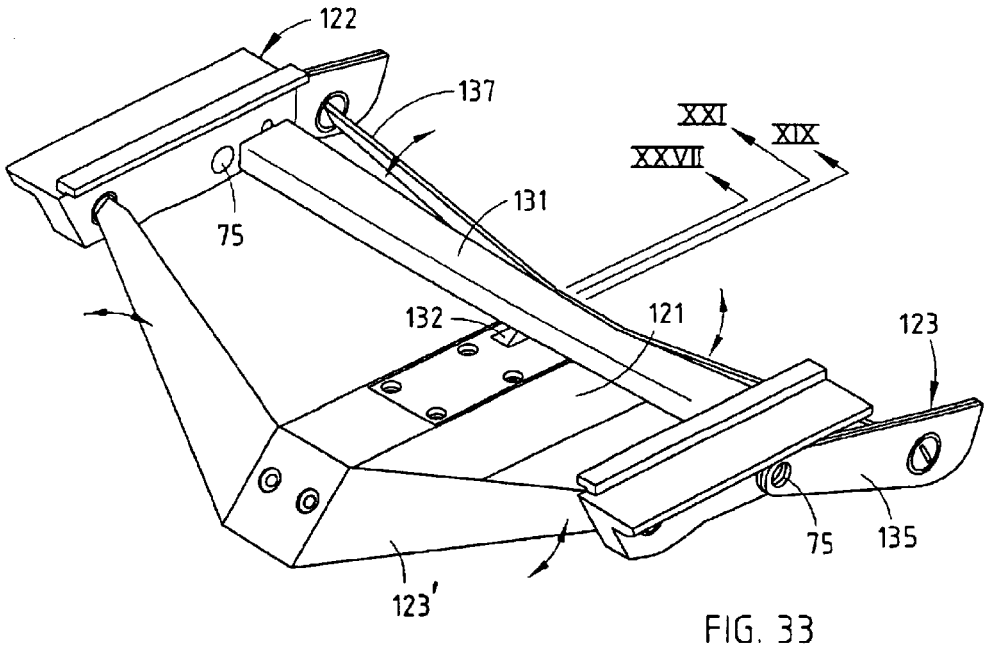

The clutch portion 235 (FIG. 28) includes one or more side sections 240 (preferably at least two side sections 240, and most preferably a circumferentially symmetrical and uniform number of side sections, such as the illustrated six side sections) having a resilient first section 241 that extends at an angle from the hub 242 to an elbow 243 that is in contact with the detent recesses 237, and a second section 244 that extends in a reverse direction from the end of the first section 241 to a free end 245 located between the hub 242 and the detent recesses 237. Each free end 245 includes a hole 248. The handle 236 includes a clutch-adjacent section 246 that supports the protrusions 238 at a location where the protrusions 238 each engage the hole 248 in the associated free end 245 of every side section 240. Due to the angle of the first sections 241 (FIG. 31A, see arrow 280) relative to the inner surface of the housing that defines detents 237, the first sections 241 interlockingly engage the detent recesses 237 against the bias of the spring 225 as communicated by the tension in cable 222 (see arrow 281), preventing movement of the clutch 235 when it is biased in direction 249 (FIG. 31) by the hub 242. Thus, when handle 236 is released, the clutch 235 again locks up against the force 281 of spring 225 (FIG. 27) as communicated by cable 222 to the clutch 235. However, when the handle 236 is grasped and moved in the rotational direction 283 (FIG. 31A) relative to housing 228, the handle protrusions 238 pull the second section 244 to thus pull the first and second sections 241 and 244 so that the rotatable member 230 (and the clutch 231) rotates. When the handle 236 is moved in a rotational direction 282 (FIG. 31A), the handle protrusions 238 push the second section(s) 244 at a low angle relative to the detent recesses 237, such that the second sections 244 (and first sections 241) slip out of and over the detent recesses 237 (FIG. 31B), allowing the rotatable member 230 (and clutch 231) to adjustingly move in direction 281. Thus, the present arrangement allows adjustment in either direction, but interlocks and prevents unwanted adjustment in a particular direction against a spring biasing force.

Figure 26:
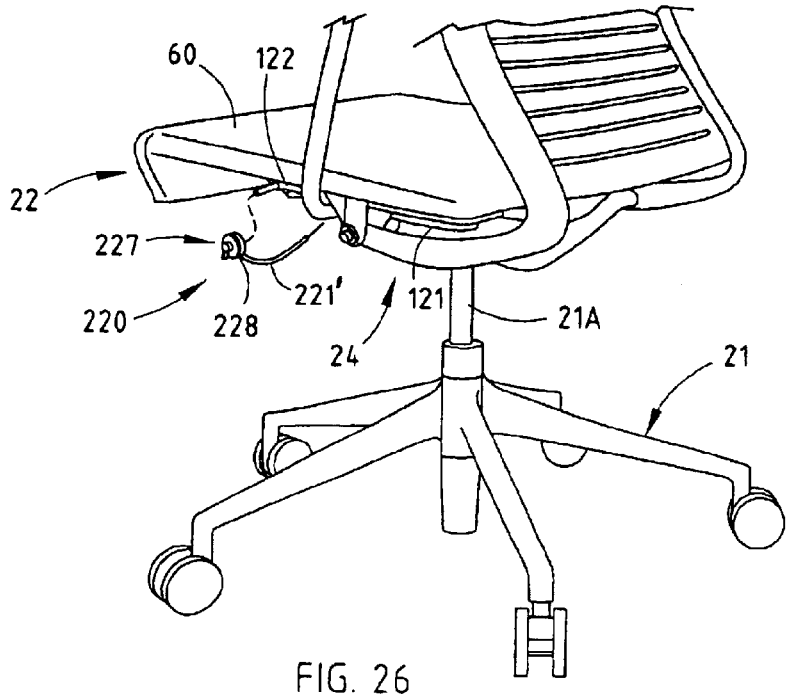
FIG. 26 is an exploded perspective view showing an underseat-located manual control for the booster and back stop mechanism.
Figure 27:
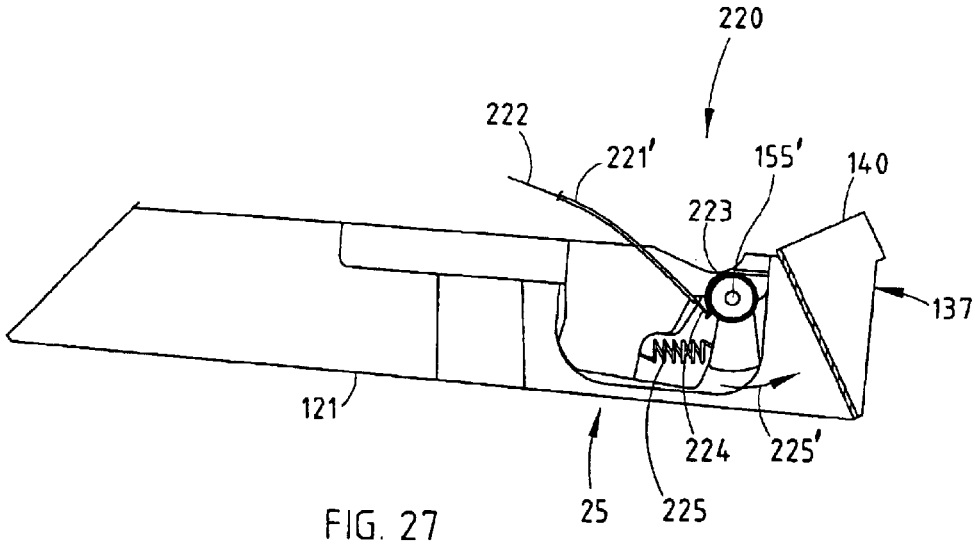
FIG. 27 is a cross-sectional view taken along the line XXVII in FIG. 33.
Figure 26A:
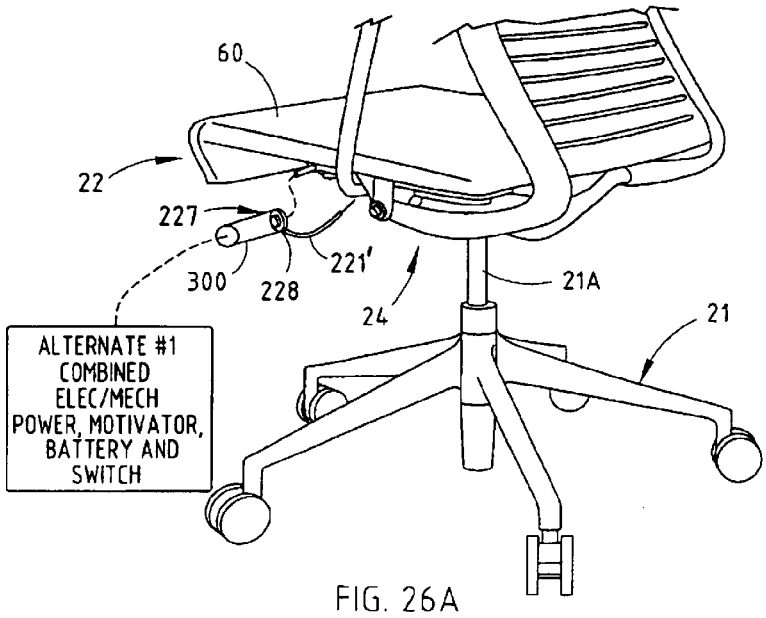
FIGS. 26A and 27A are similar to FIGS. 26 and 27, but showing alternative embodiments.
Figure 27A:
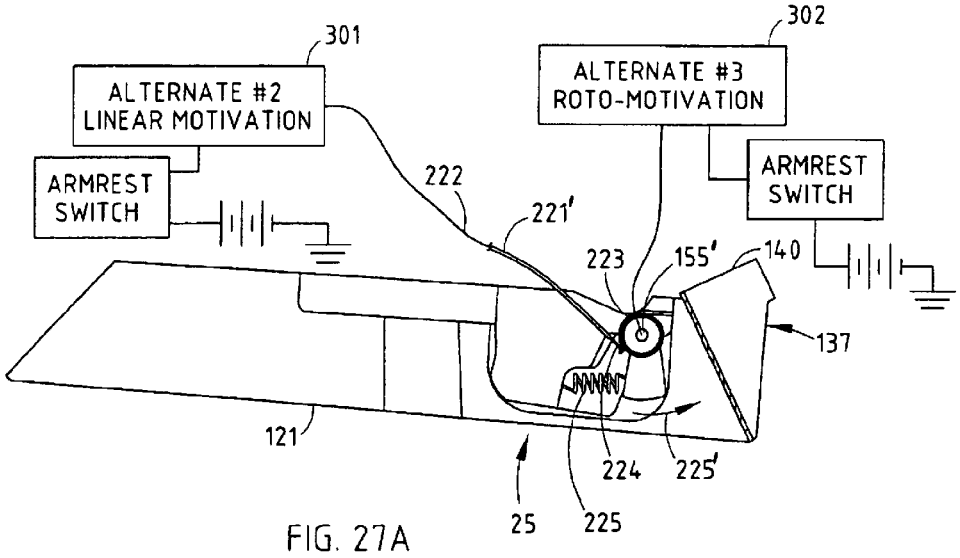

It is noted that actuation of the booster mechanism 25 and the back stop 205 is particularly easily accomplished, since the actuation action does not require overcoming the strength of a spring nor of overcoming any friction force caused by the spring 150. Further, the actuation action does not require movement that results in storage of energy (i.e. does not require compressing or tensioning a spring). Thus, a simple battery-operated DC electric motor or switch-controlled solenoid would work to operate the booster mechanism 25 and/or the back stop 205. FIG. 26 illustrates a housing 300 supporting a battery pack and electric rotary motivator (such as a DC motor), and includes an end-mounted switch. FIG. 27A illustrates a linear motivator 301 operably connected to cable 222, and also illustrates a rotary motivator 302 connected to axle 155'. Since the movement of the booster mechanism 25 and the back stop 205 requires only a very small amount of energy with minimal frictional drag, it can be accomplished without a need for a large energy source. Thus, a small battery-operated device would work well for a long time before needing recharge of its battery.

The illustrated control mechanism 24 above has front and rear leaf springs used as flexible weight-bearing members to support a seat and back for a modified synchronous movement, and has a pivoted link/arm that assists in directing movement of a rear of the seat. However, the present arrangement can also include stiff arms that are pivoted to the base support 121, or can include any of the support structures shown in application Ser. No. 10/241,955, filed on Sep. 12, 2002, entitled "SEATING UNIT WITH MOTION CONTROL", the entire contents of which are incorporated herein in their entirety. Also, a "booster" mechanism 25 provides added biasing support upon recline when a stop is engaged. However, it is contemplated that a continuously adjustable biasing device such as a threaded member for adjusting a spring tension or cam could be used instead of the booster mechanism 25.

Since the seat support 122 raises upon recline, potential energy is stored upon recline. Thus, a heavier seated user receives greater support upon recline than a lightweight seated user. Also, as a seated user moves from the recline position toward the upright position, this energy is recovered and hence assists in moving to the upright position. This provides a weight-activated movement seat, where the seat lifts upon recline and thus acts as a weight-activated motion control. (i.e. The greater the weight of the seated user, the greater the biasing support for supporting the user upon recline.) It is noted that a variety of different structures can provide a weight-activated control, and still be within a scope of the present invention.

Modification

Figure 40:
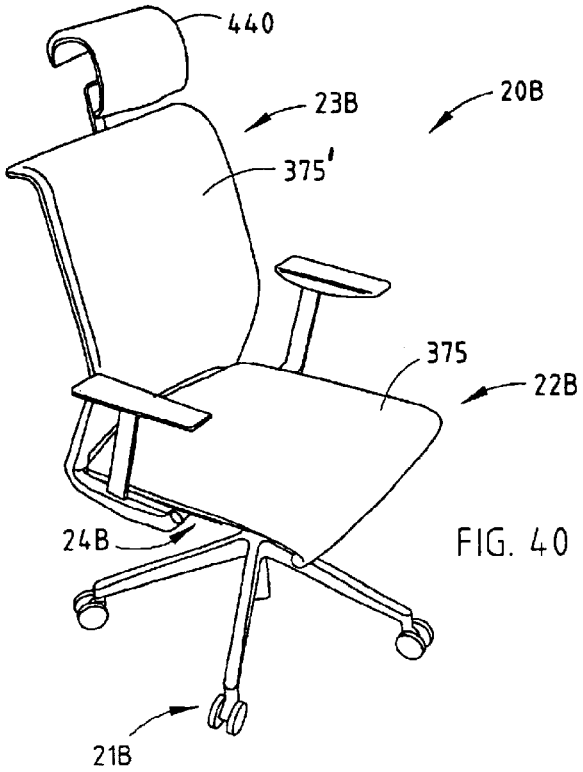
FIGS. 40–42 are front perspective, rear perspective, and side views of a modified form of the present inventive chair.
Figure 41:
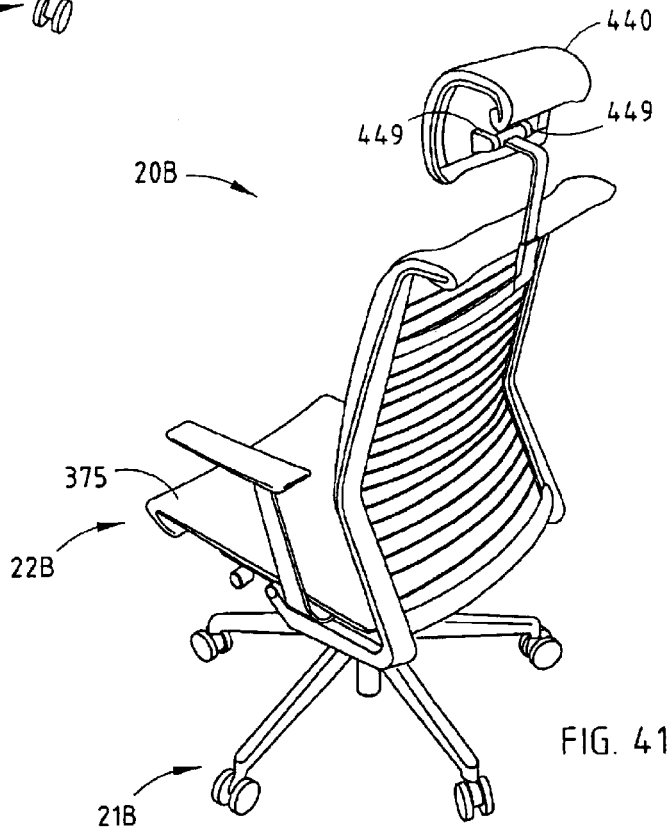
Figure 42:
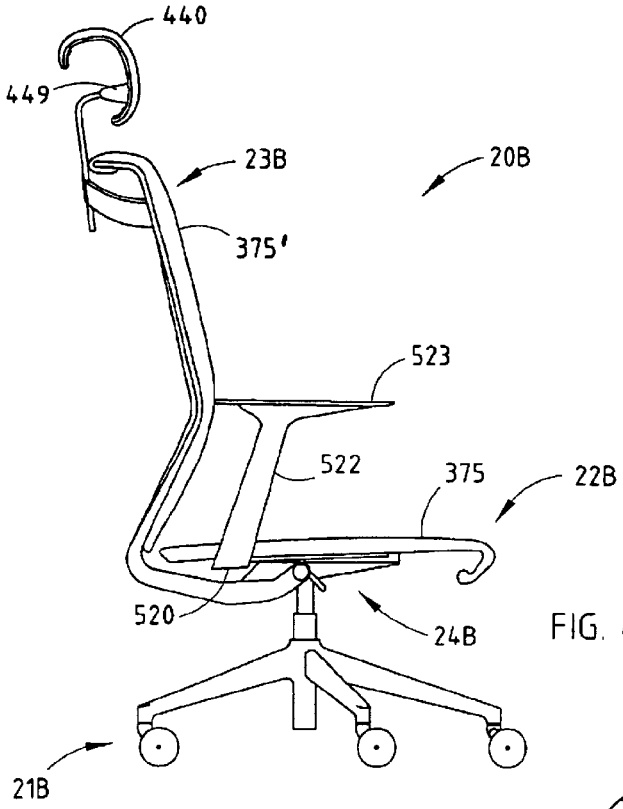

A modified chair or seating unit 20B (FIGS. 40–42) includes changes and improvements from that of chair 20. In order to minimize redundant discussion and facilitate comparison, similar and identical components and features of the chair 20B to the chair 20 will be identified using many of the same identification numbers, but with the addition of the letter "B".

The chair 20B (FIG. 40) includes a base 21B, a seat 22B, and a back 23B, with the seat 22B and back 23B being operably supported on the base 21B by an underseat control mechanism 24B for synchronous movement upon recline of the back 23B. As with chair 20, upon recline of chair 20B, the control mechanism 24B moves and lifts the seat 22B upwardly and forwardly, such that the back 23B (and the seated user) is automatically provided with a weight-activated back-supporting force upon recline. The seat 22B (and also the back 23B) includes a highly comfortable support surface formed by a locally-compliant support structure (hereafter called "a comfort surface") that adjusts to the changing shape and ergonomic support needs of the seated user, both when in an upright position and a reclined position. Specifically, the comfort surface changes shape in a manner that retains the seated user comfortably in the chair during recline, yet that provides an optimal localized ergonomic support to the changing shape of the seated user as the user's pelvis bones rotate during recline. In addition, the chair 20B avoids placing an uncomfortable lifting force under the seated user's knees and thighs, by well-distributing such forces at the knees and/or by flexing partially out of the way in the knee area. Further, comfort surfaces of the seat 22B and back 23B create a changing bucket shape (similar to that shown in FIGS. 2A and 2B) that "grips" a seated user and also actively distributes stress around localized areas, such that the seated user feels comfortably retained in the seat 22B, and does not feel as if they will slide down the angled/reclined back and forward off the seat during recline, as described below.

Figure 43:
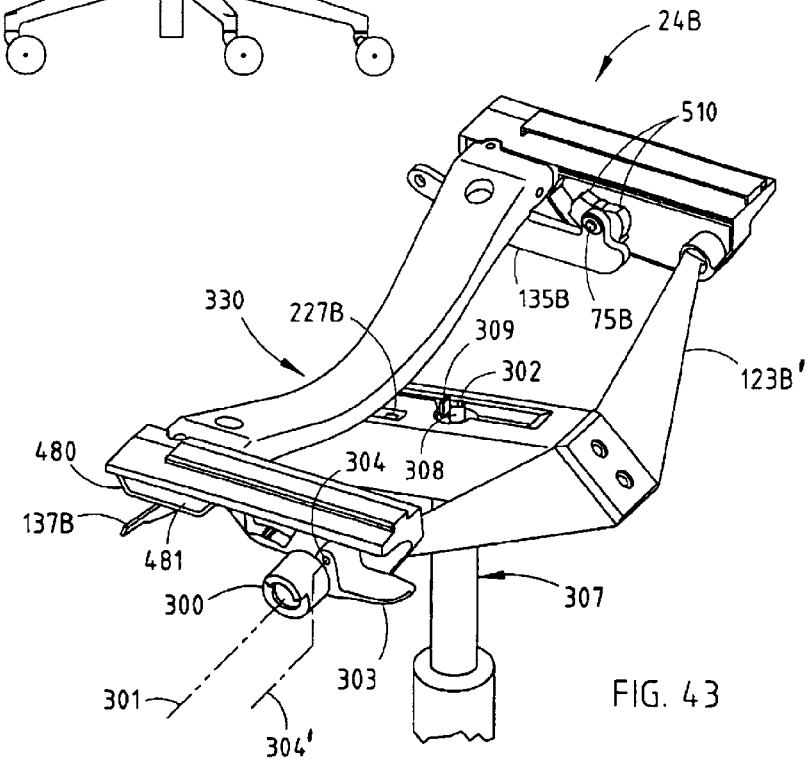
FIG. 43 is a perspective view of the underseat control for the chair in FIG. 40.
Figure 48:
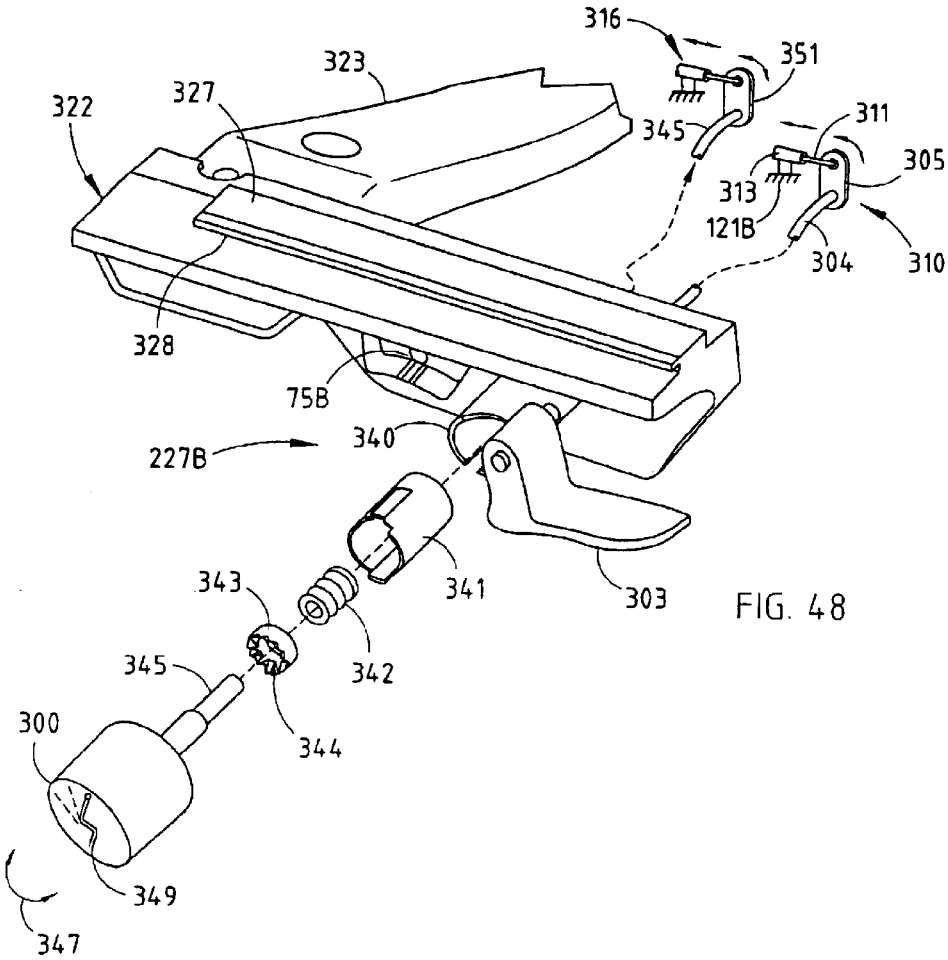

The chair control mechanism 24B (FIG. 43) includes a booster/back stop selector device 227B with a handle 300 rotatable about a first axis 301 for selectively moving the back stop and booster mechanisms (see FIGS. 19–23) (components 156 and 205) between the multiple positions illustrated in FIGS. 19, 20, 22, and 23. The control mechanism 24B further includes a second control device 302 with a radially-extending lever handle 303 rotatable about a rod 304 forming a second axis 304'. The second axis extends parallel to but is spaced from the first axis 301. The handle 303 is made to be positioned adjacent the handle 300, and includes a projection that engages the handle 300 to form a stop surface to limit back rotation of the handle 303. On an inner end of the rod 304 (FIG. 48) is a radially extending finger 305. The base 21B (FIG. 45) includes a releasable self-locking pneumatic spring 307 having two fixed tabs 308 for engaging a sheath on a cable sleeve, and a side-activatable lever 309 that operably engages an internal release button in the spring 307. A side-activatable pneumatic spring such as pneumatic spring 307 is commercially available in commerce and need not be described in detail in this application. (See Cho patent 6,276,756.) A cable assembly (FIG. 48) includes a cable 310 connected at one end 311 to the finger 305 and at another end 312 (FIG. 45) to the lever 309. The cable assembly further includes a sleeve 313 (FIG. 48) that is connected to the base support 121B near the handle 303, and that extends to and is connected to the tabs 308 (FIG. 45) on the pneumatic spring 307.

Figure 44:
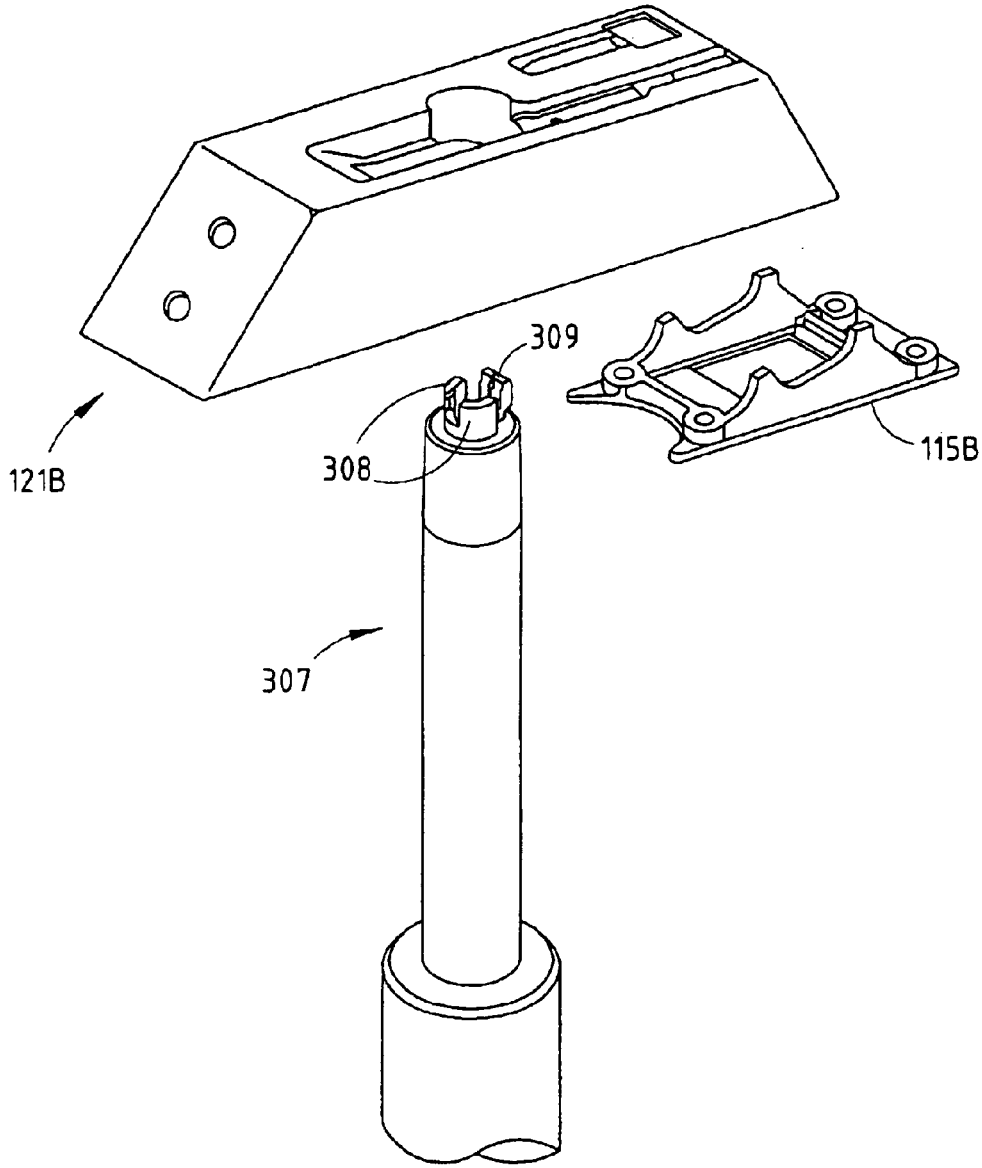
FIGS. 44–46 are top perspective, second top perspective, and bottom perspective exploded views of a portion of the underseat control and related base components of FIG. 43.
Figure 45:
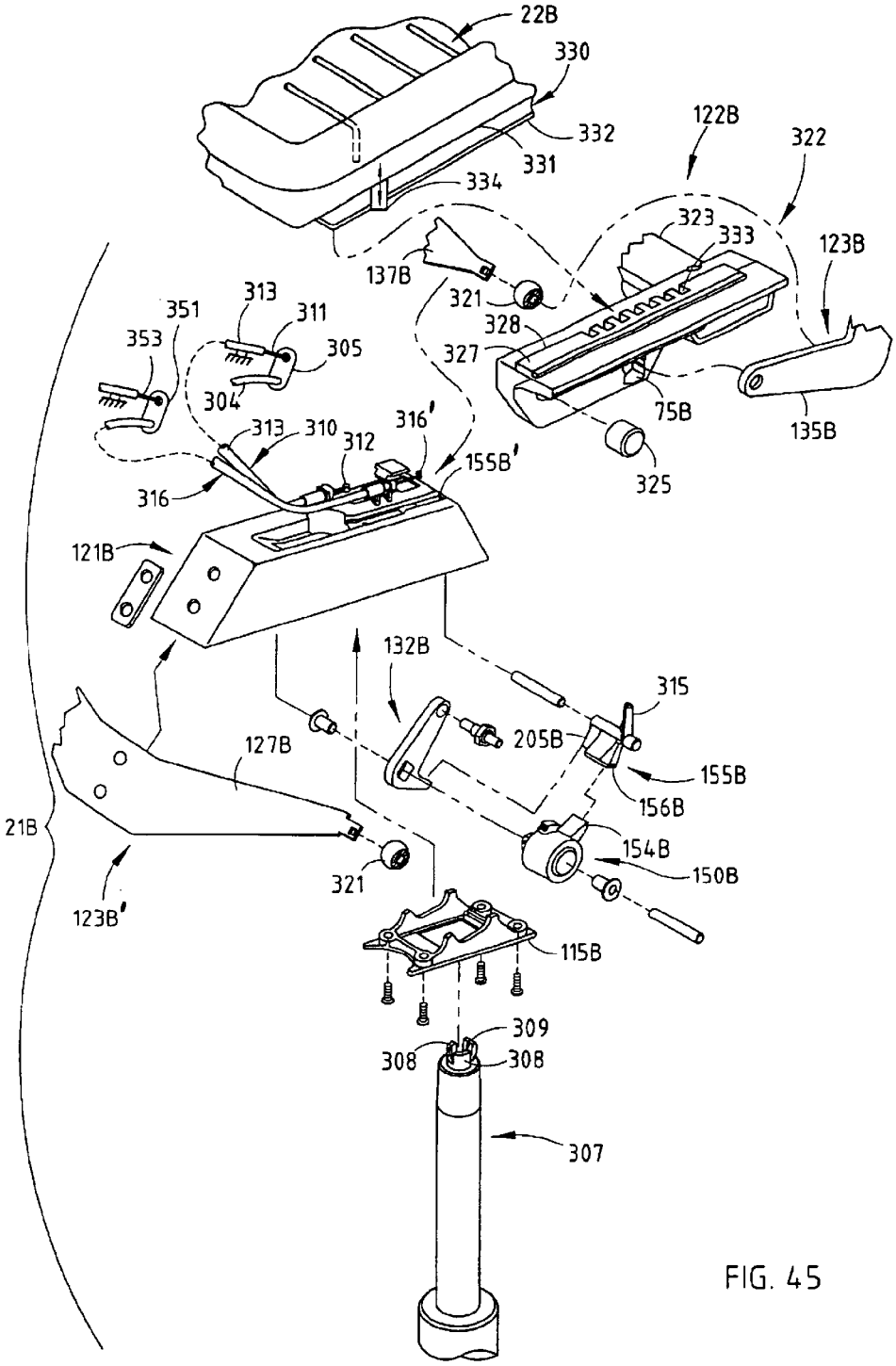
Figure 46:
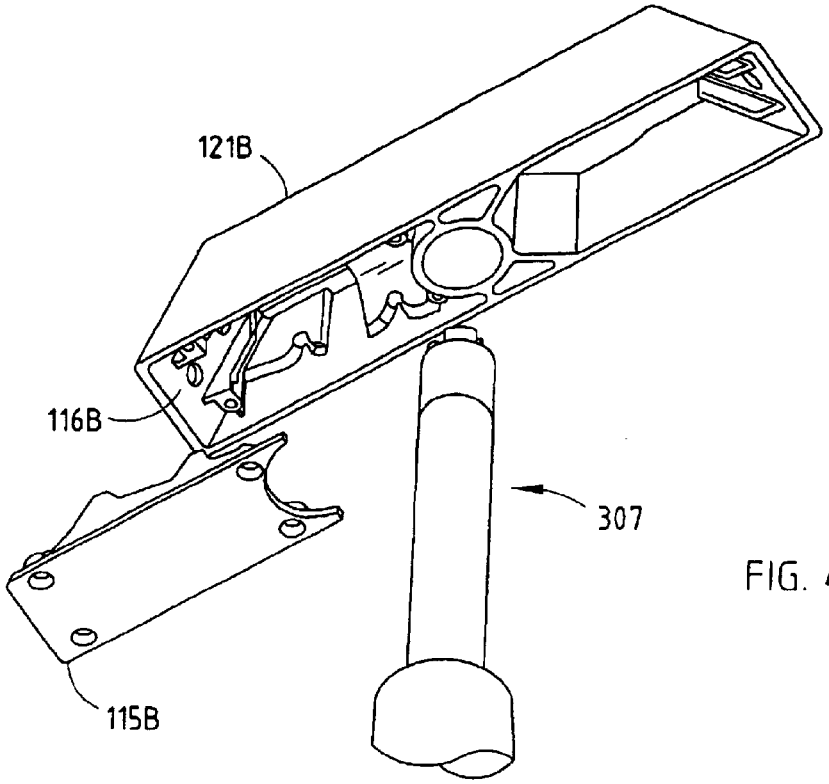

As shown in FIGS. 44–46, the base support 121B is inverted from the base support 121. Specifically, the base support 121B (FIG. 46) includes a similar cavity and internal surfaces and structure for supporting the levers, stops, and booster mechanisms within the base support 121B, similar to base support 121. However, the front portion 116B of the cavity in base support 121B opens downwardly, and the cover 115B engages a bottom of the base support 121B. An upright arm 315 (FIG. 45) is attached to the stop member 155B and extends up through a top aperture 155B' in the base support 121B. An end 316' of a cable 316 is connected to the arm 315 and extends to a tangential connection on the booster/back stop selector device 227B (FIG. 48), such that when the handle 300 is rotated, the cable 316 is pulled (and/or pushed) . . . and hence the stop member 155B is moved to a selected position. (See FIGS. 19, 20, 22 and 23).

Figure 47:
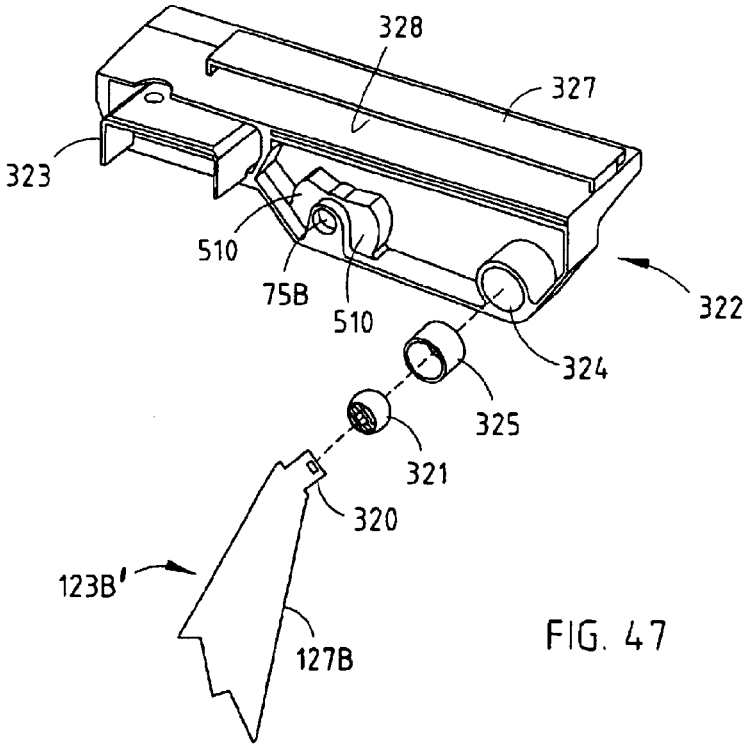
FIGS. 47–49 are exploded perspective views of the underseat control of FIG. 43, FIGS. 48 and 49 showing a hand control for adjusting the booster and back stop mechanism shown in FIG. 45.

The laterally-extending arms 127B of the front spring 123B' (FIG. 47) include a tab 320 that non-removably snap-attaches into a spherical bearing 321. The seat support 122B (FIG. 45) includes a pair of side frame members 322 and a transverse cross piece 323 rigidly connecting the opposing side frame members 322. Each side frame member 322 includes a bore 324, which, if desired, includes a bearing sleeve 325. The spherical bearings 321 on the ends of leaf springs 123B' each rotatably and telescopingly slidingly engage the sleeve 325/bore 324 to accommodate non-linear movement of the spherical bearing 321 during recline of the back 23B. Hole 75B (FIG. 47) receives a pivot pin that rotatably connects the respective side sections 135B of the back supporting upright 123B to the seat support 122B. A flange 327 forms a slot 328 along a top of the side frame members 322.

Each seat 22B (FIG. 43) includes a bracket 480 that forms a mounting socket 481 on seat side frame members 322 for receiving and fixedly supporting an "L-shaped" armrest support structure 482 (FIG. 42) and T-shaped armrest 483.

Figure 65:
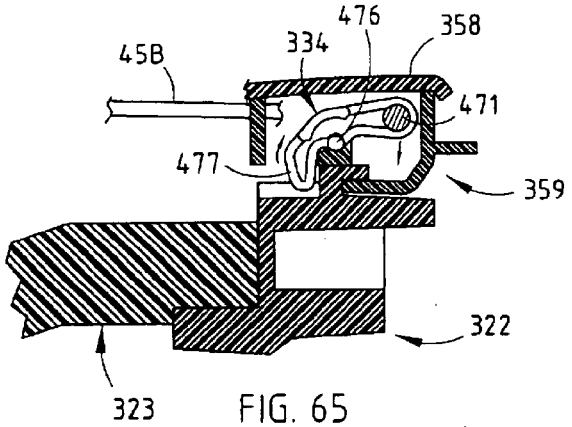
FIGS. 65 and 66 are cross-sectional views taken perpendicularly through the latching area of FIG. 64, FIG. 65 showing a latched position and FIG. 66 showing an unlatched position of the latching member.
Figure 66:
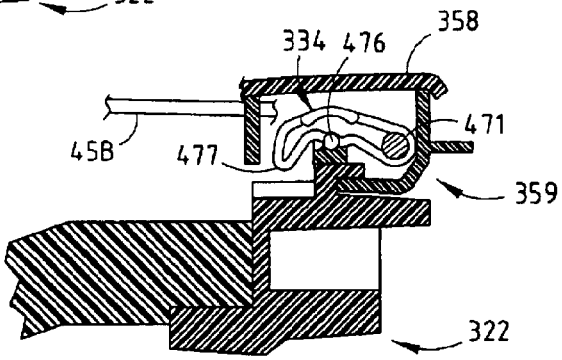

The seat 22B is depth adjustable, and includes a pair of seat carriers 330 (FIG. 45) attached to each side for sliding depth adjustment. Specifically, the seat carriers 330 each include a body 331 (FIG. 65) adapted to slidably engage a top of the side frame members 322 of the seat support 122B, and further include a lateral flange 332 that fits into and slidably engages the slot 328 for providing fore/aft depth adjustment of the seat 22B. The seat 22B is captured on the seat support 122B because flanges 332 on the right side and left side seat carriers 330 face in opposite directions. A series of notches 333 in the top inboard side of the seat carriers 330 are engaged by a latch 334 mounted on the seat carriers 330, the latch 334 being movable downward into an engaged position to engage a selected notch 333 for holding the seat 22B at a selected depth position. The latch 334 is movable upward to disengage the notches 333, thus permitting horizontal depth adjustment of the seat 22B. It is contemplated that the latch 334 can be a variety of different constructions, such as a blade mounted for vertical movement on the seat 22B, or a bent wire rod that when rotated has end sections that move into and out of engagement with the notches 333. It is contemplated that other latching and adjustment arrangements can also be constructed.

Figure 63:
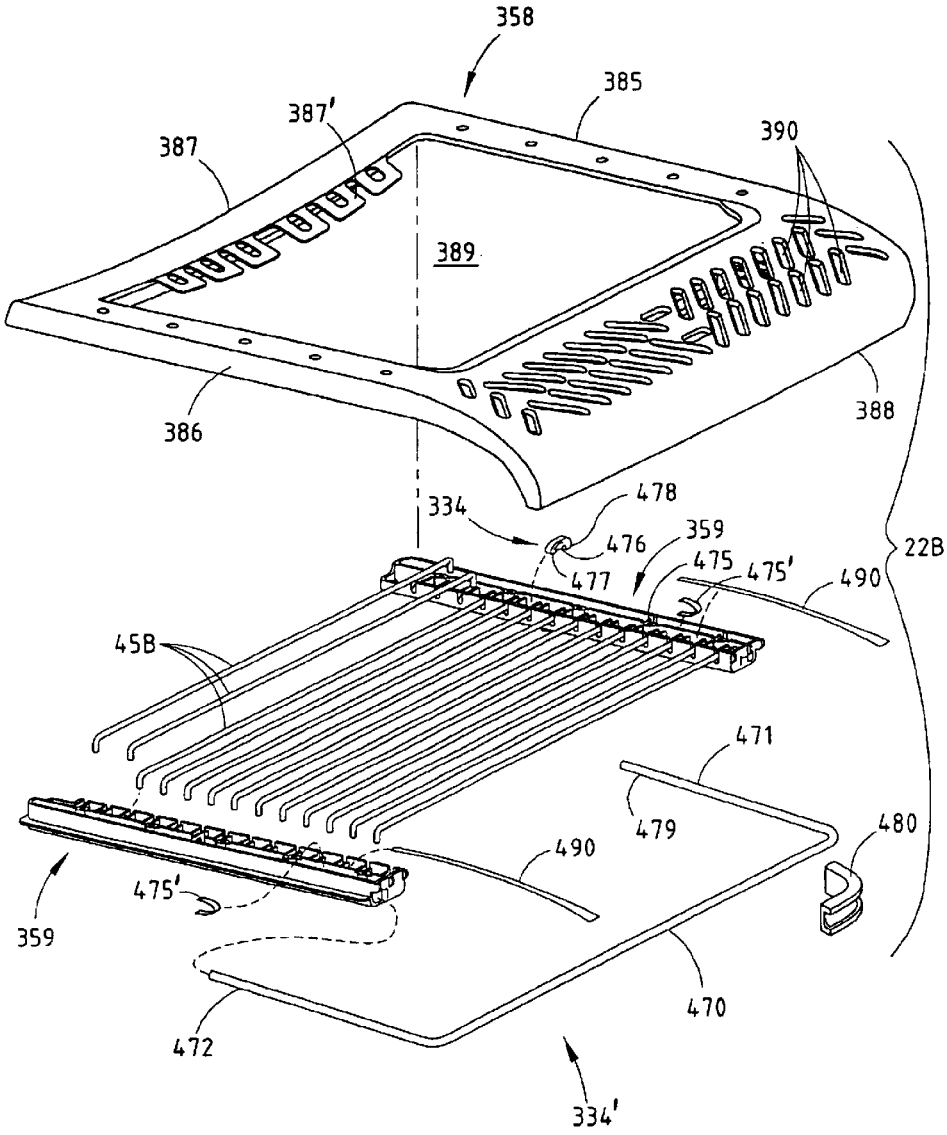
FIG. 63 is an exploded perspective view of the seat frame and wire support members of FIG. 50, including the depth adjustment latch and release handle.

In the illustrated chair design, the latch 334 is two-sided (FIG. 63) and is adapted to engage both sides of the seat 22B to prevent racking and unwanted angular twisting and rotation in the horizontal plane of the seat 22B. In other words, it is preferable that both seat carriers 330 be fixed to their respective side frame members 322 when latched to provide a stable seat arrangement that does not torque and twist in an undesirable unbalanced manner when a seated user is attempting to recline.

Figure 64:
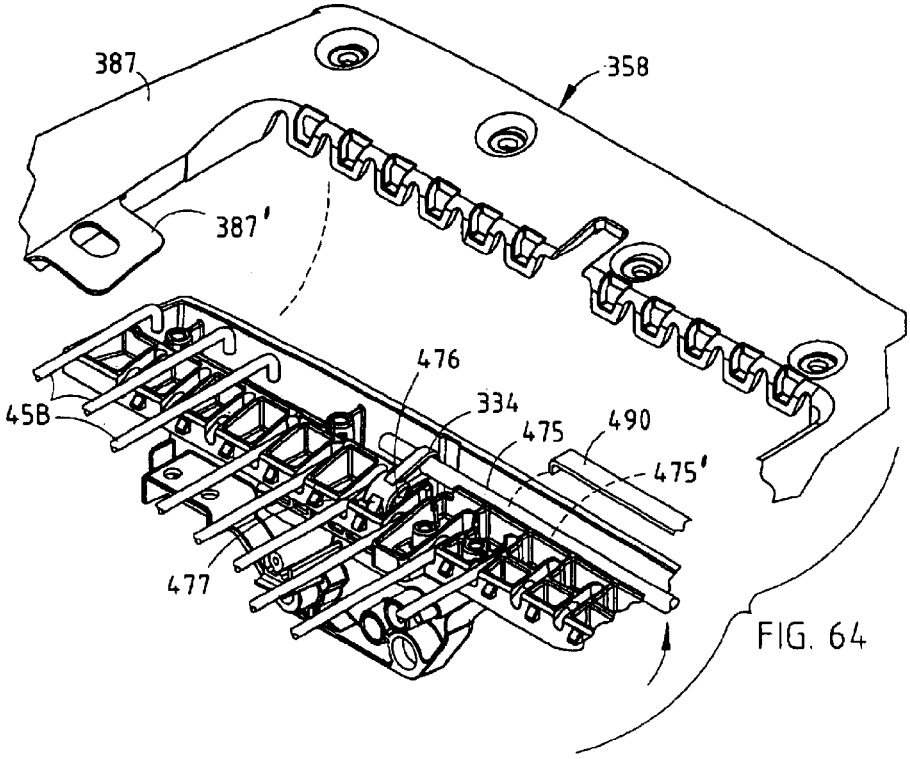
FIGS. 64 and 64A are enlarged exploded top perspective views similar to FIG. 51, but focusing on a corner of the seat subassembly of FIG. 50.

The illustrated latch 334 (FIG. 63) is actuated by a U-shaped bent wire actuator 334' which includes a transverse handle section 470 forming a handle graspable under the seat front section 388, and includes a pair of parallel legs 471 and 472. Each leg 471 (and 472) (FIG. 64) fits into a longitudinal space in the side sections 359 of seat 22B. The legs 471, 472 are pivoted on a transverse rib 375 in the side sections 359. A C-shaped spring 475' is positioned under each leg 471 and 472 to bias the handle section 470 downwardly. An annular groove 473 (FIG. 64) includes a notch 474 in the rib 475 between walls 365 and 366 to form a pivot for leg 471 (and 472). The latch 334 is pivoted on an axle 476 that aligns with legs 471, 472, and includes a latching end 477 shaped to move into and out of engagement with notches 333, and includes a second end 478 operably connected to a rear tip 479 of leg 471 in direction "D". When handle section 470 is moved up against the bias of springs 475', side legs 471 and 472 pivot at rib 475, such that leg tip 479 moves down. When leg tip 479 moves down, latching member 334 pivots about pivot 476 to lift latching end 477 out of notches 333. A depth of seat 22B can then be adjusted. One or more resilient springs 480 (FIG. 63) located between transverse handle section 470 and seat front section 388 bias section 470 downwardly, causing latching tip 479 to again engage a selected notch 333 when handle section 470 is released.

Figure 49:
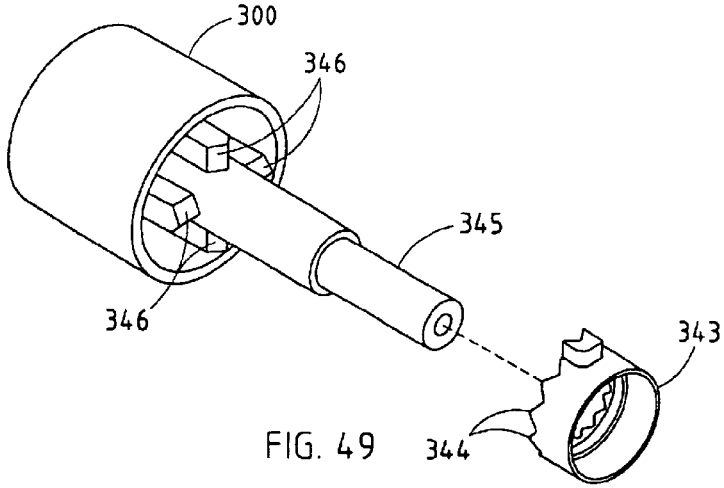

As noted above, the chair control mechanism 24B (FIG. 43) includes a booster/back stop selector device 227B with a handle 300 rotatable about a first axis 301 for selectively moving the back stop and booster mechanisms (see FIGS. 19–23) (components 156 and 205) between the multiple positions illustrated in FIGS. 19, 20, 22, and 23. More particularly, a tubular support 340 (FIG. 48) is attached to the outboard side of the right side frame member 322. A bearing sleeve 341 is positioned in the tubular support 340 along with a coiled compression spring 342, a crown-shaped detent ring 343 with pointed axial tips 344, and the handle 300. A rod 345 extends from the handle 300 through the components 343, 342, and 340 to an inside of the side frame member 322. The handle 300 includes teeth-like projections 346 (FIG. 49) that engage the axial tips 344 of the detent ring 343, and the detent ring 343 is biased axially in an outboard direction so that the tips 344 continuously engage the projections 346. Further, the detent ring 343 is keyed to the tubular support 340 so that the detent ring 343 cannot rotate, but is able to telescope axially. The tips 344 and projections 346 include angled surfaces so that upon rotation of the handle 300, the detent ring 343 will move axially inward against the bias of spring 342, and then snap back outwardly as the tips 344 fit between adjacent projections 346, thus permitting rotation of the handle 300 in directions 347. This arrangement causes the handle 300 to move with a detented rotation. The illustrated arrangement includes four projections 346 on the handle 300, and sixteen tips on the detent ring 343, but it is contemplated that more or less of each can be used. It is contemplated that the handle 300 can include markings 349 to identify its function, and that any of the handle shapes commonly used in the chair art can be incorporated into the illustrated design.

A lever 351 (FIG. 48) extends from an inner end of the rod 345, and is operably connected to one end 353 of the cable 316. Recall that the other end 316' (FIG. 45) of the cable 316 is connected to the arm 315 of the stop member 155B of the booster and back stop engaging member 155B.

Figure 50:
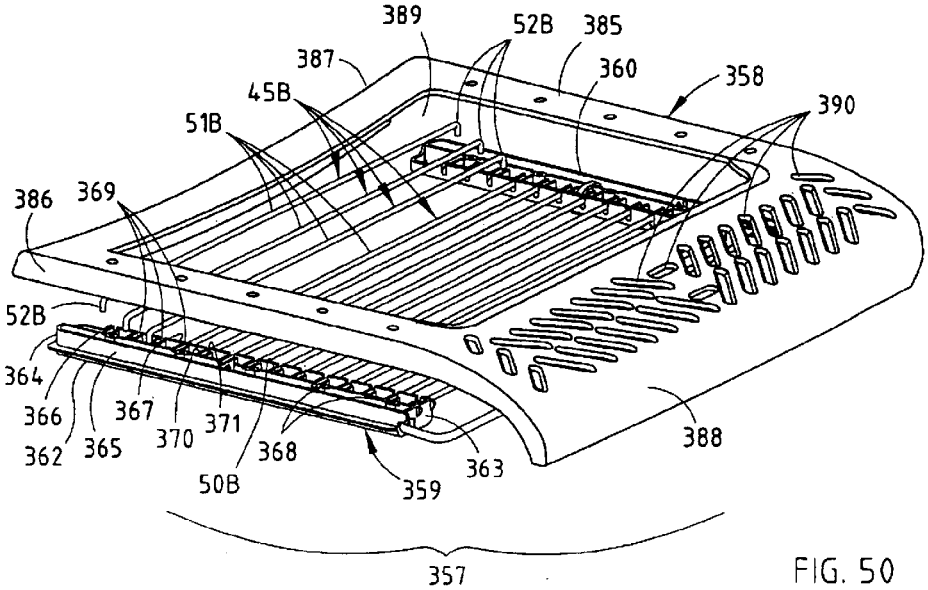
FIGS. 50–51 are perspective and fragmentary perspective views of the seat shown in FIG. 40.
Figure 51:
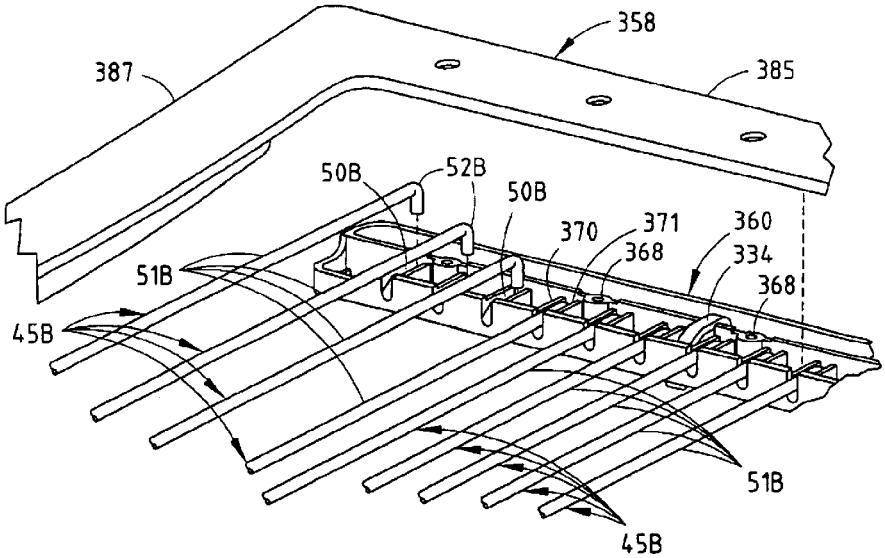

The seat 22B (FIG. 50) includes a seat frame 357 comprising an upper frame component 358 and right and left seat lower frame components 359 and 360 attached to right and left sides of the upper frame component 358. The lower frame components 359 and 360 are attached directly to the top of the seat carriers 330 mentioned earlier (FIG. 45), or can be integrally formed to incorporate the features of the illustrated carriers 330. The support members 45B (FIG. 50) comprise single wires with down-hooks formed at each end, as described below.

The lower frame components 359 and 360 (FIG. 50) are mirror images of each other, and accordingly only the lower frame component 359 will be described. The lower frame component 359 is a plastic molded component having a bottom wall 362, front and rear end walls 363 and 364, and three longitudinal walls 365–367. The outer wall 365 formed an aesthetic and structural outer surface. The intermediate wall 366 includes a plurality of apertures bosses 368 for receiving screws (not shown) to attach the upper and lower frame components 358 and 359/360 together. The inner wall 367 includes a plurality of vertically open slots 369 that extend from its top surface to about halfway down into its height, and further includes parallel walls 370 and 371 that extend from wall 367 to wall 366 on each side of the slots 369. A recess or pocket 50B is formed between each of the parallel walls 370 and 371 for receiving the end sections 52B, as described below. The inboard side of the intermediate wall 366 forms a first stop surface 372 (FIG. 52), and the outboard side of the inner wall 367 forms a second stop surface 373 with an angled ramp surface 374 extending inwardly and downwardly away from the second stop surface 373.

Each support member 45B (FIG. 50) comprises a single wire of the same type wire as support member 45 described above. Each support member 45B has a long section 51B and has L-shaped down-formed end sections 52B forming hooks. The long section 51B is linear and extends generally horizontally through a bottom of the slots 369 when in an installed position without a user sitting on the seat 22B. The end sections 52B are linear and extend downwardly into the pockets 50B. When in an installed position without a user sitting on the seat 22B (see solid lines in FIG. 52), the end sections 52B abut the outer (first) stop surface 372, causing the wire long section 51B to have a slight downward bow in its middle area at location 374'. This provides a pretension and pre-form in the wire support member 45B. When a user sits on the seat 22B (see dashed lines in FIG. 52), the long section 51B bends until the end sections 52B engage the inboard (second) stop surface 373. This limits further bowing or bending of the long section 51B. Further, the angled ramp surface 374 provides additional support to the end portions of the long section 51B, inboard from the end sections 52B, such that the effective length of the long section 51B is reduced. This results in the support member 45B having a preset maximum bend that is limited by the inner stop surface 373 (i.e. a sling type effect), and further is limited by a shorter effective length of the long wire section 51B (which feels stiffer). Both of these circumstances cause a "soft" bottoming out as the wire support member 45B deflects to a maximum bend. At the same time, the wire support member 45B can bend at any location, more than only at their center point, such that the seated user receives a particularly comfortable and ergonomic support.

Figure 70:
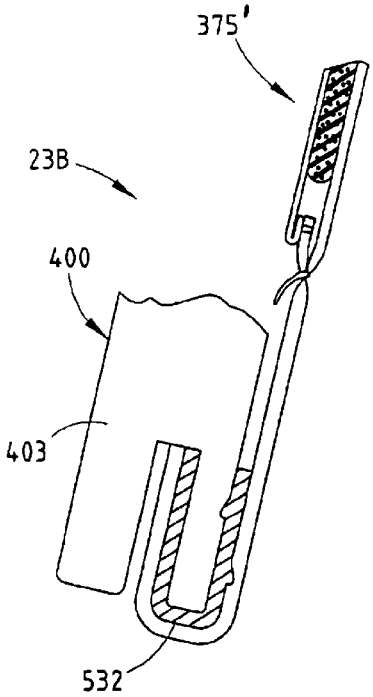
FIGS. 70 and 71 are cross-sectional views showing an attachment configuration for attaching a cushion assembly to the back frame of FIG. 53.

The seat 22B also includes a cushion assembly 375 (FIG. 40) comprising a cushion and an upholstery or cloth covering. It is contemplated that the supports 45B are so flexible and comfortable that the cushion can be eliminated. Alternatively, a cushion assembly 375 can be used that is preferably anywhere from ¼ inch to 1 inch in thickness. The upholstery covering can be any material, but preferably should allow some (though not too much) elastic stretch and give to accommodate the shape changes permitted by the individual movement of the support members 45B.

Where the cushion assembly 375 is sufficiently elastic and resilient, the cushion assembly 375 can include front and rear hook-like formations that permit it to be hook-attached to a front and a rear of the seat support structure (i.e. frame 30B). (See the discussion of FIGS. 70–71 below.)

It is contemplated that, instead of the support members 45B comprising a single long wire with bent ends, the support members 45B can be made to include long resilient wires or stiff members, supported at their ends by hinges to the side frame components, with the axis of rotation of the hinges extending forwardly and being at or slightly below the long resilient wires. For example, FIG. 52A discloses a seat having a modified lower frame component 359 made to include a strap 380 supported by a downwardly offset living hinge 381 at a bottom of where the second (inner) stop surface 373 would be. The strap 380 has a groove shaped to receive a straight length of wire 382. When there is no seated user, the wire 382 extends horizontally, and the living hinge 381 moves to allow its inner wall 367' to move to a normal raised position. When a person sits on the seat, the living hinge 381 flexes, causing the wall 367' to tip inward and downward. (See dashed lines.) This results in an action and movement similar to that noted above in regard to seat 22B.

Figure 52A:
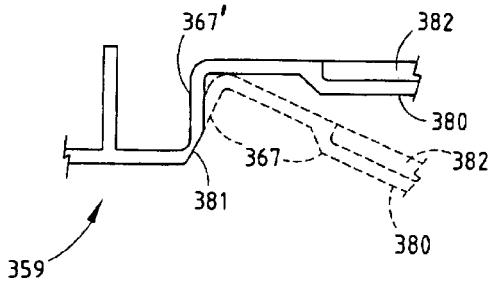
FIG. 52A is a similar view showing an alternative mounting structure.
Figure 52:
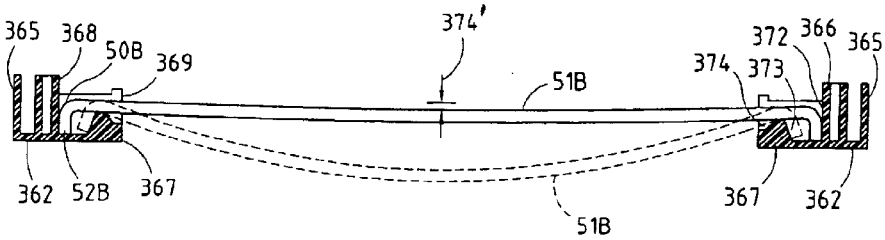
FIG. 52 is a cross section showing flexing of the wire support member for the wire support members shown in FIG. 50.
Figure 58A:
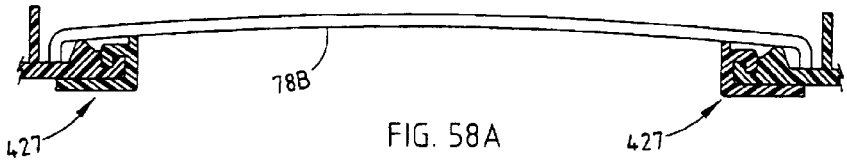
FIG. 58 is a schematic showing the lumber device of FIG. 57.

FIGS. 52 and 52A illustrate an aspect of the present invention that deserves additional explanation. Most engineers will understand that, where a tension cable (or sheet of "stressed" material) is tensioned between spaced apart side frames, huge forces can be generated to pull the side frames toward each other by placing relatively small forces perpendicularly at a center of the cable (or sheet). The result is that the side frame members of a chair having a tensioned cable (or stressed fabric covering) must be made extra strong and stiff in order to keep the cable (or stressed fabric covering) flat enough to be comfortable to a seated user despite a weight of the seated user. This causes the side frame members to be larger, heavier, stiffer, more expensive, and opens them up to undersired creep and/or distortion over time due to cold flow of materials. The present arrangement avoids that problematic circumstance, since the side frame member do NOT have to support a tensioned fabric. Hence, the present side frame members can be made significantly smaller in cross section, made from materials that are lower in stiffness, and made with significantly less total material, such as 10% to 50% less cross section dimensions, 10% to 50% lower material properties, and 10% to 50% less total material, depending on a particular chair's design and functional criteria. The reason is because the support members (e.g. support members 45/51, 45B/51B, 78B, 380/382) provide a support force to a seated user that primarily comes from bending of the support member and NOT from vertical forces generated from lateral tension between the side frame members of the back or seat frames. Restated, when a person sits on the present support members (45/51, 45B/51B, 78B, 380/382), the resultant forces on the side frame members are NOT undesirably magnified. Instead, the forces from a seated user are transmitted from the support members to the side frame members as simple vertical forces that are spread along a length of the side frame members.

It is noted that the condition shown by the dashed lines in FIG. 52 (i.e. where the L-shaped ends of the support member engage the inboard surfaces on the side frame members to limit their inward sliding movement on the side frame members) is designed to occur only in extreme "abuse" conditions, such as when about 200 pounds of force are applied as "point loads" to the seat of the present chair (which is what happens when a person tries to stand on the chair). At that point, the support member is flexed to a curvilinear shape where forces on the side frame members are not as magnified unacceptably by perpendicular forces on the center of the support members. Further, abuse conditions are less likely to occur and are not likely to continue over a substantial time period, and hence different priorities apply.

The FIG. 52A also illustrates that an end of the support member (i.e. wire 382) does not need to extend completely onto the side frame member. It is acceptable in some applications for the end of the support member to terminate close to (but short of) the side frame member. In such circumstance, the support member will still distribute and spread stress across its length as the support member bends, thus providing a desired distributed supporting force as felt by a seated user. This results in forces on the side frame member that are sufficiently perpendicular to the side frame member to be acceptable from a stress management point of view for the chair frame.

A comparison of FIGS. 52 and 52A also shows that the pivot point defined by the support members is slightly below the top supporting surface of the seat, such as about one to two inches below the top surface of the support members. For example, in FIG. 52A, the pivot location is at about location 381. In FIG. 52, the pivot location is a virtual pivot located somewhat below the end of the L-shaped end 52B. Notably, the arrangement of FIG. 52 allows the side frame member to have a thinner cross section than that shown in FIG. 52A. It is contemplated that the support members can be supported by an actual "hard" pivot on the side frame as well as the illustrated versions.

Earlier, it was mentioned that the support members (e.g. support members 45/51, 45B/51B, 78B, 380/382) can have different shapes or sizes. In particular, it is noted that their shape, stiffness, spacing, and material type will greatly affect the forces noted above. Specifically, in regard to shape and material, it is contemplated that the support members can be spring steel rods having a round cross section (as illustrated), or that they can be flat steel bands (such as, for example, 1 mm thick by 10 to 20 mm wide), or that they can be springs made from fiberglass and/or composite materials, or they can be engineering plastics (such as acetal or nylon). It is contemplated that the sections 367' (see FIG. 52A) can be designed to provide some flexibility or extensibility in a direction parallel a length of the support members 382, such as by the addition of a back-and-forth S-shaped section integrally formed at ends of the support member, so as to reduce unwanted stress magnification on the side frame members during initial bending of the support members. It is contemplated that the support members can have a non-uniform cross section along their length and/or have a non-uniform spacing between each other to optimize their support and comfort. For example, increased support may be desired in a lumbar region of a back. It is contemplated that the support members may or may not extend parallel to each other (i.e. they can extend in an "X" shaped pattern or at an angle to each other), and that they may or may not extend perpendicular to the side frame members, and that they may have changing thicknesses, widths, and/or strength properties along their lengths. (For example, the support members could be heat-treated or have "selectively non-uniform thicknesses" to provide particular strengths at particular locations.) In one contemplated variation, the edges of flat support members are wave-shaped, with interfitting edges that provide "interfitting finger-like" support to a seated user for increased comfort. In another version, one long serpentine-shape wire is bent to form all of the support members (45/51).

Figure 64A:
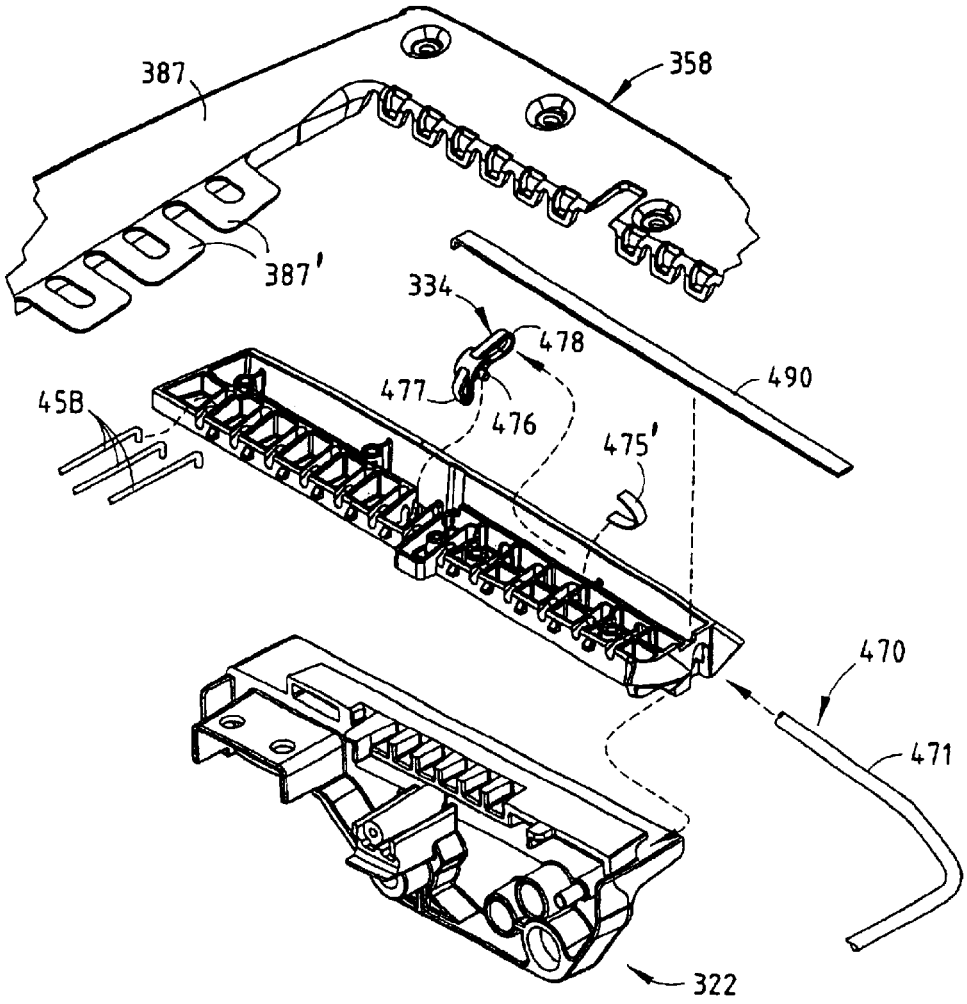
Figure 64B:
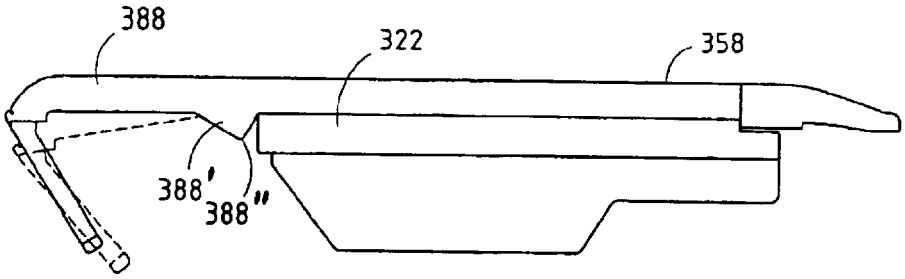
FIG. 64B is a side view similar to FIG. 4A, but showing the control of FIG. 67.

The seat upper frame component 358 (FIG. 50) includes a perimeter frame portion with side sections 385 and 386, rear section 387 and under-the-knee "waterfall" front section 388 defining a large opening 389 across which the support members 45B extend. The side sections 385 and 386 screw-attach to the lower side frame components 359 and 360, and both stiffen the side frame components 359 and 360 and also capture the end sections 52B in the pockets 50B. The rear section 387 forms a stiff rear area of the seat 22B. Tabs 387' (FIGS. 63 and 64) extend from a rear section 387 inward. Tabs 387' reduce a tendency of a seated user to uncomfortably feel the difference between the rearmost wire 45B and the rear section 387 of the seat frame. The front section 388 extends forwardly 3 to 6 inches, and forms a front "waterfall" front surface that comfortably supports the thigh area of seated users of the chair 20B. Multiple slots 390 and/or stiffening ribs provide an optimal stiffness so that the front section 388 will resiliently flex but provide adequate support and a good feel in both the upright and reclined positions of the chair 20B. Also, the triangular ribs 388' (FIG. 64B) are added so that, after a limited angular flexure of the front section 388, a face 388" of the ribs 388' abut a front of the side frame member 322. Thus, further angular flexure of the front of the seat requires an increased amount of force.

Fore/aft leaf springs and transverse leaf springs can be added to optimize any one of the sections 385–388. In particular, it is contemplated that fore/aft springs will be added to help support the transition area at ends of the front section 388 near a front of the side sections 385–386.

The illustrated reinforced-plastic springs 490 (FIG. 63) are pultruded flat leaf-springs made to flex without taking a permanent set. They fit snugly into a recess in the upper frame component 358, and are held thereagainst by the lower frame components 359. It is contemplated that they will have a flat horizontal cross-sectional shape, and that they will extend forward of the front end of the side sections 359, but other configurations and arrangements are possible, while still accomplishing the same function.

Figure 53:
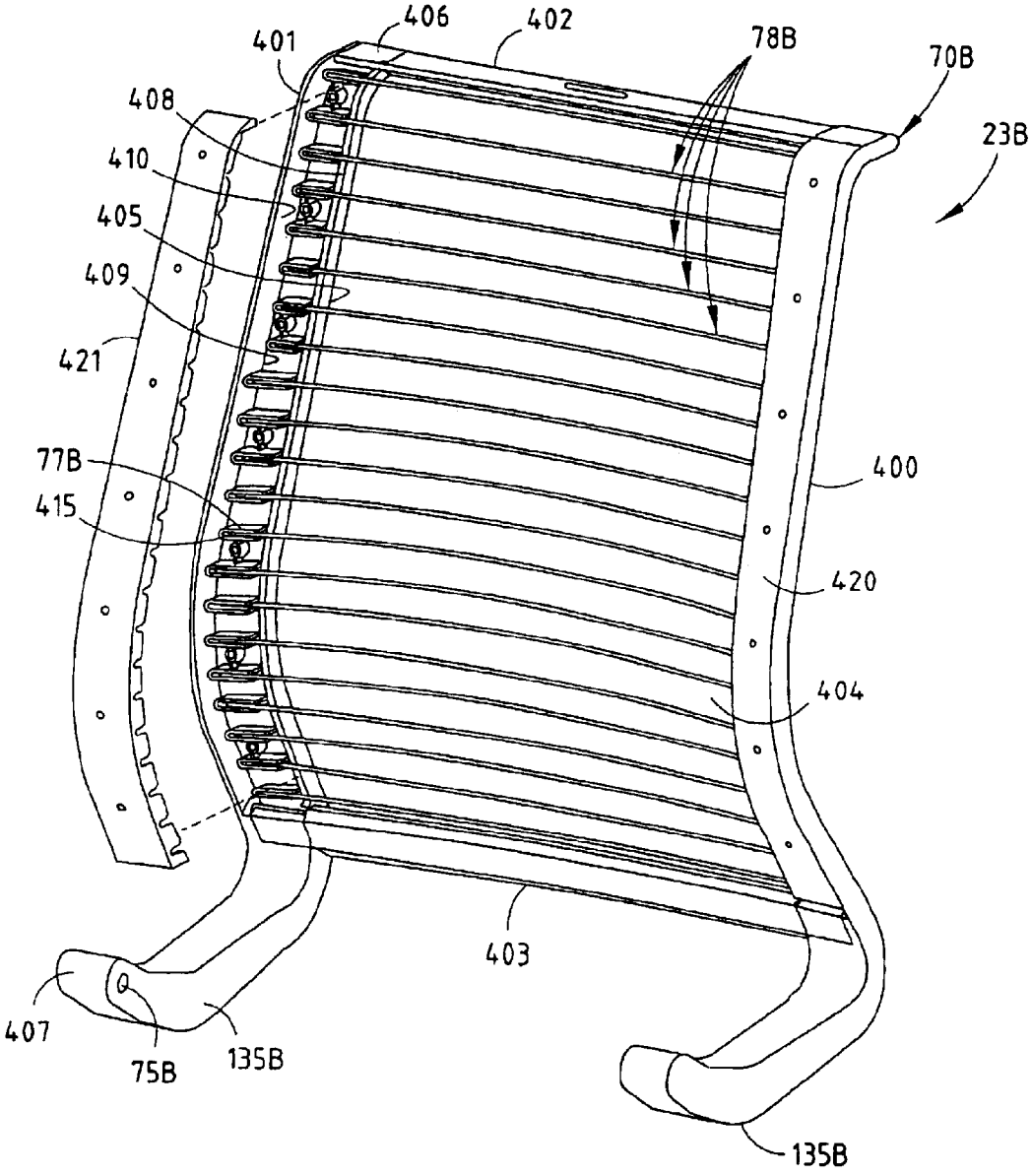
FIGS. 53–54 are exploded perspective views of the back shown in FIG. 40.
Figure 54:
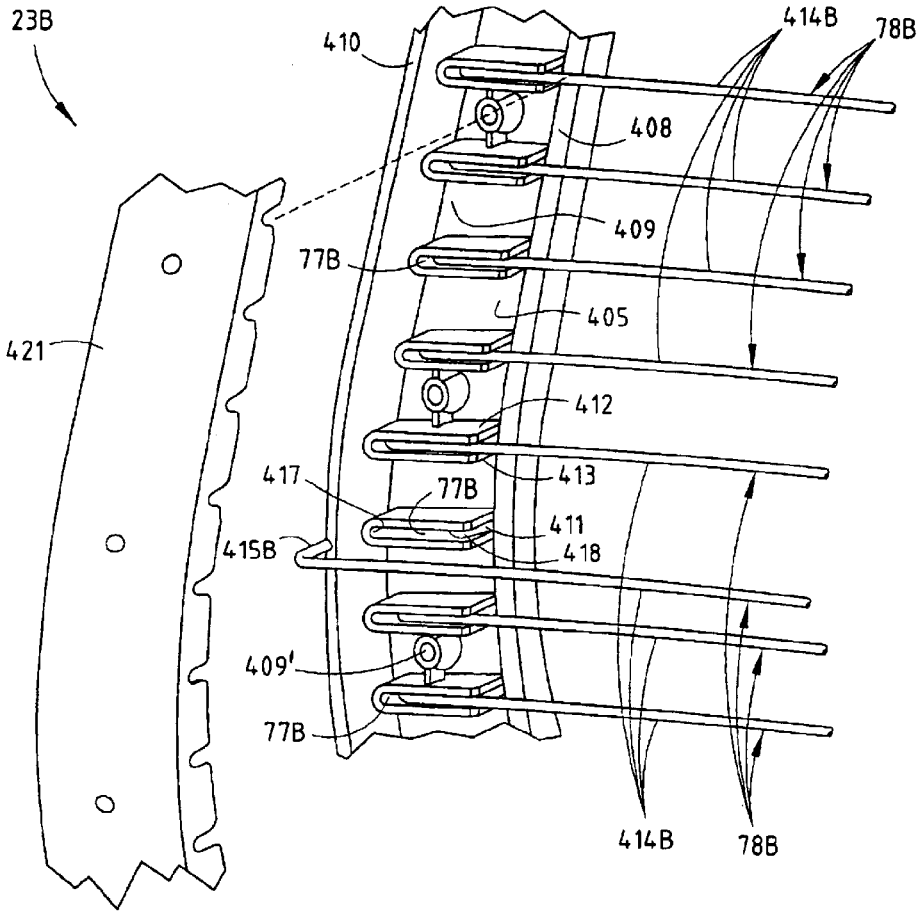

The structure of back 23B (FIGS. 53–54) is not dissimilar to the structure of the seat 22B. Hence a detailed repetitious description is not required. Nonetheless, it is noted that the back 23B includes a back perimeter frame 70B with upright side sections 400, 401, top transverse section 402 and bottom transverse section 403 defining a large open area 404. A bottom of the side sections 400 and 401 extend forwardly to form forwardly-extending side leg sections 135B, and are pivotally connected to the seat side sections at pivot 75B. The upright side sections 400 and 401 include a bottom wall 405 (FIG. 53), end walls 406 and 407, and inner and outer walls 408 and 410. Half-depth slots 411 (FIG. 54) are formed in inner wall 408, and parallel walls 412 and 413 extend between the inner and outer walls 408 and 410 on each side of each slot 411. A pocket 77B is formed on the bottom wall 405 between the parallel walls 409–410. Bosses 409' are formed between the inner and outer walls 408 and 410, and are supported by a short intermediate wall 409 that extends between adjacent ones of the parallel walls 412 and 413 (at locations not interfering with the recesses or pockets 77B). Support members 78B (similar to support members SOB in the seat 22B) are positioned on the back 23B, and each include a long wire section 414 that extend into the slots 411, and L-shaped bent end sections 415 that extend down into the pockets 77B. The movement of end sections 415 within the pockets 77B is similar to that described above in regard to the seat 22B. In the rest position, the end sections 415 abut outer surfaces 417 of the pockets 77B, thus holding the wires in a partially bent condition. When a seated user rests in the chair and leans on the back, the long wire sections 414 flex, until the end sections 415 move abuttingly into the inboard stop surface 418, thus limiting any further flex of the wire support members 78B. Front covers 420 and 421 (FIG. 53) are attached to a front of the back upright side sections 400 and 401. The covers 420 and 421 both stiffen the side sections 400 and 401, and also hold the end sections 415 within the pockets 77B.

A cushion assembly 375' (FIG. 40) similar to that described above in regard to the seat 22B is attached to the back frame 70B. It can be attached in different manners. It is contemplated that one optimum method is to stretch and hook-attach the cushion assembly to the top and bottom transverse frame sections 402 and 403. It is contemplated that a person skilled in the art will be able to use and adapt the attachment structure shown in FIGS. 70–71 to the top and bottom of the back 23B for attaching the back cushion assembly 375', and to the front and rear of the seat 22B for attaching the seat cushion assembly 375. Thus, a detailed description of each is not required.

Figure 71:
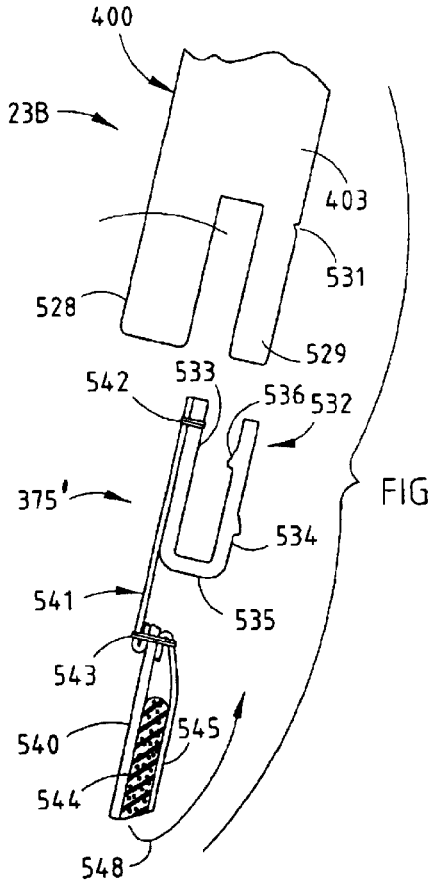

As shown in FIG. 71, the bottom frame section 403 of the back frame 400 includes a pair of ridges 528 and 529 that define a downwardly-facing rectangularly-shaped pocket or channel 530 that extends continuously across a width of the back frame 400. A detent channel 531 (or ridge, if desired) is formed parallel the channel 530 along an outside front surface of the bottom frame section 403. The cushion assembly 375' includes a U-shaped extruded plastic attachment clip 532, including a flat leg 533, a barbed leg 534, and a resilient section 535 connecting the legs 533 and 534. The legs 533 and 534 are spaced apart to receive and mateably engage the forward ridge 529. A detent protrusion 536 is biased into engagement with the detent channel 531 by the resilient section 535.

The cushion assembly 375' further includes a sheet of upholstery material 540 connected to the flat leg 533 by a strip of elastic sheet material 541. (Alternatively, the elastic sheet material 541 can be eliminated, and the upholstery material 540 attached directly to the flat leg 533, if testing shows that the added elastic stretch from the sheet material 541 is not required.) Specifically, one edge of the elastic sheet material 541 is sewn to the flat leg 533 of clip 532 by stitching 542, and an opposite edge is sewn to the upholstery material 540 by stitching 543. The strip 541 extends completely across a width of the back frame 400. Different methods are known for attaching and sewing the upholstery material 540 to the strip 541, and for attaching and sewing the strip 541 to the flat leg 533, such that only a single simple seam is illustrated. It is contemplated that in some embodiments, in addition to the sheet material 541, a foam layer 544 and stable backing sheet 545 will be attached to the cushion assembly 375', although this is not required.

To attach the cushion assembly 375' to the back frame 400, the flat leg 533 of the extruded clip 532 of the cushion assembly 375' is pressed into the channel 530 of the bottom frame section 403 of the back frame 400, with the opposing leg 534 frictionally engaging an outer front surface of the bottom frame section 403. The combined thickness of the elastic sheet material 541 and the flat leg 533 captured within the channel 530, along with the detent protrusion 535 engaging the detent channel 531, form a strong secure connection that retains and holds the cushion assembly 375' to the back frame 400. It is noted that the sheets 540 and 541 overlay onto the barbed leg 534 when the cushion assembly 375' is fully installed onto the back frame 400 (see the arrow 548 in FIG. 71, and see the assembly of FIG. 70). Since the barbed leg 534 has a thickened cross section, a tension in the sheets 540 and 541 further biases the detent protrusion 535 into engagement with the detent channel 531. Also, the thickened section of the barbed leg 534 can help hide the stitching by providing a space to receive the stitched area and to receive the multiple thicknesses of pleats in the stitched area. By tensioning the cushion assembly 375' from top to bottom, the cushion assembly 375' with upholstery material 540 will pretension and bend the wires (78) to form a "PRINGLES® potato chips" shape of the comfort surface of the back.

Figure 55:
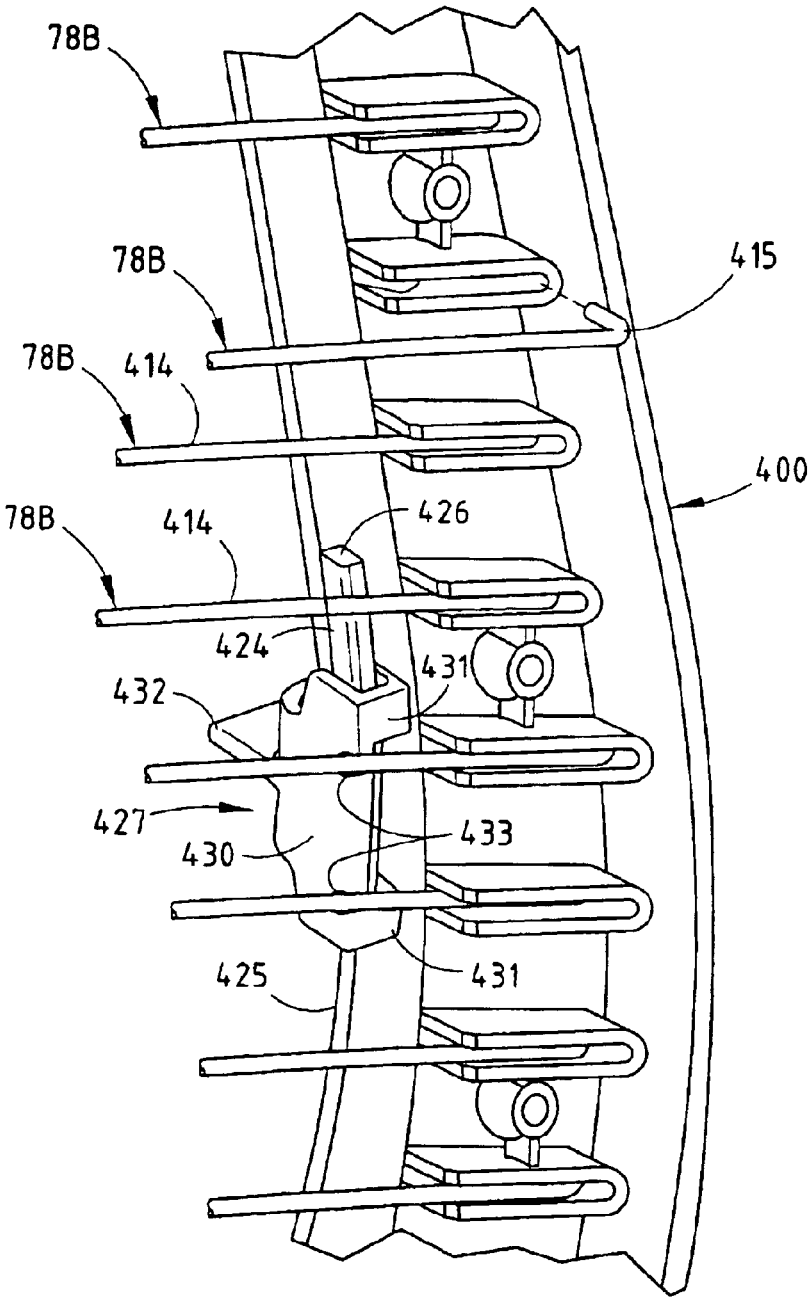
FIGS. 55–57 are perspective views of the lumbar devices and their effect on the wire support sections.

A rail 424 (FIG. 55) is formed on a front of an inwardly-directed flange 425 on the side sections 400 and 401. The rail 424 extends vertically about one-half to two-thirds of a length of the side sections 400 and 401, and includes a top termination or end 426 that forms an access port for engaging the rail 424. Different accessories can be mounted on the rail 424. For example, a lumbar device 427 and a headrest support 428 (FIG. 40) are illustrated.

Figure 56:
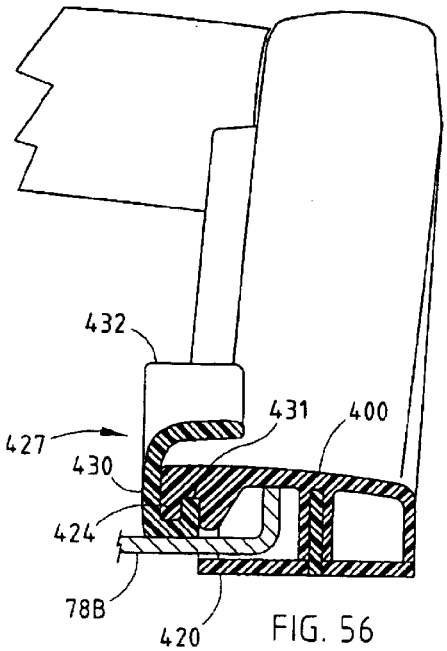
Figure 57:
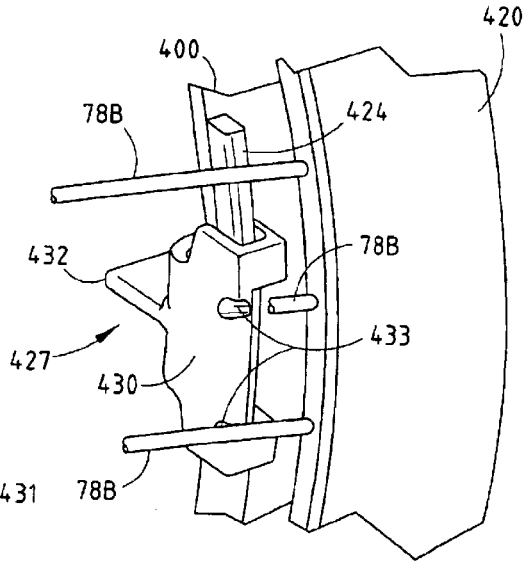
Figure 58:
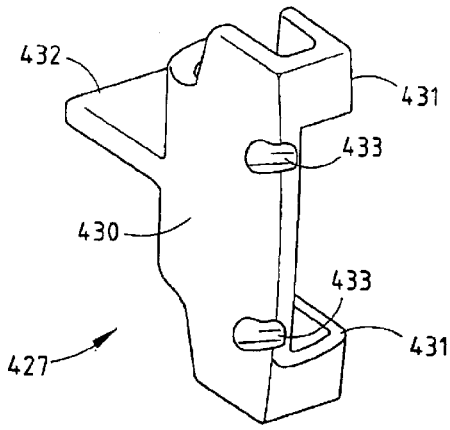
Figure 59:
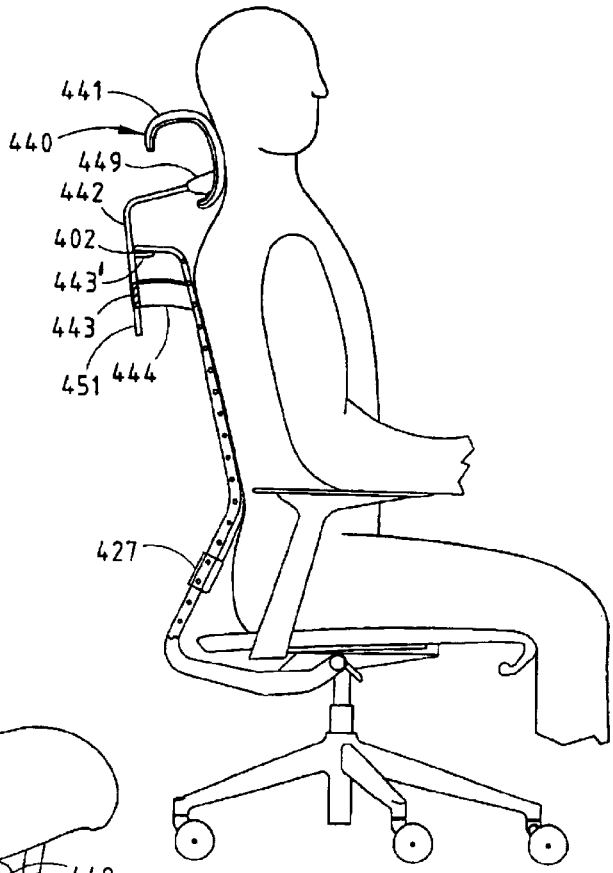
FIG. 59 is a perspective view of the chair of FIG. 40 with the lumber device of FIG. 55 in a disabled storage position.

The illustrated lumbar device 427 (FIG. 55) includes a plastic body 430 that extends around flange 425, a pair of hook-shaped retainer fingers 431 that slidably engage the rail 424, and a handle 432 that extends from body 430 opposite the retainer 431. A pair of detent bumps or recesses 433 are formed on the body 430 adjacent the retainer fingers 431, and are adapted to detentingly engage successive wire support members 78B as the lumbar device 427 is moved up and down. Interestingly, the lumbar device 427 can be adjusted downwardly to a non-use storage position (see FIG. 59), where the lumber device 427 is so low that it is effectively disabled since it is no longer effective to provide lumbar support to a seated user. As the lumbar device 427 is moved upwardly, the area of body 430 adjacent the detent bumps 433 supports the long wire sections 414 at locations inboard of the inner wall 408. (See FIG. 56.) Thus the effective bendable length of the long wire sections 414 is foreshortened, as illustrated by FIGS. 56–57. Thus, the added lumbar support comes from less flexing of the long wire sections 414, and does not come from a forced shape change to the lumbar support area on the back 23B (although it could also be designed to create a shape change in the lumbar, if desired). This "flat" adjustment is believed to have good ergonomic benefits, since a seated user receives the added lumbar support that they desire, yet their back and upper torso are not forced to take on a different body shape.

Another important discovery is the independent action of the right and left lumbar devices 427. By adjusting the right and lumber devices 427 to a same height, a maximum lumbar support force can be achieved in a particular area (i.e. two wire long support sections 414 are supported). By adjusting the right and left lumbar devices 427 to different heights, the lumbar support area is effectively enlarged (i.e. four wire long support sections 414 are supported). Further, where one lumbar device 427 is adjusted high and the other is adjusted relatively low but still in an effective lumbar supporting area, the lumber devices 427 provide an exceptionally wide range of non-uniform adjustability, (i.e. more to the right in one area and more to the left in another area). It is also conceived that different lumbar devices 427 can be provided, such that a user can select the lumbar support that they desire by choosing an appropriate lumbar device 427.

Even if a single one of the illustrated lumbar devices 427 is used (e.g. if the other side lumbar support device 427 is parked in the disabled position), the seated user does not feel an unbalanced lumbar support from the back 23B. However, it is conceived that the present lumbar device 427 can be designed to appreciably shift the lumbar support to one side (i.e. the long wire section 414 is supported only on one side, such that more lumbar support is provided on one side of the chair and less support on the other side). This initially may seem to be undesirable since the lumbar support is unbalanced. However, testing has shown that some seated users want and even prefer an unbalanced lumbar support. This may be particularly true for users having a curved spine, where non-uniform support has beneficial health effects. Also, users may want different lumbar support at different times as they sit and/or recline sideways in unsymmetrical positions, and as they turn and shift to different unbalanced positions in their chairs.

The illustrated back frame 70B (FIG. 67) has a unique construction that facilitates assembly. The bottom 500 of side sections 400 and 401 are hollow and each define an arcuate cavity 501. Side leg sections 135B include an arcuately-shaped body 502 configured to telescopingly slide into cavity 501. Once telescoped together, holes 503 and 504 on the bottom 500 and side leg sections 135B align. Pivot pins are extended through holes 503 and 504 to form pivot 75B, and both secure the components (bottom 500 and side leg sections 503 and 504) together, but also act as pivots for the back frame 70B on the seat 22B.

The side frame members 322 of the seat 22B include a pair of arcuate recesses 510 (FIGS. 48 and 67) that extend partially circumferentially around the hole 75B. The recesses 510 and holes 75B form a bow-tie-shaped feature. An inboard side of the side leg sections 135B include a pair of opposing protrusions 511 (FIG. 67) that fit into recesses 510. The protrusions 511 engage opposing ends of the recess 510 as the back frame 70B (i.e. back 23B) is rotated around pivot pins 505 between upright and fully-reclined positions, thus acting as a stop to set a maximum recline position of the back 23B.

Figure 60:
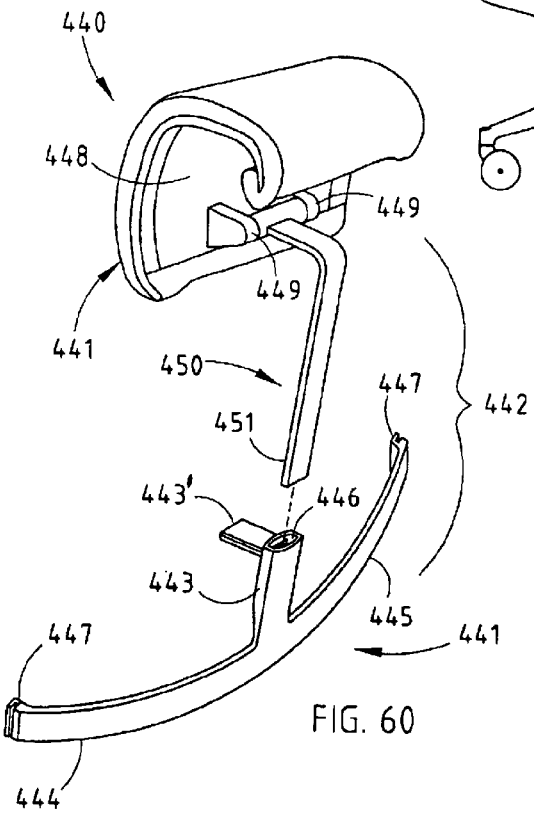
FIG. 60 is an exploded perspective view of the headrest assembly on the chair of FIG. 40.

A headrest 440 (FIG. 60) can be added to the chair 20B. The headrest 440 includes a headrest support 441 and a vertically and angularly adjustable headrest assembly 442. The headrest support 441 includes a center tube 443 and right and left arms 444 and 445 that extend to side sections 400 and 401 of the back frame 70B. The center tube 443 is positioned rearward of the transverse upper frame section 402 and includes a tab 443' configured to securely engage and be attached to the top frame section 402 of the back frame 70B. Alternatively, it is contemplated that the tube 443 can be positioned under and in-line with an opening in the rearwardly flared top frame member 402 of the back 238. The arms 444 and 445 each have an end 447 configured to engage the accessory rail 424 for stability. The headrest assembly 442 includes a cushioned C-shaped head-engaging support 441. A pair of mounts 449 are attached to a rear of a stiff sheet 448 under the C-shaped support 441. An upright support 450 includes a vertical leg 451 that extends slidably through the opening in the center tube 443. Detents can be provided in the upright support 450 and tube 443 to retain the headrest in a selected position.

Figure 61:
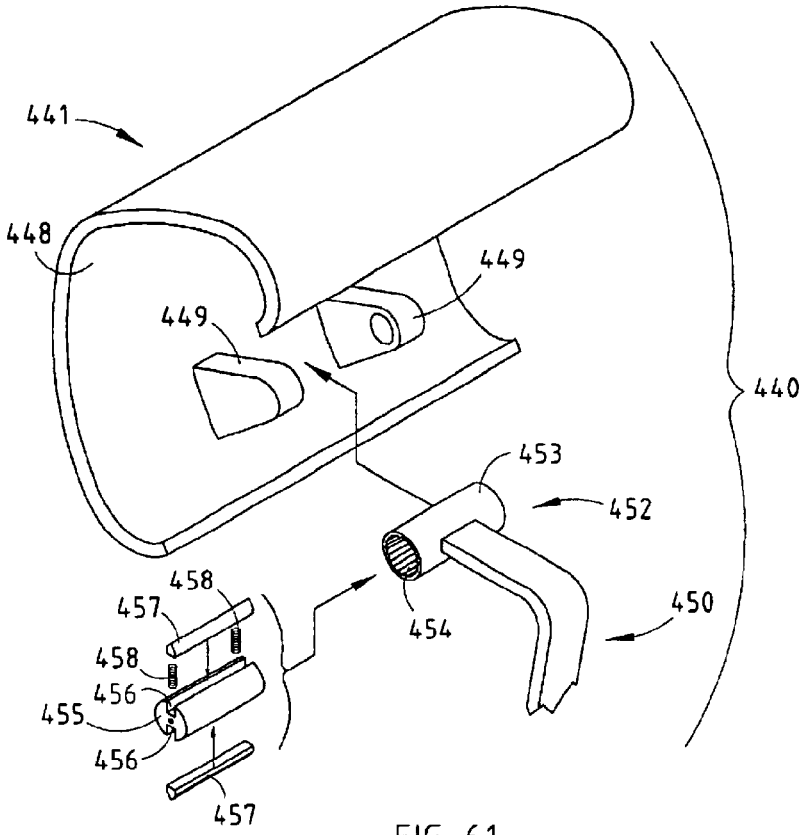
FIGS. 61–62 are an exploded perspective view and exploded cross section view of the headrest assembly of FIG. 60.
Figure 62:
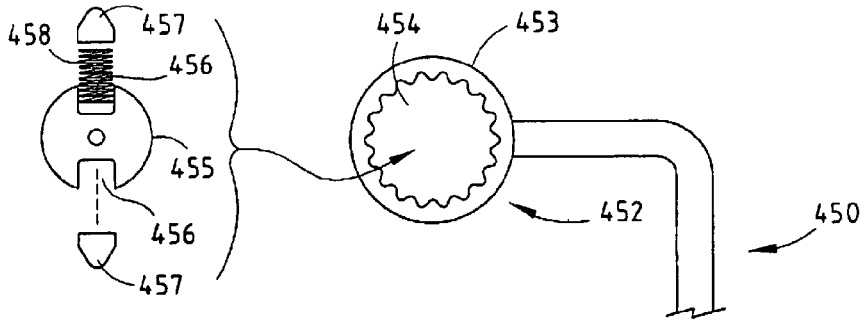

A top of the upright support 450 includes a transverse T-shaped section 452 (FIG. 61) that extends between the mounts 449. The section 452 (FIG. 61) includes a hollow tube member 453 with longitudinal serrations 454 around its inner surface. A bar 455 extends between and is fixed to the mounts 449. The bar 455 includes a pair of longitudinal channels 456, and a pair of detent rods 457 are positioned in the channels 456. Springs 458 are positioned in transverse holes in the bar 455, and bias the detent rods 457 outwardly into engagement with the serrations 454. By this arrangement, the headrest assembly 442 can be angularly adjusted on the headrest support 441. The C-shaped headrest support structure 448 has a forward surface that, in cross section, is spiral in shape and is non-symmetrical about the bar 455. Due to the shape of the C-shaped headrest support structure 448, the effective area for supporting a seated user's head moves forward as the headrest support structure 448 is angularly rotatingly adjusted.

The seat supports (FIG. 50), back supports 78B (FIG. 53), seat frame 30B (FIGS. 45 and 50), back frame 70B (FIGS. 53 and 69), springs 123B' and 137B and control mechanism 24 (FIG. 45) form a compliant chair assembly that results in a soft stop as the back 23B reaches a full upright position, and results in a soft stop as the back 23B reaches a full recline position. This avoidance of a hard "clunk" or jerky stop, in combination with the fluidity and smoothness of the ride during recline is noticeable, and results in a surprising and unexpected level of support and comfort to a seated user.

It has been discovered that during recline of the chair 20B (FIG. 40) (and similarly chair 20 of FIG. 1), the structure of the link 132B and the arms 127B and the back frame upright 123B permit some compliant motion of the back 23B even when the back stop member 205B is engaged. Specifically, with the illustrated components, when the back 23B "bottoms out" against the back stop during recline, the support arms 127B and related components in the present chair control provide a compliancy internal to the control not previously seen in prior chair controls. Specifically, the arms 127B and related components allow the back 23B to give and comply a limited but noticeable amount. Thus, at the point of engaging the back stop, an increased back support force is provided to a seated user . . . but the feel of a rigid "brick wall" stop is avoided. Instead, the compliant support arms 127B and back frame upright 123B flex permitting the back 23B to move along a limited changed path to provide a compliant "soft stop". The forces on the back 23B along this limited changed path can be controlled by varying a strength and massiveness of the various structural elements of the chair, as will be understood by a person skilled in the art of manufacturing chairs and seating units.

It is noted that the present appearance and design of the illustrated chairs and individual components of the chairs, (such as the armrest, headrest, wires visible on a rear of the back, "gull wing" shape of the underseat control spring, and other items) are considered by the present inventors to be novel, ornamental, and non-obvious to a person of ordinary skill in this art, and hence are believed to be patentable.

Additional Modification

Figure 72:
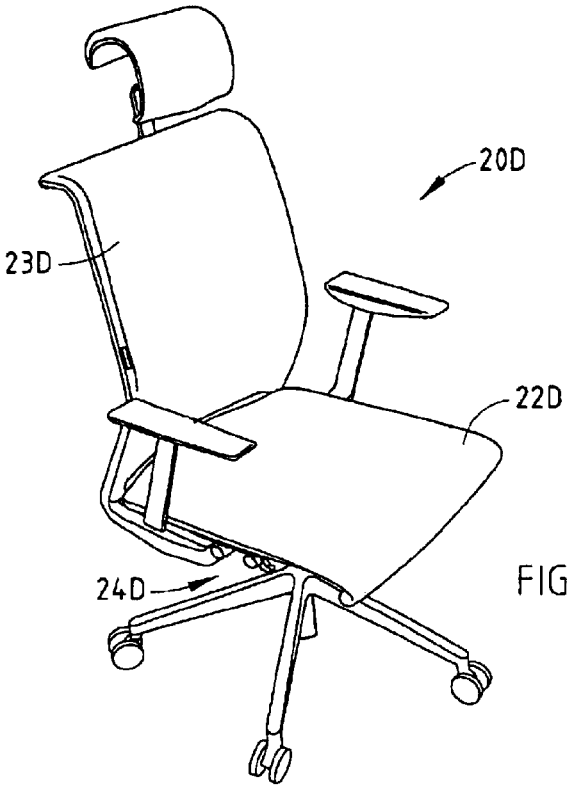
FIGS. 72–74 are front perspective, rear perspective, and side views of another embodiment similar to the embodiments shown in FIGS. 1–71 but with improvements.
Figure 73:
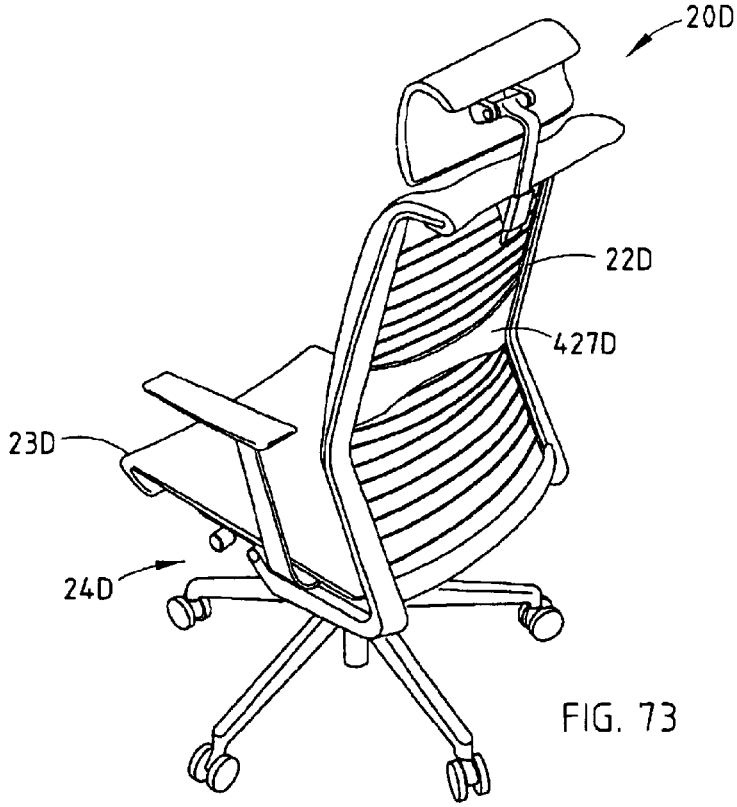
Figure 74:
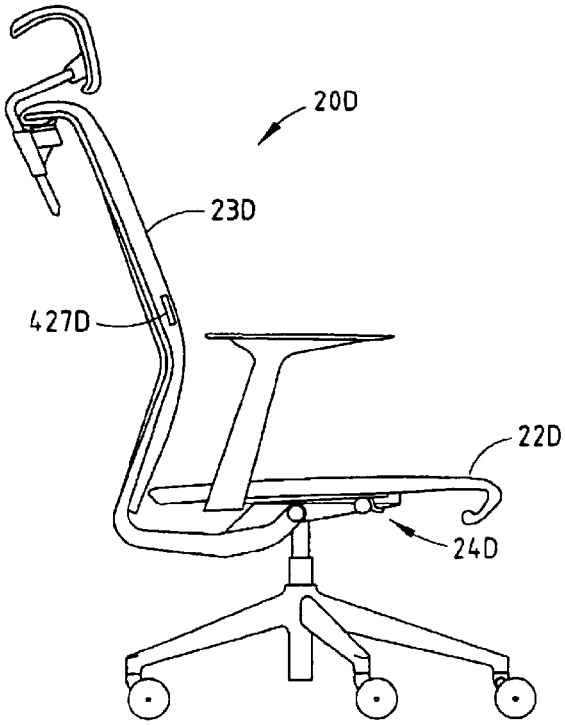
Figure 75:
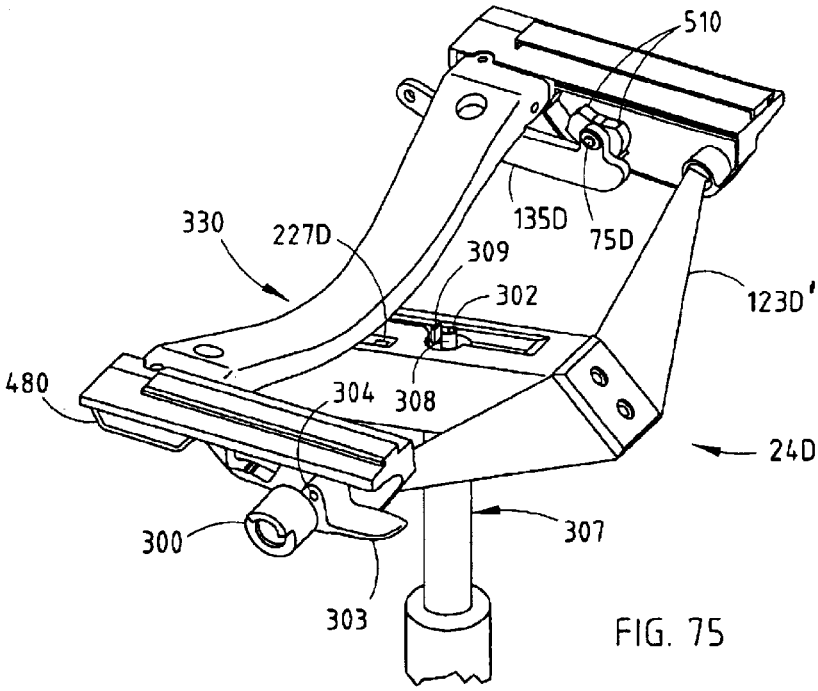
FIG. 75 is a perspective view of the control of FIG. 72.
Figure 76:
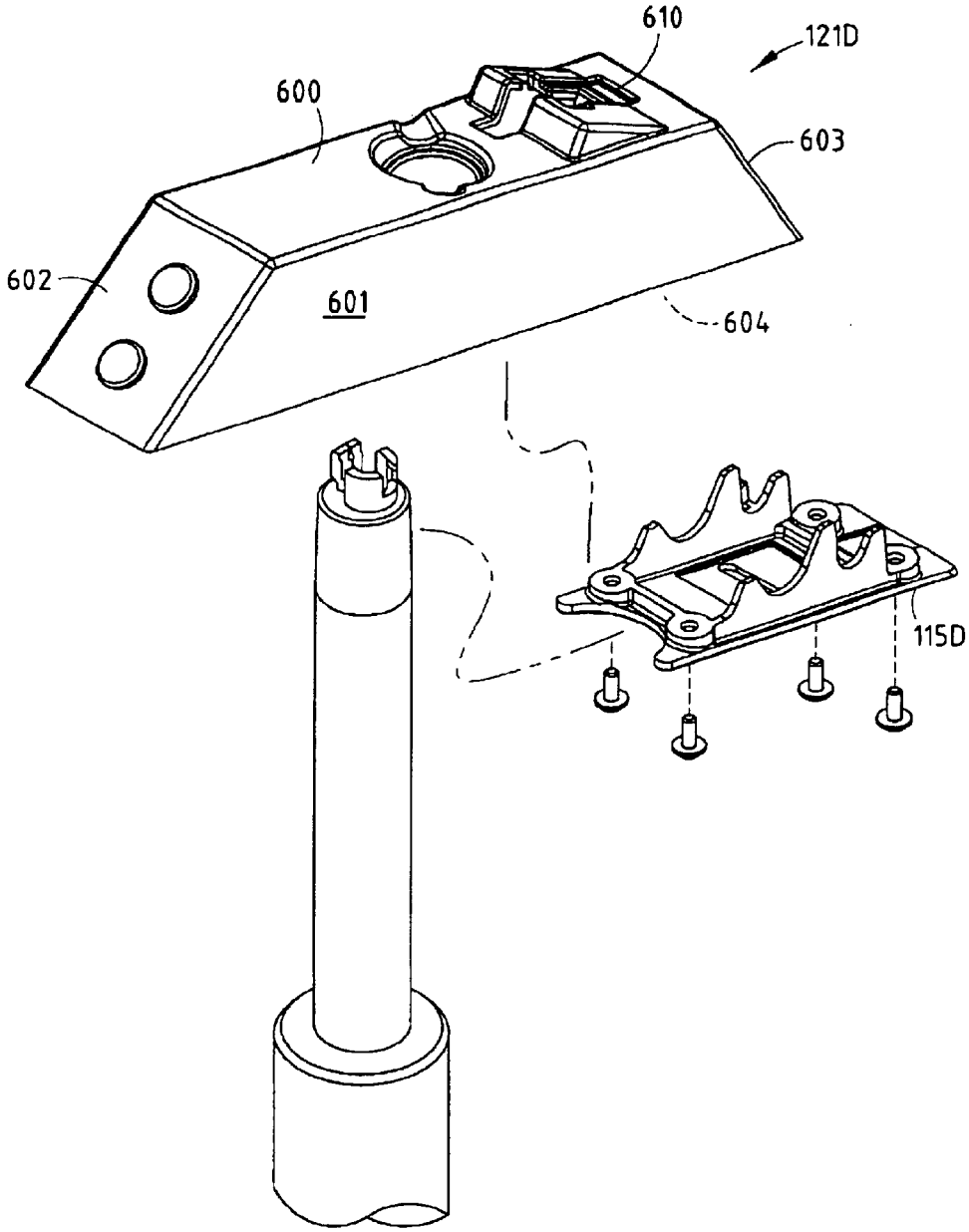
FIGS. 76–79 are exploded views of the various control components shown in FIG. 75.
Figure 77:
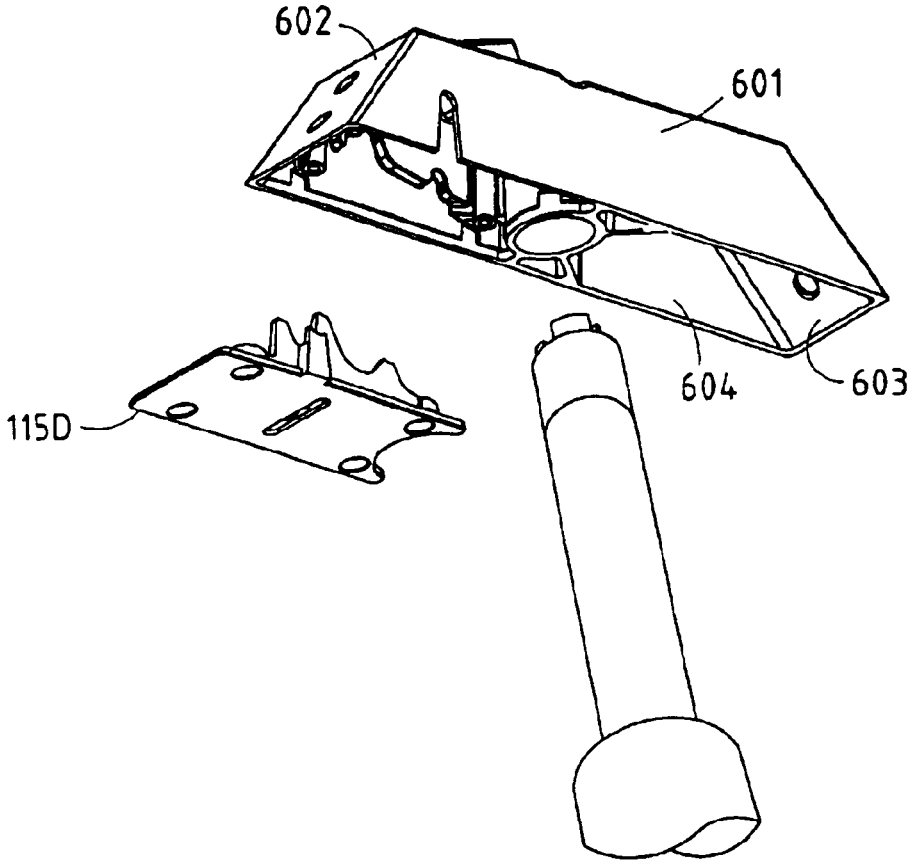
Figure 78:
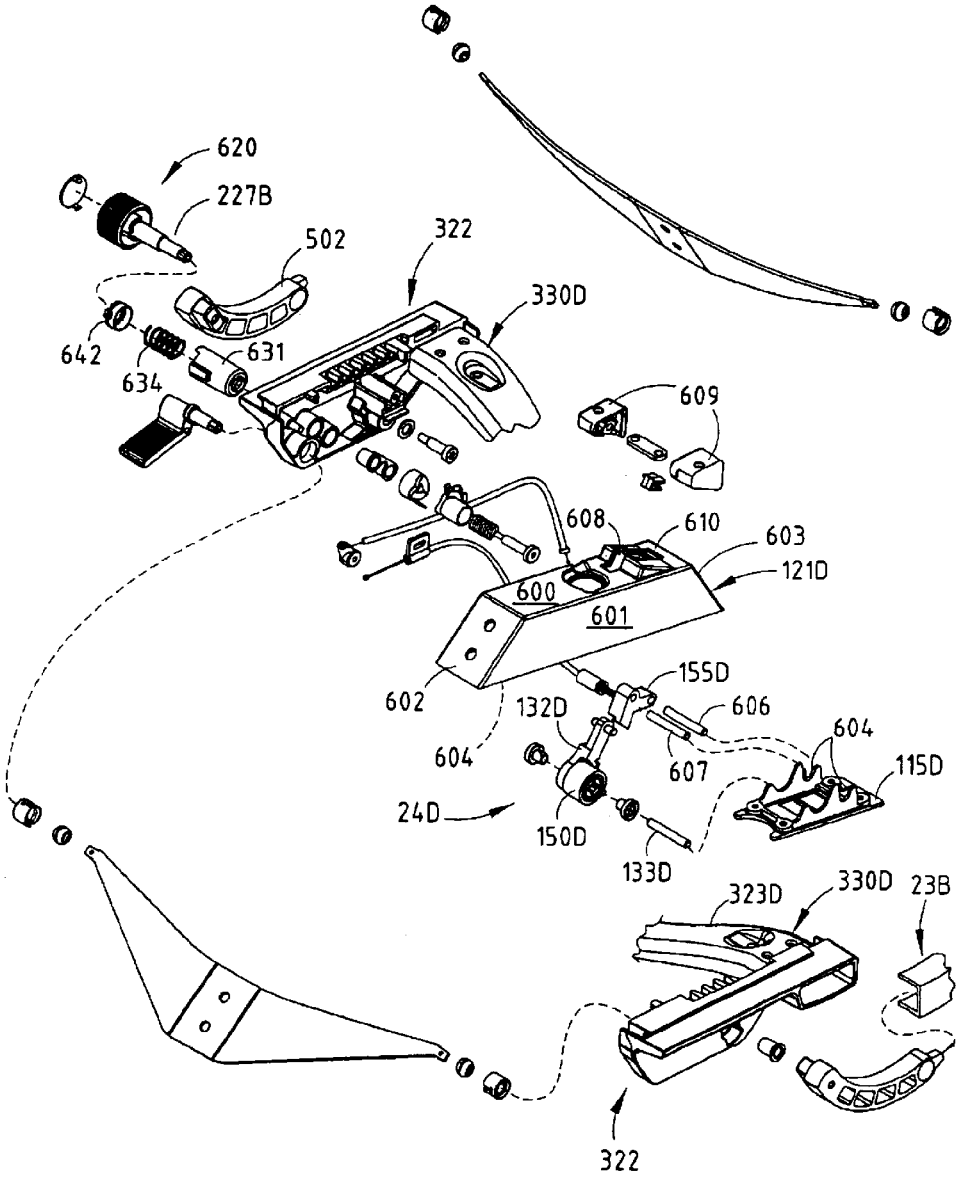
Figure 79:
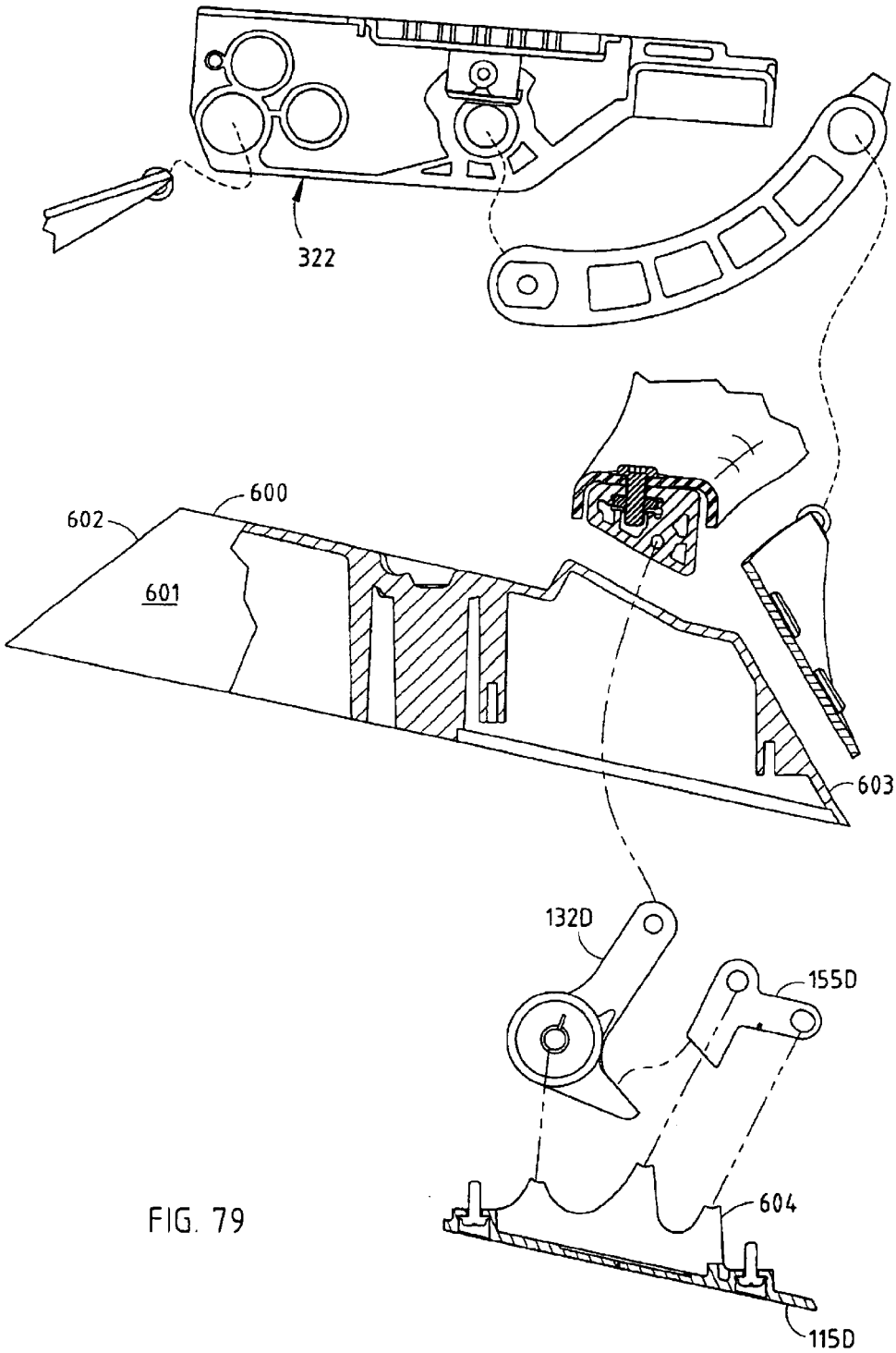

A modified chair or seating unit 20D (FIGS. 72–74) includes changes and improvements from that of chairs 20 and 20B. In order to minimize redundant discussion and to facilitate comparison, similar and identical components and features of the chair 20B to the chair 20 are often identified using many of the same identification numbers, but with the addition of the letter "D".

Figure 94:
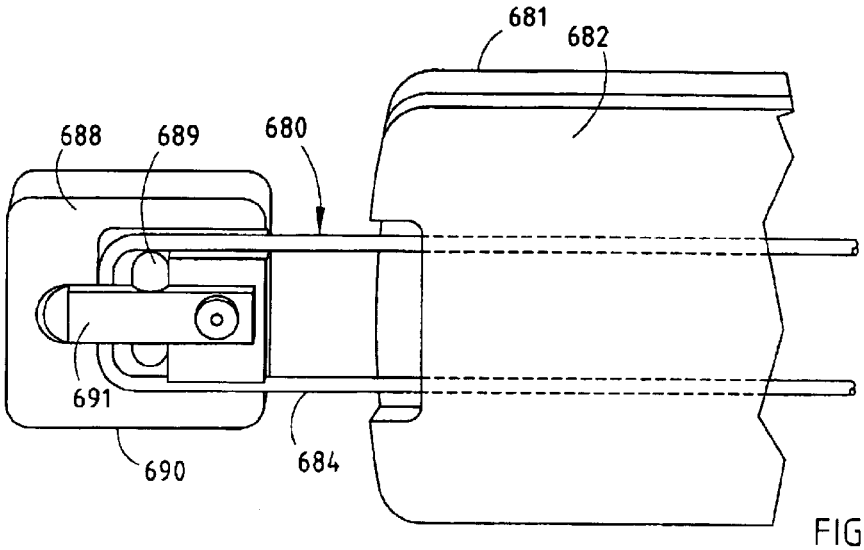
FIGS. 94 and 94A are an end section and an exploded perspective view of the lumbar device shown in FIG. 93.
Figure 94A:
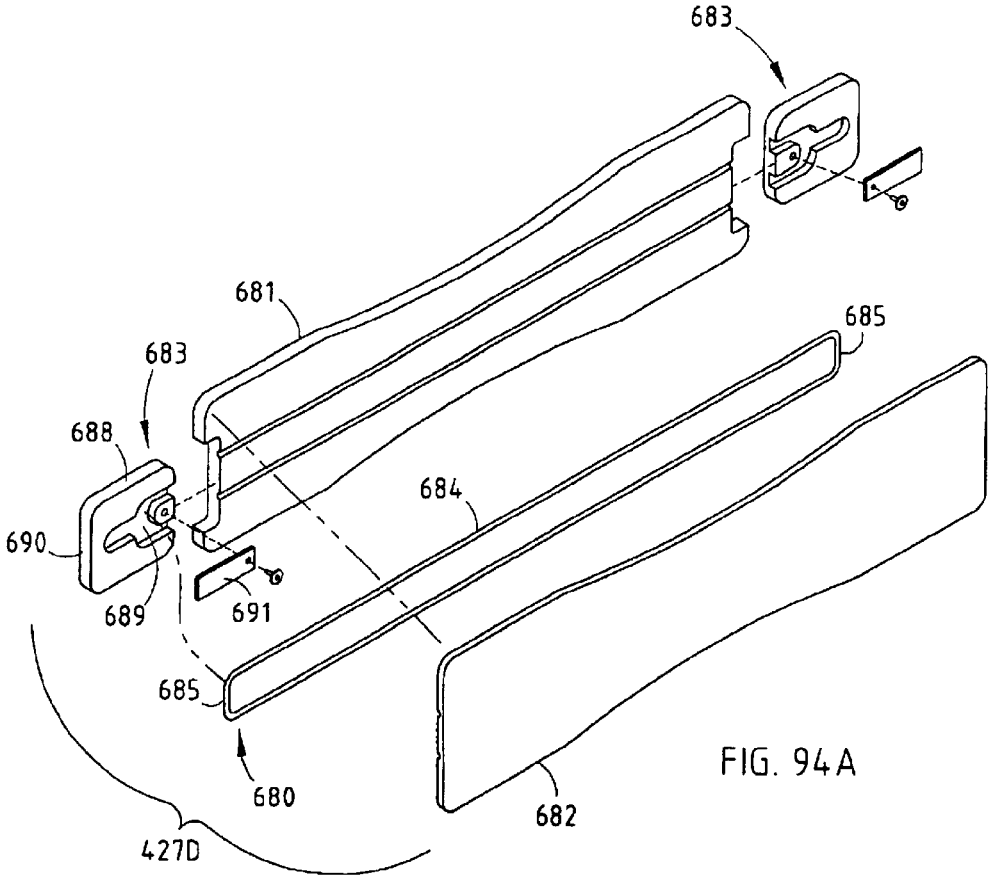
Figure 94B:
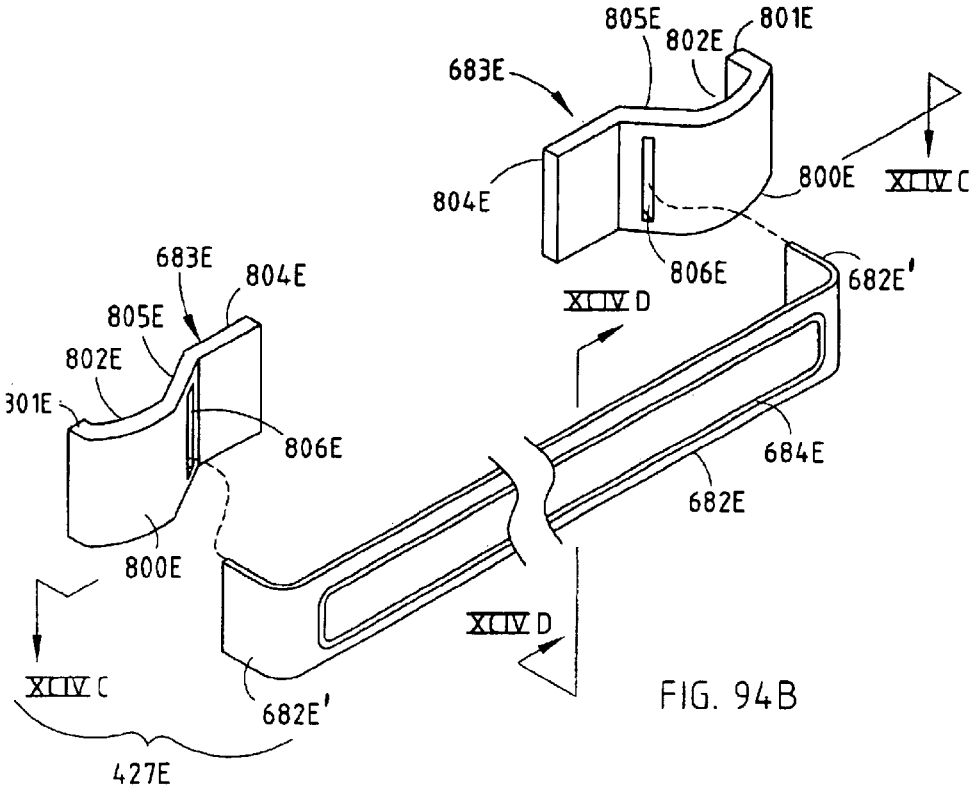
FIG. 94B is an exploded view of a modified lumbar device.
Figure 94C:
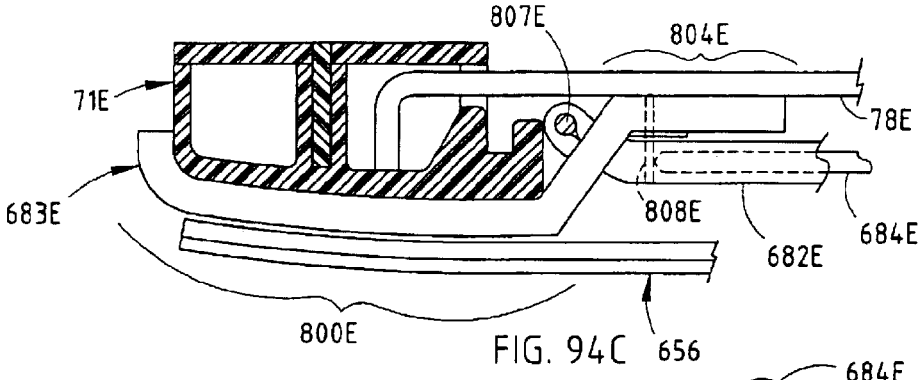
FIGS. 94C–94D are cross sections taken through FIG. 94B.
Figure 94D:
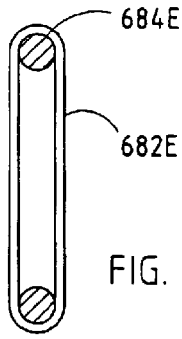
Figure 95:
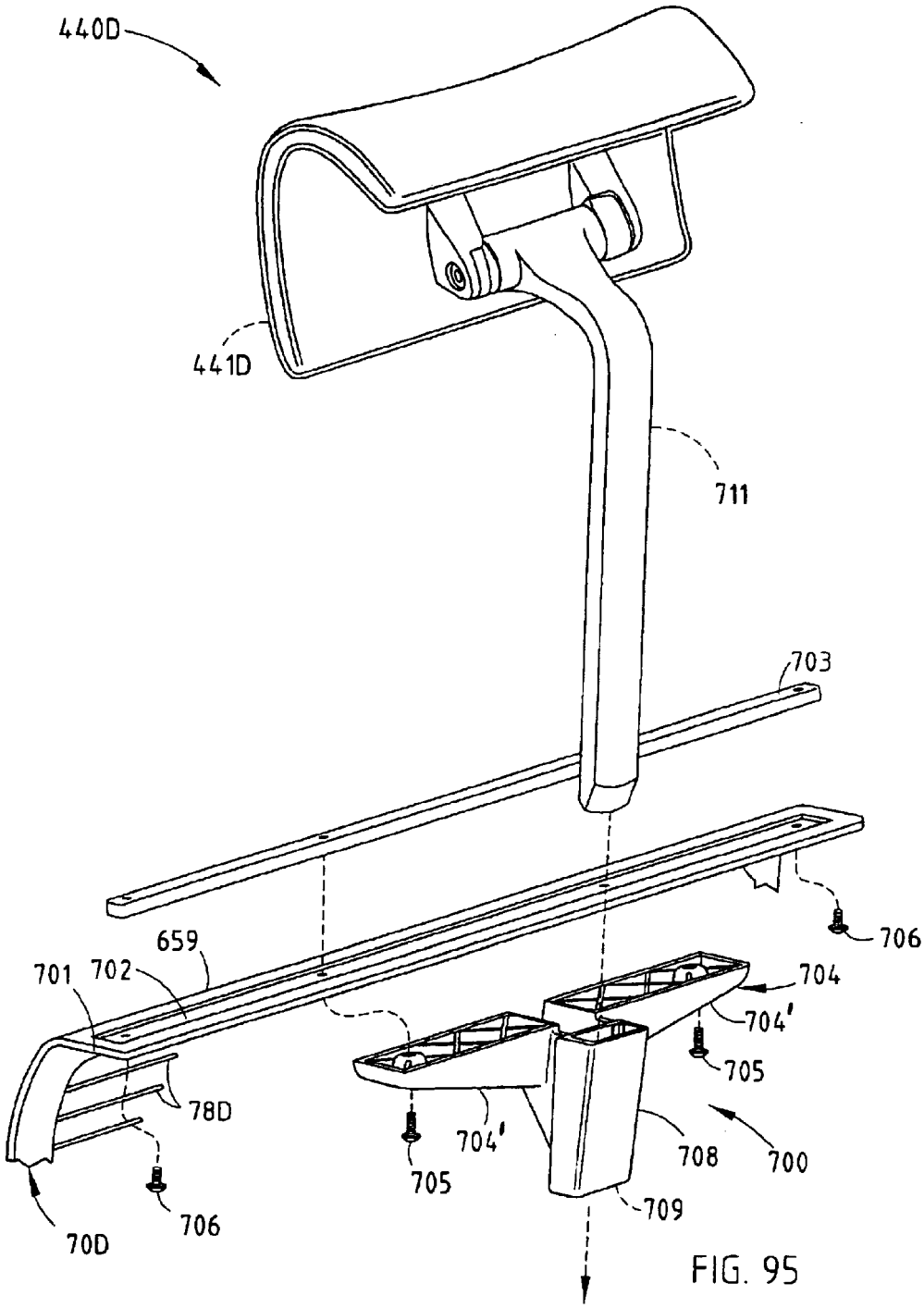
FIGS. 95–96 are exploded perspective views of the headrest shown in FIG. 72.
Figure 96:
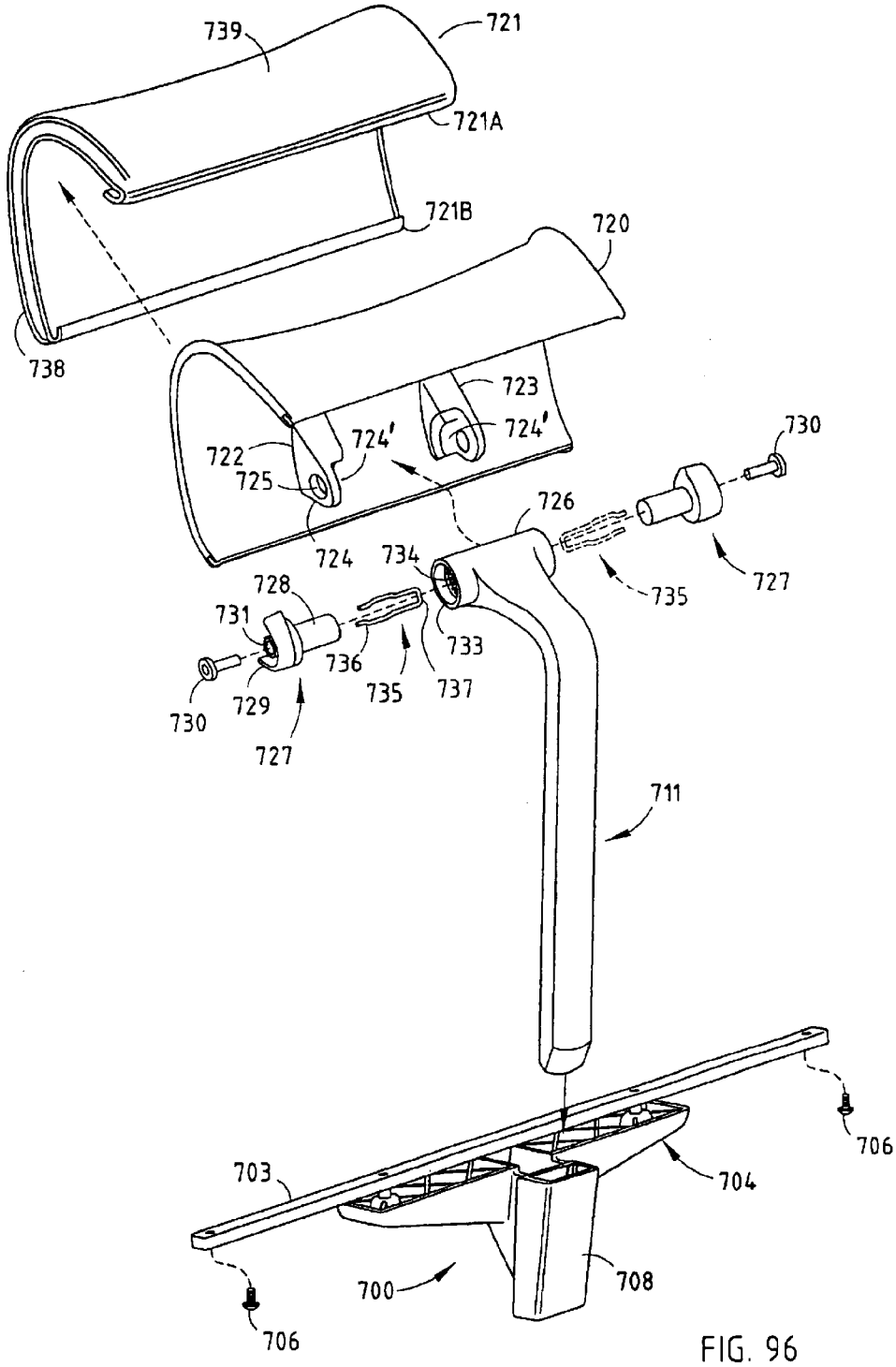
Figure 97:
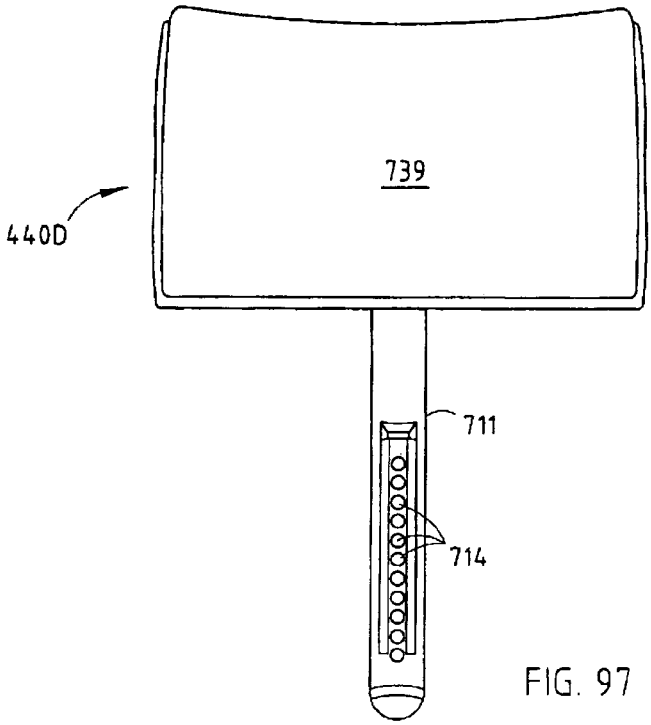
FIG. 97 is a front view of the headrest and headrest mount of FIG. 95.
Figure 98:
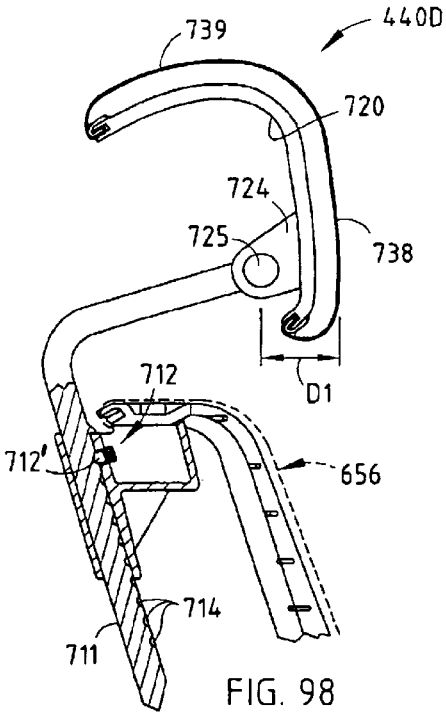
FIGS. 98–99 are side cross-sectional views showing operative angular positions of the headrest.
Figure 99:
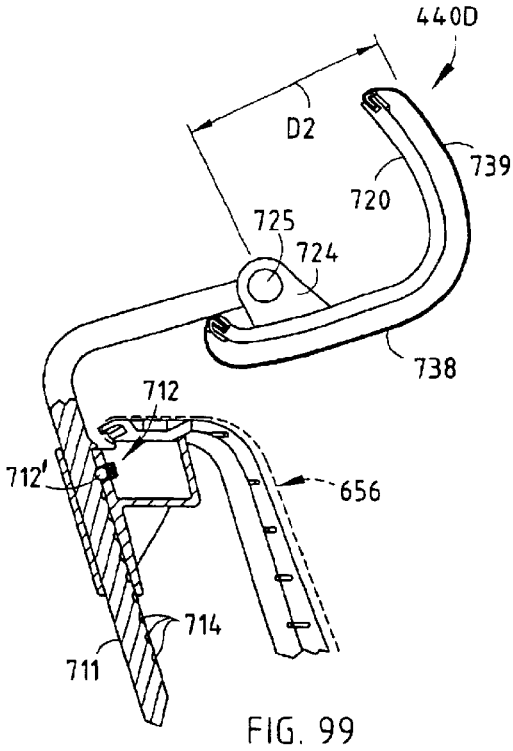
Figure 100:
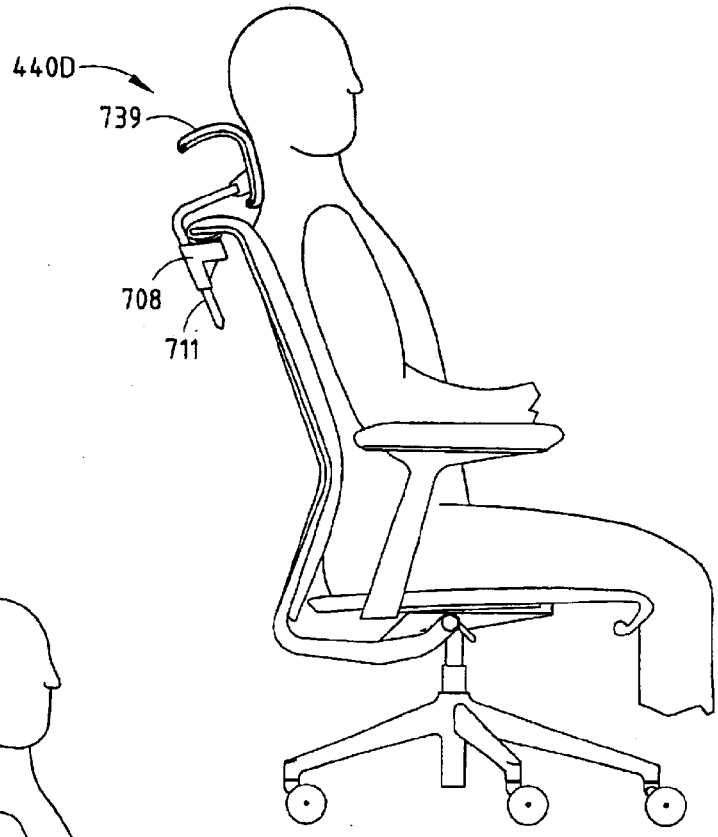
FIGS. 100–101 are similar views showing the entire chair.
Figure 101:
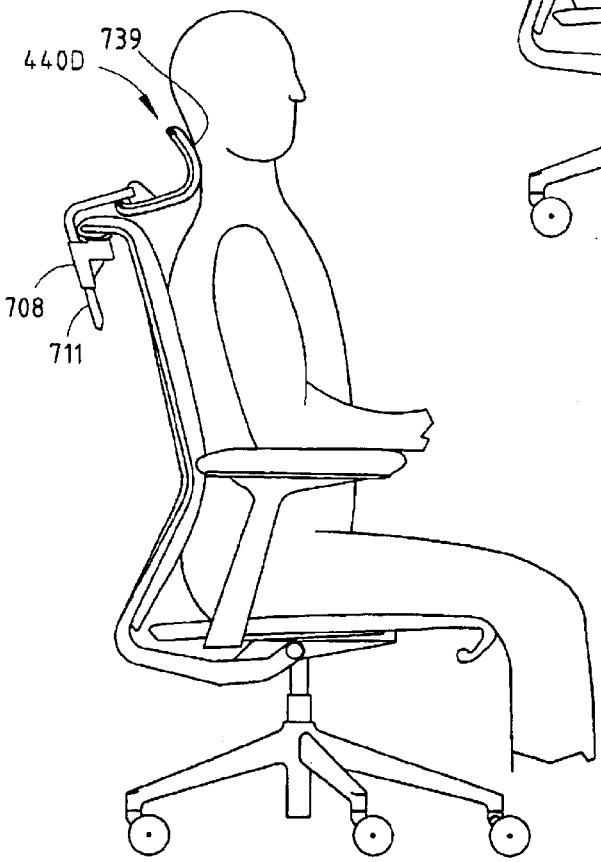
Figure 102:
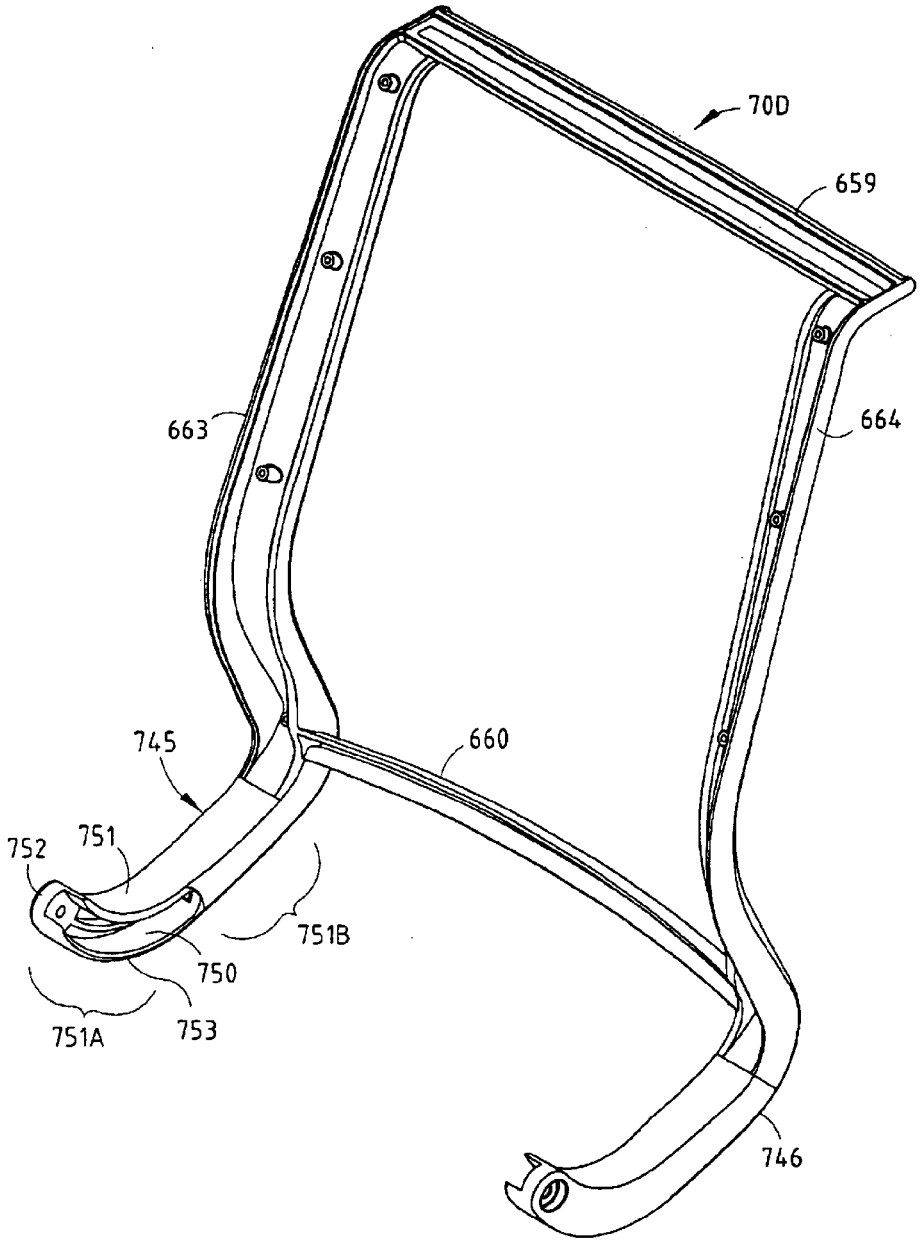
FIG. 102 is a perspective view of the back frame of FIG. 72.
Figure 104:
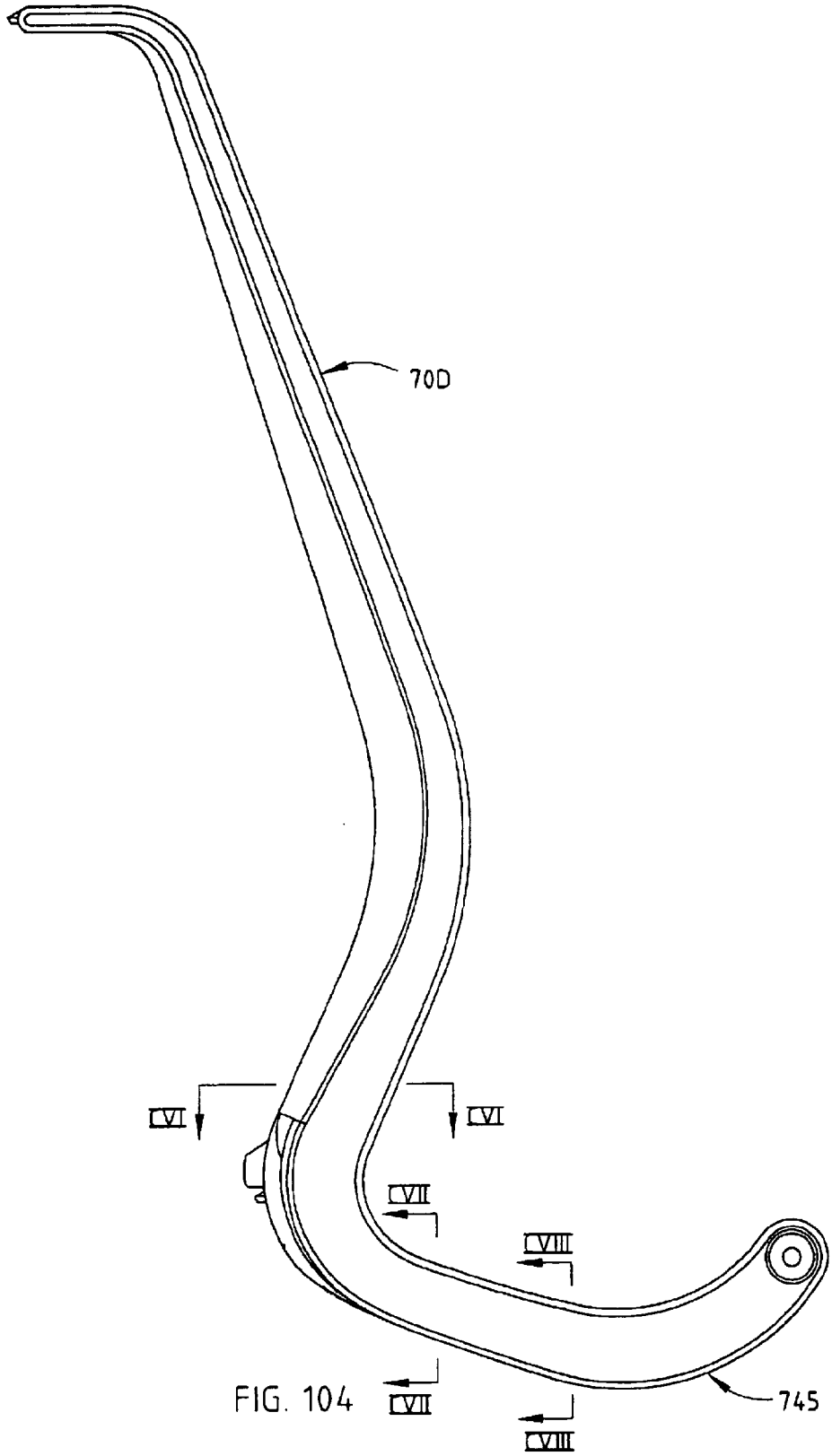
FIGS. 103–104 are rear and side views of a side frame member of the back frame of FIG. 102.
Figure 103:
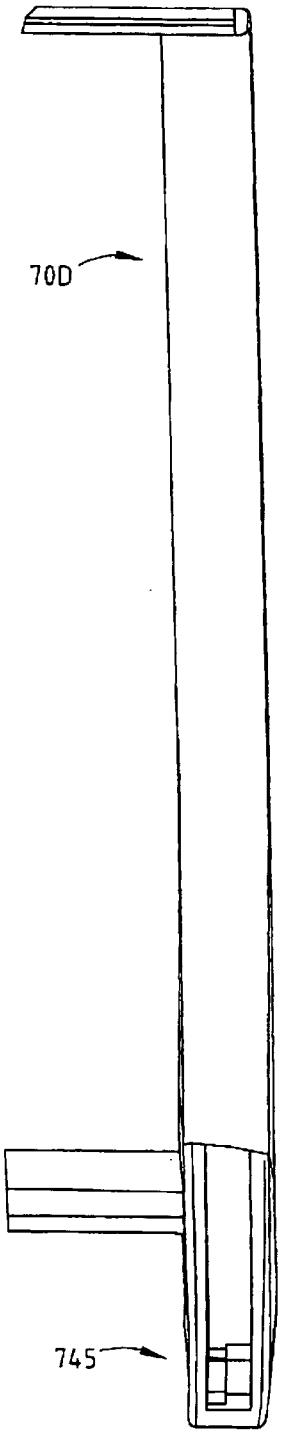
Figure 105:
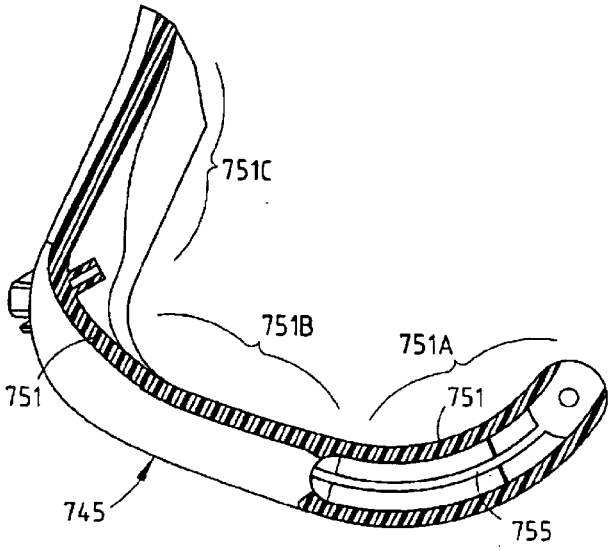
FIG. 105 is a cross section along lines 105—105 in FIG. 103.
Figure 106:
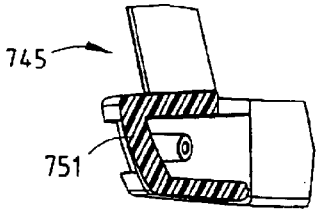
FIGS. 106–108 are cross sections along lines 106—106, 107—107, and 108—108, respectively.
Figure 107:
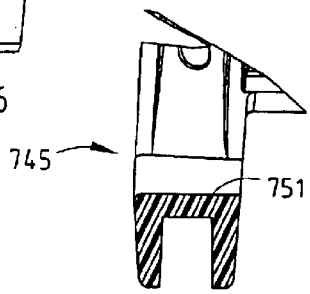
Figure 108:
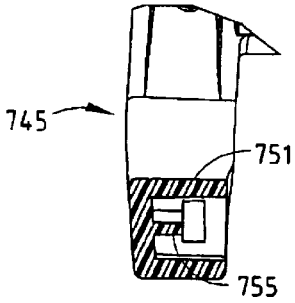

Seating unit 20D (FIGS. 72–73) includes a modified cushion-forming, wire-covering assembly, a modified control mechanism 24D (FIGS. 75–84) with a laterally slidable stop member 155D and hand control 620 (FIGS. 85–89) (which includes a modified selector device 227B), a modified lumbar device 427D (FIGS. 90–94) or 427E (FIGS. 94B–94D), a modified headrest 440D (FIGS. 95–101) and a modified back frame (FIGS. 102–108).

In one form, the back covering and/or back cushion assembly is replaced with a material called a "technical" fabric. This fabric is known in the industry as a filament-type material of dyed PE or PET, and is a 3D knit fabric with inner monofilament and outer layer of knitted multifilament, such as about 3 mm to 8 mm thick. The surface of the material forms an open knit with excellent breathability. The material is called a "technical" fabric because it creates a pattern that is "technical" and detailed in appearance, with the holes forming a "busy" pattern that is both geometric and small in scale. The holes provide some level of see-through or "transparency" (meaning the holes through the knit allow visual recognition of objects through it and allow some light to pass through it). The properties of the material are advantageous, including their durability, good surface or "hand feel", and anti-compression-set properties.

The modified control mechanism 24D (FIG. 78) includes a housing 121D with top, side, front and rear walls 600–603 defining a downwardly open cavity 604 closed by cover 115D. Up flanges 604 on the cover 115D combine with features inside the housing 121D to retain the axle-forming pivot pin 133D (recall that pin 133D is rotatably supported in the housing 121D and is keyed to the seat-attached link 132D and keyed to the torsional booster spring 150D), and the features are also used to retain the parallel rods 606 and 607 for slidably supporting the stop member 155D. The top wall 600 includes a raised area 608 for abutting a triangular mount 609 attached to the cross beam 323D of the seat frame 330D, and further includes a slot 610 for receiving an upper arm 132D' on the link 132D.

Figure 80:
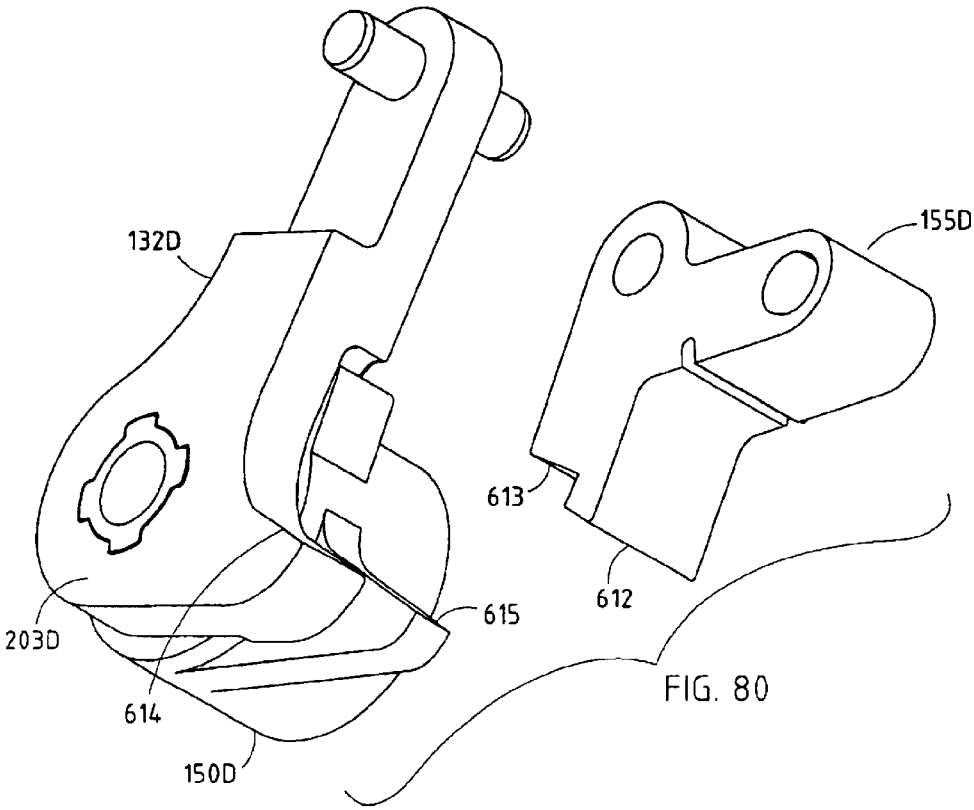
FIGS. 80–80A are top and bottom perspective views of the control components including the laterally-slidable stop member, the seat-supporting link, and the booster spring of FIG. 75.
Figure 80A:
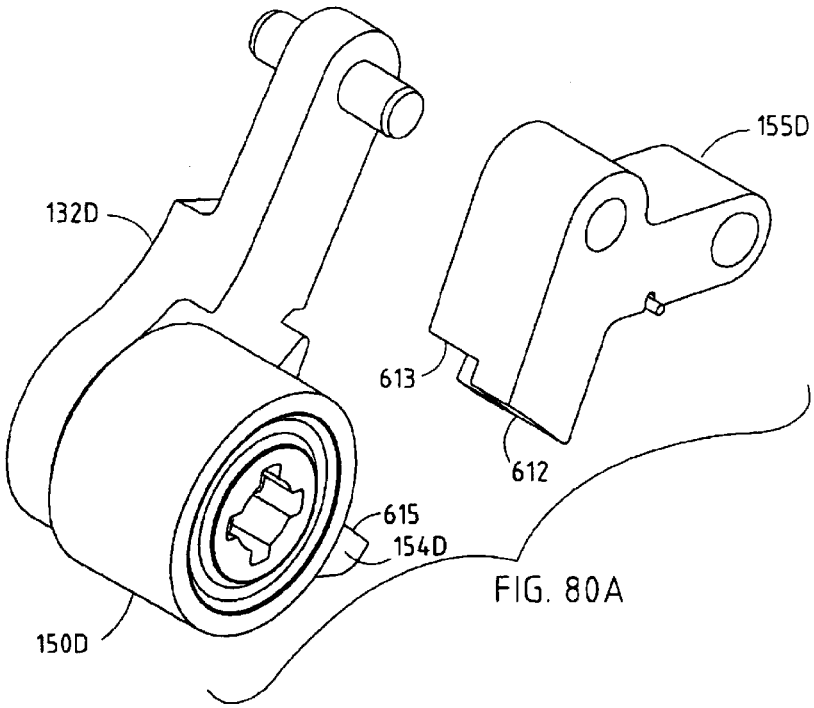
Figure 81:
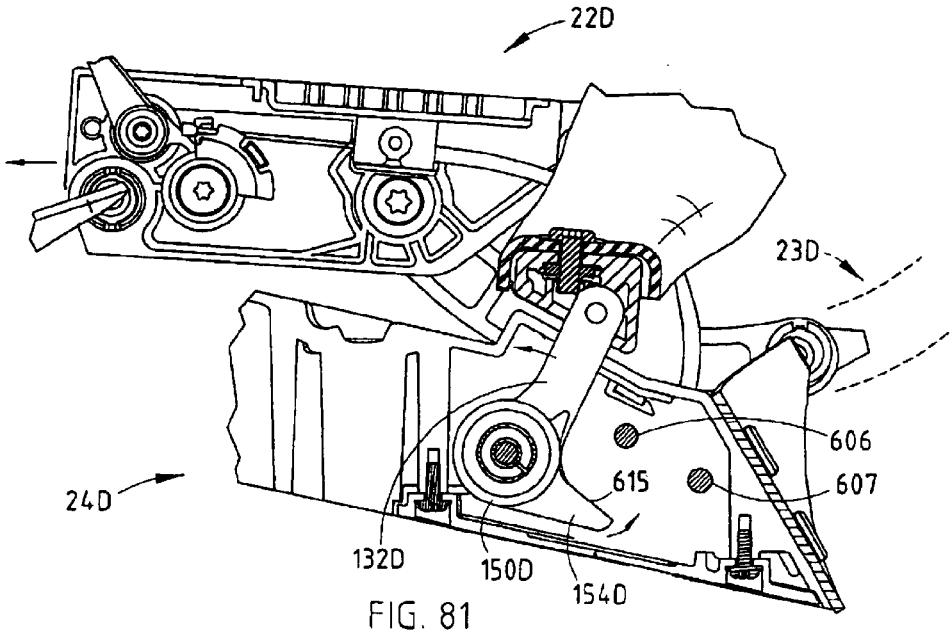
FIGS. 81–84 are side cross-sectional views showing operation of the control components including the components of FIGS. 80–80A.
Figure 82:
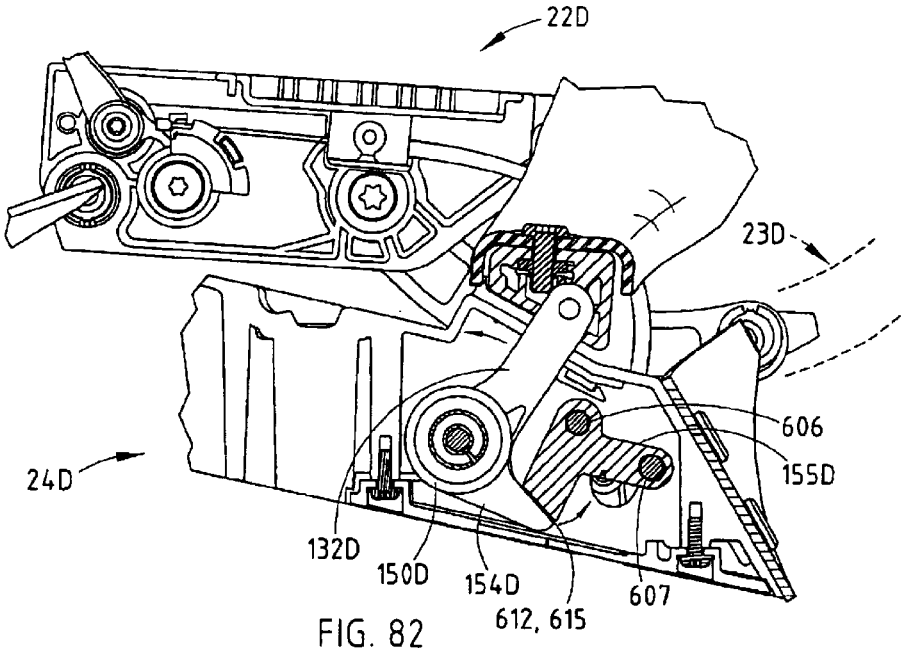
Figure 83:
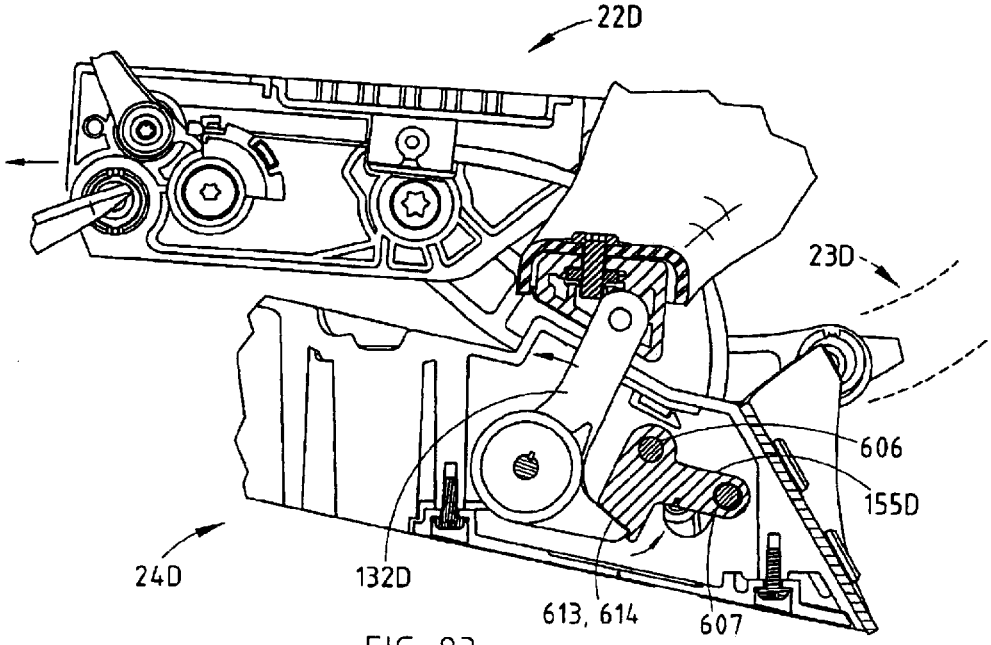
Figure 84:
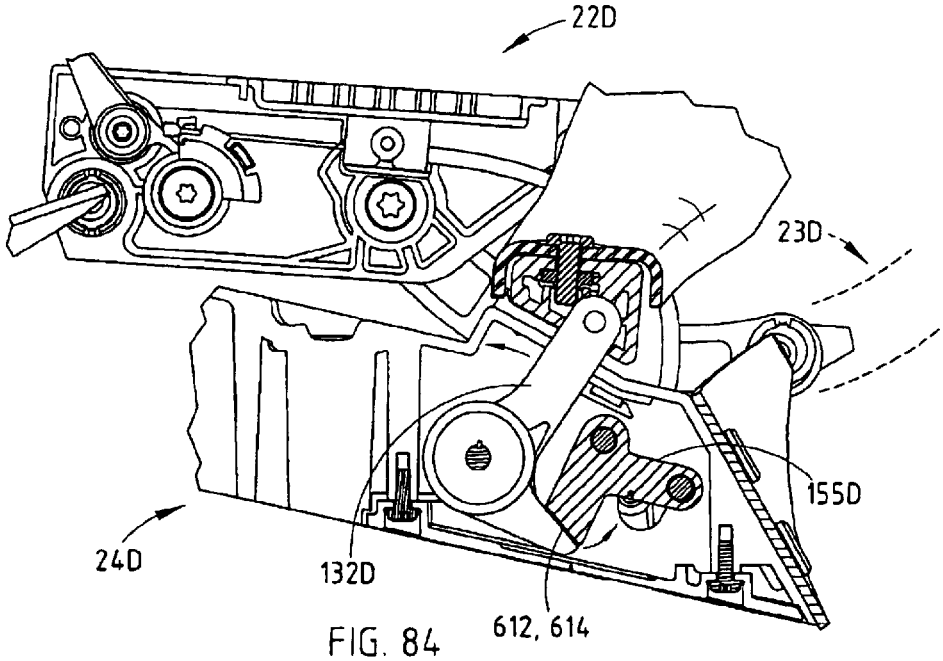
Figure 85:
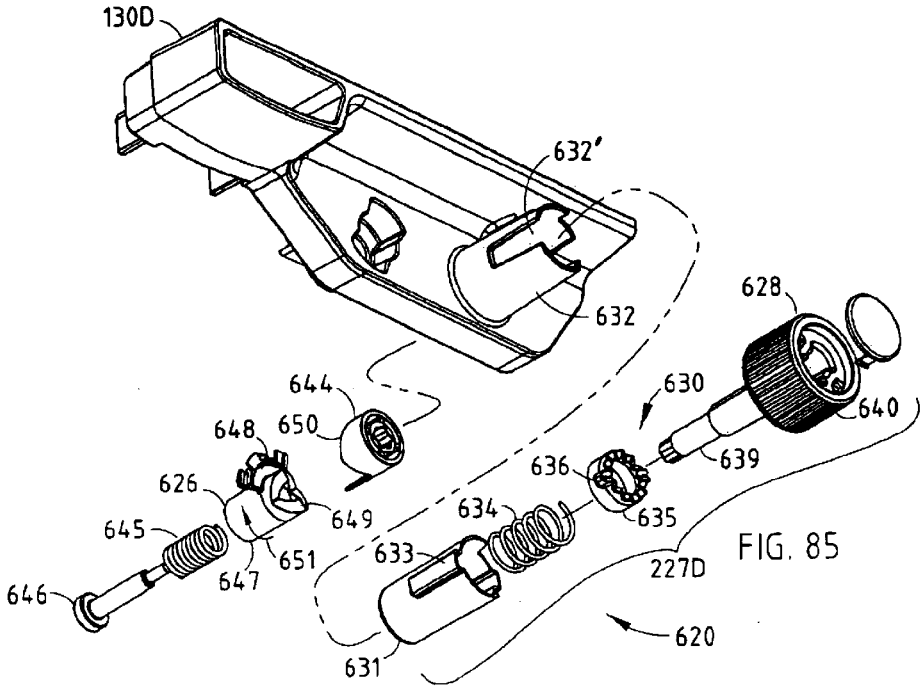
FIGS. 85–86 are exploded perspective views of the hand control for operating the stop member of FIGS. 80–80A.
Figure 86:
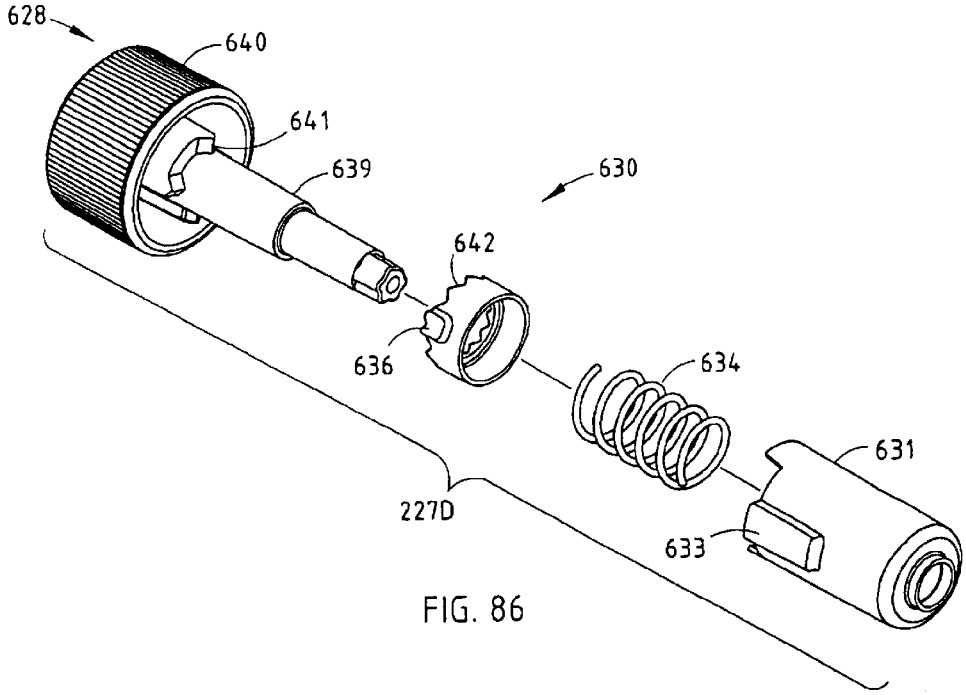
Figure 87:
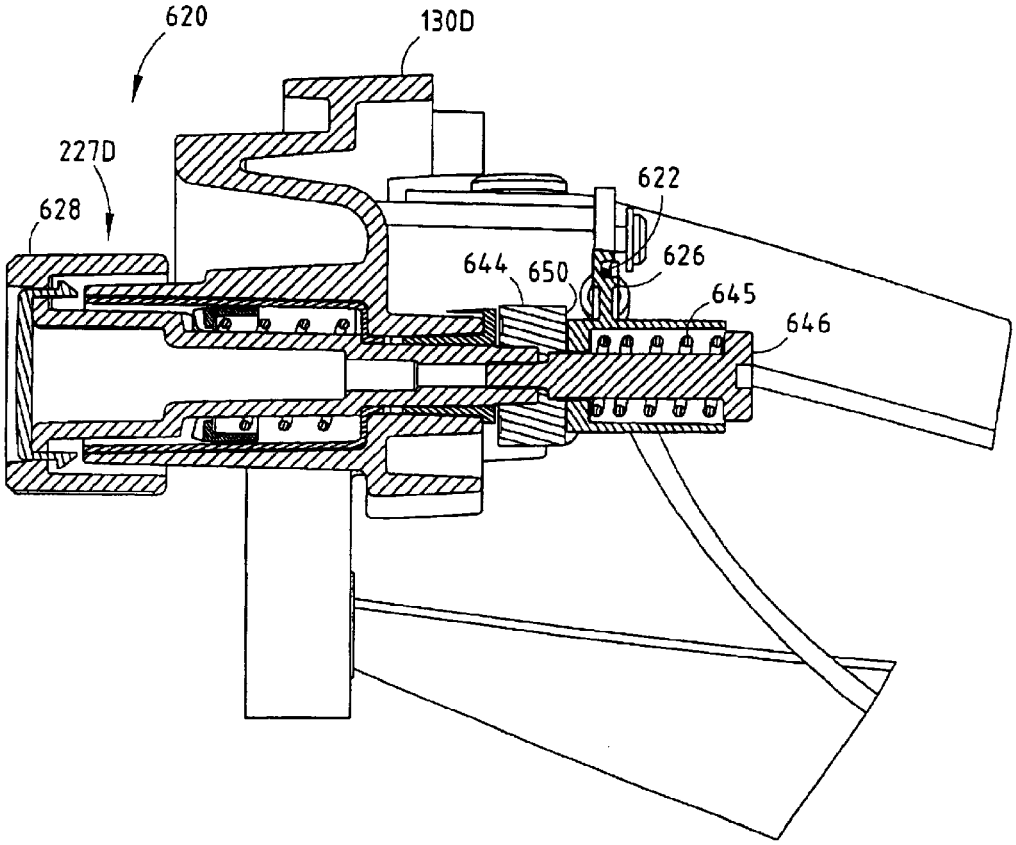
FIGS. 87–88 are cross-sectional views of the hand control of FIGS. 85–86, FIG. 87 being assembled and FIG. 88 being exploded apart.
Figure 88:
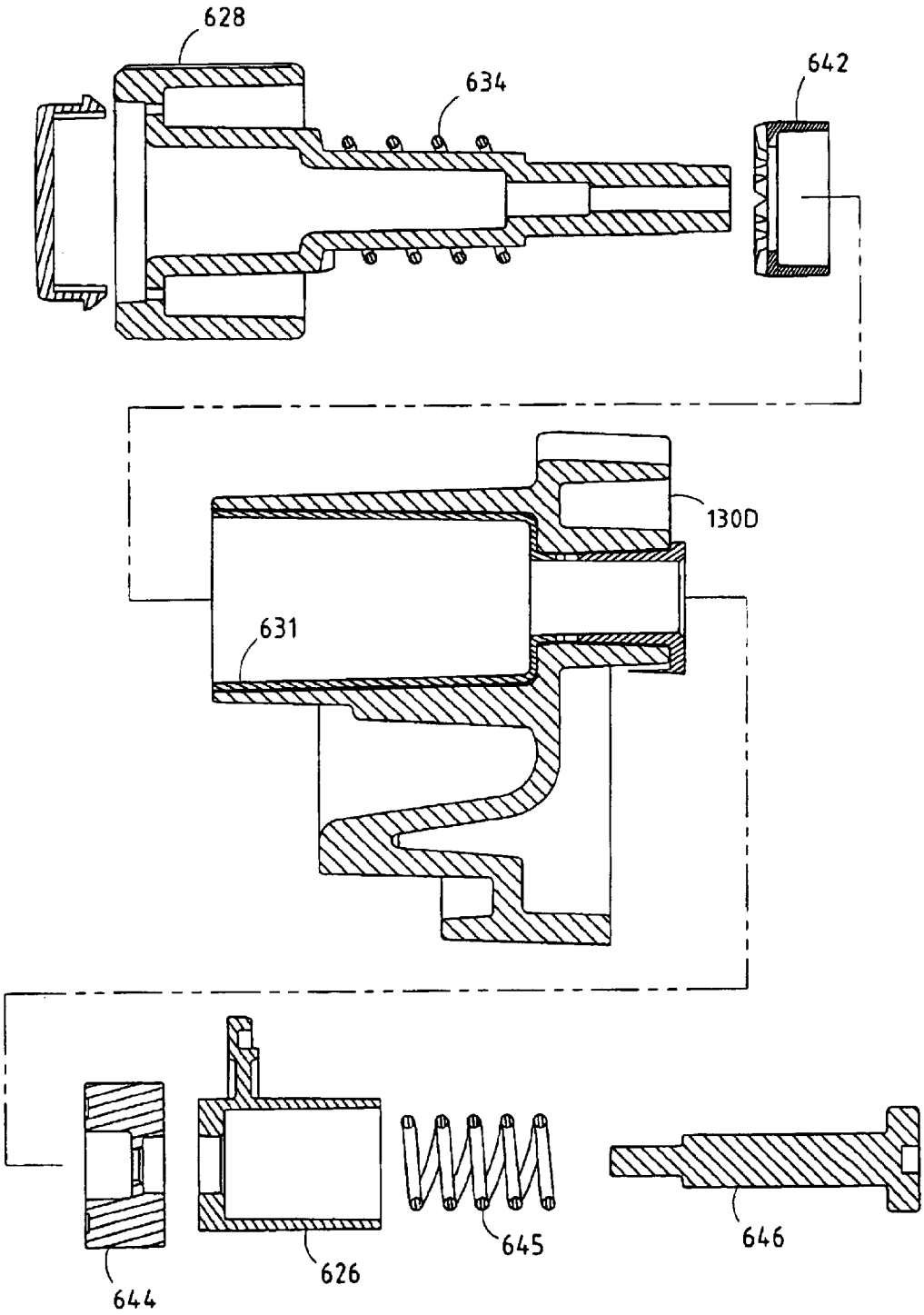

The stop member 155D (FIGS. 78–80A) is slidably carried by rods 606 and 607 for laterally sliding movement. The stop member 155D includes first and second stop surfaces 612 and 613 (FIG. 80A), which are angularly stepped from each other to define different angular positions relative to the axle-forming pivot pin 133D. The link 132D (FIG. 80) includes a mating stop surface 614 on its arm 203D, and the torsional booster spring 150D includes a mating stop surface 615 on its outer sleeve's arm 154D. In a first (home) position (FIG. 81), the stop member (155D) is laterally shifted toward one side so that it is positioned out of the way, such that the stop surfaces 612 and 613 do not engage any mating surface. Hence, the back 23D is supported only by the energy stored in the compliant springs 123D' and 137D (and the potential energy stored as the seated user is lifted by the seat 22D during recline of the back 23D).

In a second position (FIG. 82), the stop surface 612 engages the stop surface 615 on the spring arm 154D, such that the booster spring 150D is engaged and supplements (i.e. adds to) the back supporting force during recline of the back 23D. Notably, the back 23D is permitted to move to a full recline position. In a third position (FIG. 83), the stop surface 613 engages the mating stop surface 614 on the link 132D. Since the stop surface 613 is angularly stepped from the stop surface 612, the back 23D is permitted a partial recline before the stop surface 613 engages the link's stop surface 614. Notably, the stop surface 612 of the stop member 155D engages the stop surface 615, such that the booster spring 150D is continuously engaged during this partial recline. In a fourth position (FIG. 84), the stop surface 612 engages the stop surface 614 of the link 132D, preventing any recline of the back 23D (i.e. "zero recline").

Advantageously, the only frictional force that must be overcome when moving the stop member 155D is the effort to slide the stop member 155D along rods 606 and 607, which is designed to have a very low frictional force. Thus, normally, a very low "shifting force" is required. It is contemplated that the shifting force for moving the stop member 155D can be provided by a Bowden cable with telescoping internal wire that is stiff enough to provide both a "push" shifting force and a "pull" shifting force. Alternatively, the shifting force can be provided by any of the alternative concepts shown in FIGS. 26A–27A.

The illustrated hand control 620 (which incorporates modified selector device 227D) for moving the stop member 155D is shown in FIGS. 85–88, and the details are described below. The hand control 620 includes a "pull only" cable 622 (FIG. 89) positioned in a sleeve 623, and includes a return biasing spring 624. The selector device 227D (FIG. 85) includes a handle 628 that can be manipulated by a seated user, a cable-puller part 626 connected to an end of the cable 622, and an overload system (or "over-torque protector) and a detent system therebetween, as described below.

Figure 89:
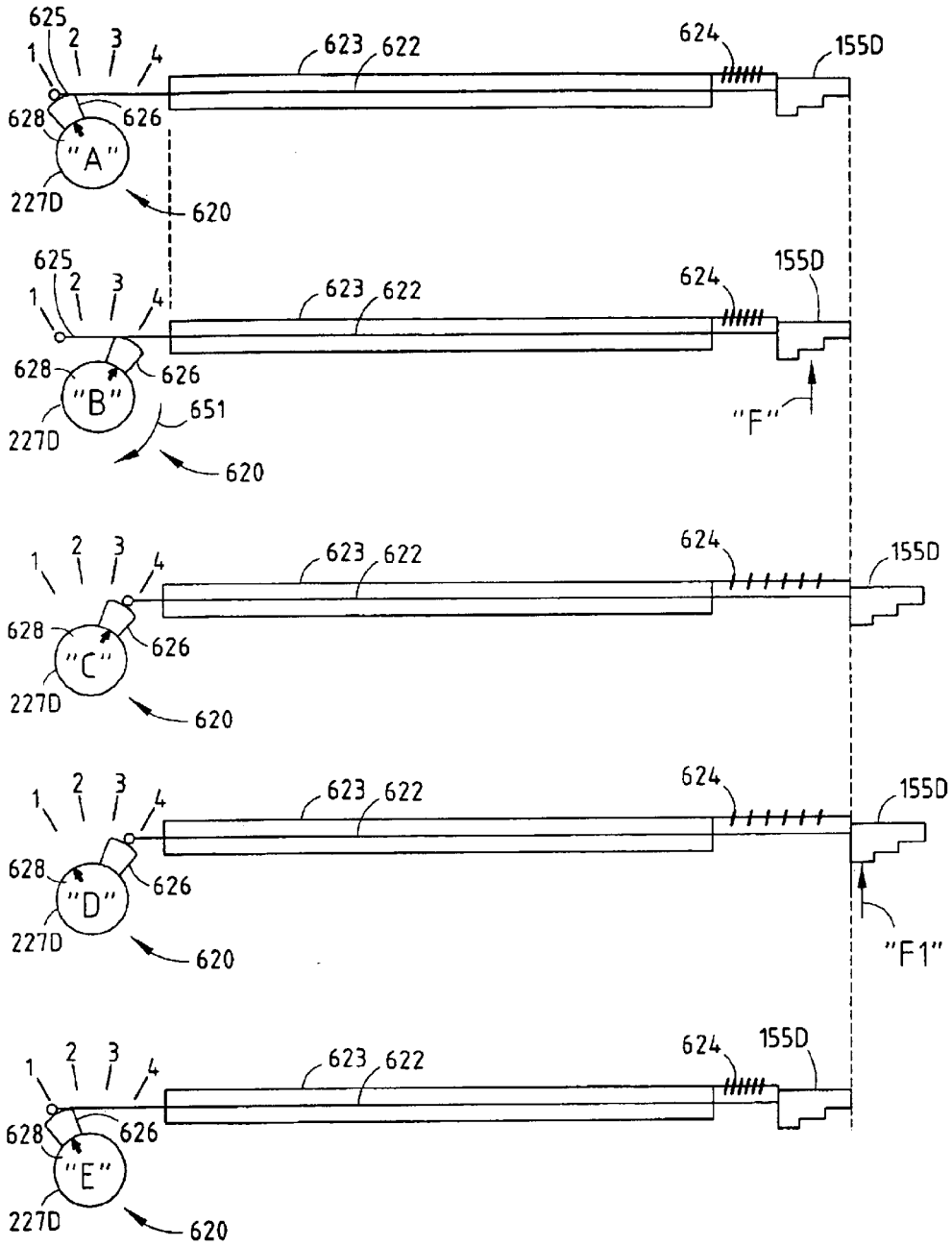
FIG. 89 schematically shows operation of the hand control of FIGS. 85–86, the connecting cable, and the control components of FIGS. 75–79.
Figure 90:
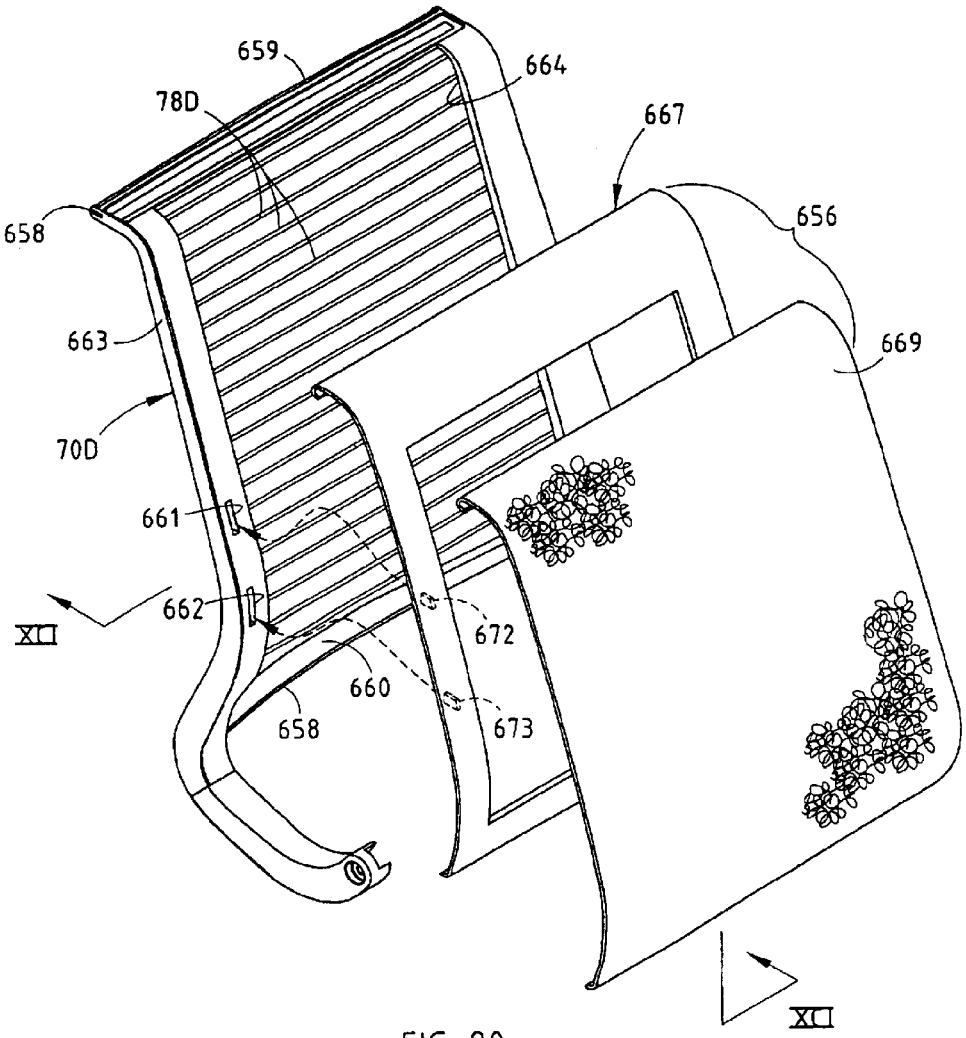
FIG. 90 is an exploded perspective view of the back of FIG. 72.
Figure 91:
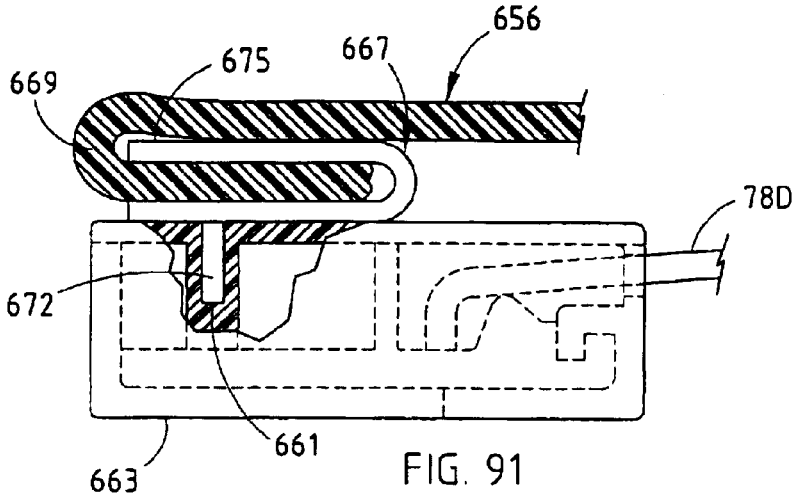
FIGS. 91, 91A and 92 are cross sections taken through the back of FIG. 90.
Figure 91A:
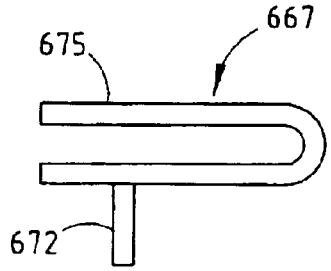
Figure 92:
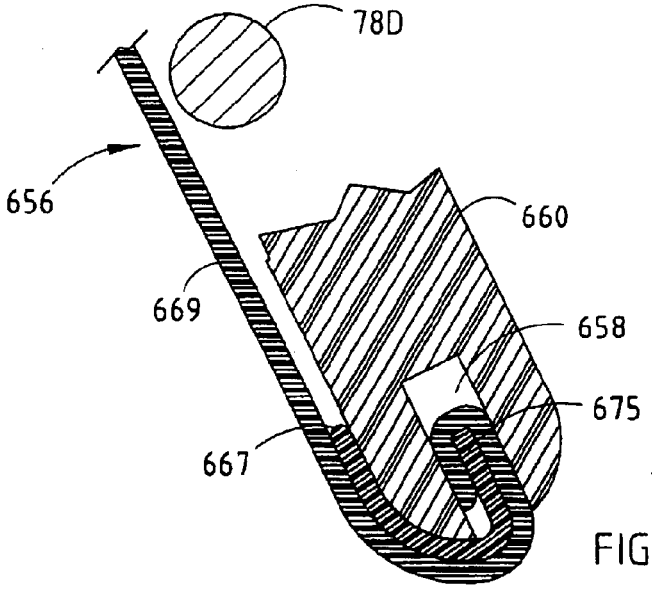
Figure 93:
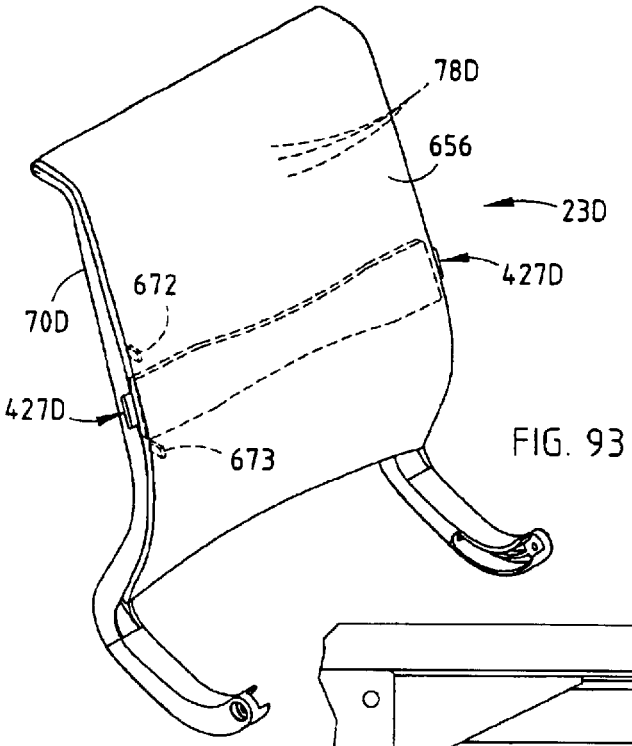
FIGS. 93 and 93A are enlarged perspective views of the back of FIG. 72 including its lumbar device.
Figure 93A:
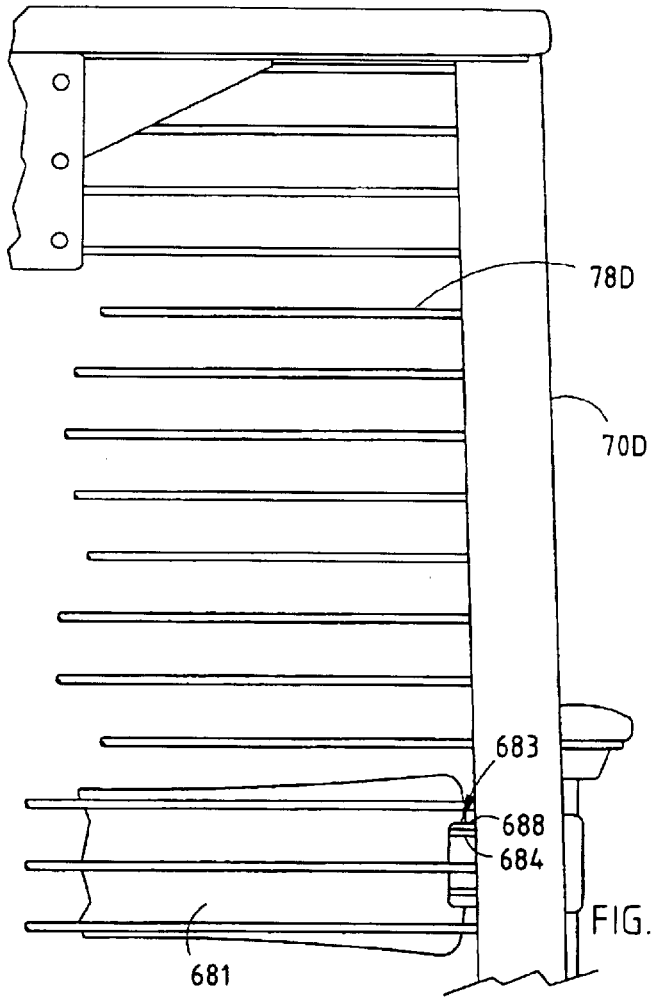

The four positions of the stop member 155D (FIG. 89) are represented by the numbers 1–4 in FIG. 89. Four particular conditions of interest are schematically shown by the five sketches "A"–"E" in FIG. 89 (sketches "A" and "E" being duplicates). In condition "A", the selector device 227D is in the home position "I" and the stop member 155D is also in the home position "1". In condition "B", a seated user has moved the selector device 227D to position "4", but the stop member 155D cannot be moved due to force "F" (such as when a person is leaning rearwardly at the time of making the adjustment, which causes the stop member 155D to strike a side of the spring arm 154D instead of being able to be moved onto the stop surface of the spring arm 154D of spring 150D). In such case, the end 625 of the cable 622 slips out from its cable-puller part 626. Also, the handle detent system retains the selector device 227D in the newly selected position. In condition "C", the force "F" has been removed (such as by the seated user moving back to an upright position in the chair). The spring 624 pushes the stop member 155D to position "4" (which is the position that the seated user had previously selected). In condition "D", the seated user forces the selector device 227D back to position "4", but the stop member 155D cannot be moved due to a force "F1" (such as when a person is leaning rearwardly against the back 23D at the same time as when a zero recline position "4" is selected). In this case, a handle 628 on the selector device 227D is moved to position "1", but the cable-puller part 626 does not rotate (since the cable 622 cannot move). The handle detent system retains the selector device 227D in the newly selected position "1", even though the cable-puller part 626 has not moved. When the force "F1" is removed (such as when the seated user no longer presses against the back 23D), a biasing system between the handle 628 and the cable-puller part 626 biases the cable-puller part 626 back to the position "1".

Notably, the above discussion describes circumstances that occur when selecting between positions "1" and "4". However, the same set of circumstances will occur when selecting between any two of the positions "1" through "4". For example, one could substitute position "2" for the position "4" in the above discussion.

The control 620 (FIG. 85) includes a detent system 630 so that the seated user can feel which of the four positions they are in as they select between the positions. The detent system 630 includes a sleeve 631 that fits into a mating socket 632 in the right seat side frame member 130D, and includes a ridge 633 that keys into a slot 632' in the socket 632 to prevent its rotation therein. A spring 634 and crowned ring 635 fit into the sleeve 631, the crowned ring 635 including a second key 636 that fits into the ridge 633 to prevent rotation of the ring 635. The handle 628 includes a stem 639 and grip 640. The grip 640 includes an inner surface with detent bumps 641 (FIG. 86) that abut the undulated top surface 642 on the crowned ring 635, forming the detent system. When the handle 628 is rotated, the detent bumps 641 detentingly move between the four positions "1" through "4" of the selector device 227D as noted above. The detent system is strong enough to hold the handle's position against the force of spring 624.

The control 620 includes an inner assembly comprising a second crowned ring 644 (FIG. 85 and also see FIG. 88), a spring 645, and a mounting bolt 646 that rotatably retains the cable-puller part 626 as follows. When assembled (FIG. 87), the cable-puller part 626 is biased against the ring 644 and against the seat side frame member 130D by the spring 645 and bolt 646. The cable-puller part 626 has a sleeve portion 647 (FIG. 85), an arcuate section 648 attached to an end of the cable 622, and an undulated end surface 649. The ring 644 has a mating undulated surface 650 that abuts the end surface 649. When the cable-puller part 626 is rotated in direction 651 (see condition "B" in FIG. 89), the end of the cable 622 merely stays put as the arcuate section 648 rotates. When the cable-puller part 626 is forced to rotate in a direction opposite direction 651, the end surface 649 of the cable-puller part 626 rides up on the undulated surface 650 of the ring 644, causing the spring 645 to compress. This allows the handle 628 to rotate, yet allows the cable-puller part 626 to remain stationary (until the force "F1" is removed and the stop member 155D is able to be moved). The detent system is designed to hold the handle 628 in a selected position, and the spring 645 causes the cable-puller part 626 to move to the selected position when the "F1" force is removed and the stop member 155D is shifted to the selected position.

It is specifically contemplated that the undulations 649 and 650 can be configured to provide a one-way over-torque release feature (as described above) or can be configured to provide a two-way over-torque release feature. (In other words, the undulations 649 and 650 can be designed to allow the handle to be rotated clockwise or counter-clockwise without forcing the cable-puller part to be forcibly moved, thus providing a two-way over-torque protection which prevents breaking and damaging the cable-puller part 626.) By this arrangement, the control 620 prevents damage to components when the selector device 227D is forced to move at a time when the stop member 155D cannot be moved. Advantageously, the overload device allows the selector device 227D to be moved to a selected position and holds the selector device 227D in the selected position, and then snaps the stop member 155D to the selected position when pressure is taken off the stop member 155D permitting it to move. Seated users appreciate the above-described release feature because it lets them adjust the chair (regardless of whether the chair controls are deadlocked or not) . . . and then the control automatically moves to the adjusted position at such time as the interference is eliminated.

The seat 22D and back 23D (FIGS. 72–73) each include a removable covering hook-attached as follows. The back 23D is hook-attached at its top and bottom, and further includes cushion-edge locators as described below. The seat 22D is similarly hook-attached at its front and rear, but it is contemplated that the seat 22D will not require cushion-edge locators at this time. Accordingly, the back 23D is described below since it includes both features. A redundant discussion of the seat 22D is not believed to be necessary.

The back covering 656 (FIG. 90) is attached to the back frame 70D as follows. The back frame 70D includes a channel 658 formed along its top and bottom frame members 659 and 660, and includes a pair of slots 661 and 662 formed along its side frame members 663 and 664. The slots 661 and 662 are located just above and below the lumbar region of the back frame side members 663 and 664. The back covering 656 (FIG. 90) includes a molded perimeter frame 667 designed to lie flat against a front surface of the back frame 70D. The back covering 656 includes a cushion 669 preferably made of a recyclable fibrous PET material (such as from reground pop bottles) (though other foam and non-foam cushions could also be used). The cushion 669 is only about 7 mm thick or less, since comfortable support is provided by the resilient wires 78D of the "comfort surface" of the chair 20D. A fabric upholstery material (such as customer-ordered material or factory-inventoried material) is laid onto a front of the cushion 669 and wrapped with the cushion around an outer flange 675 on the perimeter frame 667 (FIG. 92), creating a double thickness that is held by stitching or staples to the outer flange 675. The perimeter frame 667 includes a pair of protrusions 672 and 673 (FIG. 90) on each side that engage the slots 661 and 662 in the back frame 70D. The slots 661 and 662 control lateral movement of the perimeter frame 667 by engagement with the protrusions 672 and 673 to thus limit mismatch of the edge of the back covering 656 relative to the back frame 70D. However, they move longitudinally in the slots 661 and 662 to allow the covering 656 to stretch and let the wires 78D flex and move for comfortable support. The covering 656 is removably retained to the back frame 70D by engagement of a curled outer flange 675 which slips into channels 658 in the top and bottom frame members of the back frame 70D. (See FIGS. 91–92). The covering 656 is tensioned top-to-bottom so that the wires 78D are pretensioned and formed into a "PRINGLES® potato chip" shape for optimally supporting a seated user.

The lumbar device 427D (FIGS. 93–94) is positioned between the back covering 656 and the back frame 70D. The lumbar device 427D can be shifted vertically between the protrusions 672 and 673 for adjusting the lumbar support provided. The lumbar device 427D (FIG. 94A) includes a wire 680, front and rear bow-tie-shaped thin panels 681 and 682, and opposing handles 683. The wire 680 is generally rectangular, and includes long resilient straight sections 684 and short ends 685. The thin panels 681 and 682 capture the wire 680 therebetween. It is contemplated that the thin panels 681 and 682 can be held together in different ways. For example, the two parts can be held together by separate fasteners (e.g. rivets, screws, mechanical interlocks, snaps), or can be held together by bonding techniques (e.g. heat staking, ultrasonic bonding, adhesive), or by other means known in the art. It is contemplated that the lumbar panels 681 and 682 can be extruded or molded. It is also contemplated that they can be made as a single part, with the panels 681 and 682 being held together with an integrally-molded living hinge and with a hook and tab feature opposite the living hinge for securement.

Unlike prior art lumbar devices, it is contemplated that the front and rear thin panels 681 and 682 are as thin as possible and are surprisingly flexible, so that the lumbar support comes from the active flexing of the wire 680, rather than from a stiff flat part. Thus, the lumbar support provided is very much like the support provided by the wires 78D in "comfort surface" of the back 23D. As a result, the lumbar support comes from the increase in force versus displacement curve provided (i.e. the wire 680 of the lumbar device supplements the wires 78D of the back 23D) . . . instead of the increased lumbar support coming only from a forced shape change in the lumbar area of the back 23D. Nonetheless, it is contemplated that increased lumbar support can come from both a lumbar shape change and also an increased lumbar support force curve.

The wire 680 is able to flex and move within and between the panels 681 and 682, and the ends 685 of the wire 680 extend outward from ends of the panels 681 and 682. Handles 683 include a thin body 688 with a U-shaped cavity 689 for receiving the ends 685. A handle 690 is attached to an end of components 680, 681, 682, and extends outward from them to form a grip to facilitate adjustment of the lumbar device 427D that can be grasped from a side of the chair 20D. The wire 680 can be snapped into position or a second tab or a clip 691 can be provided to loosely retain the wire 680 slidably within the U-shaped cavity 689. Advantageously, one or both sides of the lumbar device 427D can be adjusted, so that an optimal comfortable support can be obtained. The lumbar device 427D is held in place by the tension of the back covering 656, which, due to the curvature of the back, causes tension between the back covering 656 and the back frame 667.

It is contemplated that the wire loop 680 can be replaced with a flat strip of spring metal or leaf-spring-like plastic member. In fact, the entire lumbar wire 680 and "clam shell" covers 681, 682 could be replaced with a single molding or stamping, with its handles 42 being formed on or attached to ends of the lumbar device.

Another lumbar device 427E (FIGS. 94B–94D) includes a rectangular wire 684E positioned inside of a sock 682E of slightly-elastic material, such as slippery LYCRA® material. The sock material can be black, fabric-color, patterned, see-through, or translucent. Handles 683E are attached to ends 682E' of the sock 682E. The handles 683E include an outer end section 800E with a lip 801E forming a recess 802E that slidably engages a front surface of the back frame side sections 71E. The inboard end 804E is offset from an intermediate section 805E to form a shelf for supporting the end of the wire 684E that is coplanar with the outer end section 800E. An end 682E' of the sock 682E is fed through an aperture 806E in the intermediate section 805E. The end 682E' is doubled back and either looped around an anchor 807E or is secured (e.g. by stapling or fastener 808E) to the handle 683E.

The lumbar device 427E is positioned under the upholstery back covering and in front of the back frame side sections 71E, with the handles 683E slidably engaging the side section 71E. If the back frame side sections 71E are non-parallel, the sock 682E stretches (or elastically shrinks) to compensate as the lumbar device 427E is moved vertically. The slipperiness of the sock 682E helps the lumbar device 427E slip up and over each successive back wire 78E as the lumbar device 427E is vertically adjusted. The long parallel sections of the wire 684E can be (but do not necessarily need to be) bent to form a slightly bowtie-shaped arrangement, which shape also helps slip up and over each successive wire 78E.

The headrest 440D (FIG. 95) includes a mount assembly 700 for attaching the headrest support 441D to the back frame 70D. The top frame member 659 includes a rearwardly extending flange 701 with a top recess 702 therein. The mount assembly 700 includes a top bar 703 that fits into the recess 702 and a T-frame 704 with arms 704' that abut a bottom of the frame 701. A pair of inboard screws 705 extend upwardly through holes in the T-frame arms 704' and through flange 701 threadably into holes in the bar 703. A criss-cross arrangement of ribs stiffen the T-frame arms 704'. A pair of outboard screws 706 extend through holes in the flange 701 threadably into the bar 703. By this arrangement, stress on the headrest 440D is well distributed across the flange 701 and across the back frame 70D. Notably, the recess 702 places an upper surface of the bar 703 flush with the upper surface of the flange 701, such that the back covering 656 lies flat and does not have a bump where it covers the bar 703.

The T-frame 704 (FIG. 95) further includes a vertical tube section 708 molded integrally with the T-frame 704. The tube section 708 defines a vertically-open cavity 709 having a rectangular cross-sectional shape. The headrest 440D includes a C-shaped headrest support member 441D and a vertical post 711. The vertical post 711 is shaped to mateably slidably engage the cavity 709. A detent device 712 (FIG. 98) is positioned on the post 711 to retain a selected vertical position of the post 711 in the tube section 708. The illustrated detent device 712 includes a spring-biased ball 712' shaped to engage any one of a series of depressions 714 (FIGS. 97–98) on the inner surface of the post 711. By lifting or pressing downwardly, the headrest 440D can be adjusted to a desired height.

The C-shaped headrest support 441D (FIG. 96) includes a C-shaped molded shell 720 with a fabric covered cushion 721 attached to the headrest shell 720 by top and bottom hook-shaped connectors 721A and 721B similar to those discussed above in regard to the back covering 656. The cushion 721 could also be a polyurethane pad snapped or attached onto the shell 720 or molded thereon. Projections 722 and 723 are integrally molded onto an undersurface of the headrest shell 720. The projections 722 and 723 each include an apertured flange 724 and a configured inner surface 724'. Notably, the illustrated arrangement allows the headrest shell 720 to be molded using relatively simple molding dies, with only the holes 725 in the flange 724 requiring a slide or puller in the molding dies. The vertical post 711 includes a transverse tubular section 726 at its top.

A pair of bearing supports 727 are provided for detentingly supporting the headrest support 441D on the tubular section 726. The bearing supports 727 include a sleeve portion 728 that fits into the cavity 733 of tubular section 726, and a configured outer end portion 729 that fits non-rotatably against the inboard surface 724' of the projections 722 and 723. Screws 730 fit through the holes 725 in the apertured flanges 724 and thread into holes 731 in the bearing supports 727. The cavity 733 in the tubular section 726 includes longitudinal ridges 734, and a bent-wire U-shaped detent clip 735 includes legs 736 that fit against the outer surface of the sleeve portion 728 detentingly against the ridges 734 of the tubular section 726. The end 737 of the detent pin 735 is located inboard of the end of the screw 730 and extends across an inboard end of the sleeve portion 728 through a slot (which makes it non-rotatable). Thus, the headrest support 441D is angularly adjustable, but is held in a selected position by the detent system described above. One or two detent clips 735 can be used.

The C-shaped headrest support 441D has relatively flat first and second surfaces 738 and 739 that are positioned at distances D1 and D2, respectively, (FIGS. 98–99) from holes 725 in the apertured flanges 724 of the projections 722 and 723 on the shell 720. These distances D1 and D2 are selected to provide optimal headrest support when the headrest support 441D is used in the recline position (see FIGS. 98 and 100) and when the headrest support 441D is used in the upright position (see FIGS. 99 and 101). The optimal distance is believed to be generally about 2 to 4 inches difference, and more specifically is about 2¼ to about 2½ inches difference. The present headrest arrangement is designed so that the headrest support 441D can be rotatable about 90 degrees to optimally position the surfaces 738 and 739 for use.

As noted above, the back frame 70D (FIG. 102) includes top and bottom frame members 659 and 660, and includes side frame members 663 and 664. Side legs 745 and 746 extend downwardly and forwardly from the side frame members 663 and 664, respectively. The legs 745 and 746 were carefully designed and have a particular shape to facilitate assembly and optimally distribute stress in order to pass an industry standard known as the BIFMA Backrest Strength Test-Static-Type I. This test includes placing an 890N (200 lbf.) at a top of the chair's back for one minute, which is not a small load. The legs 745 and 746 are mirror images of each other, such that only one need be described. Reference is made to the leg sections 135B and body 502 previously discussed (see FIGS. 67–69).

Figure 67:
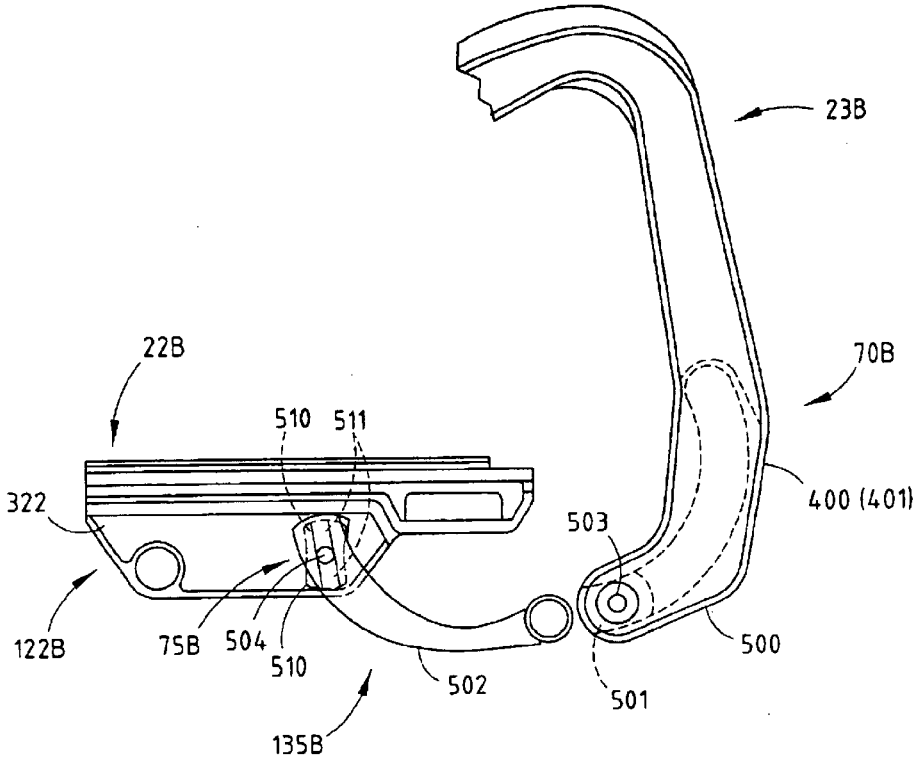
FIGS. 67–69 are fragmentary views of the back frame of FIG. 53 and side frame members of FIG. 45.
Figure 68:
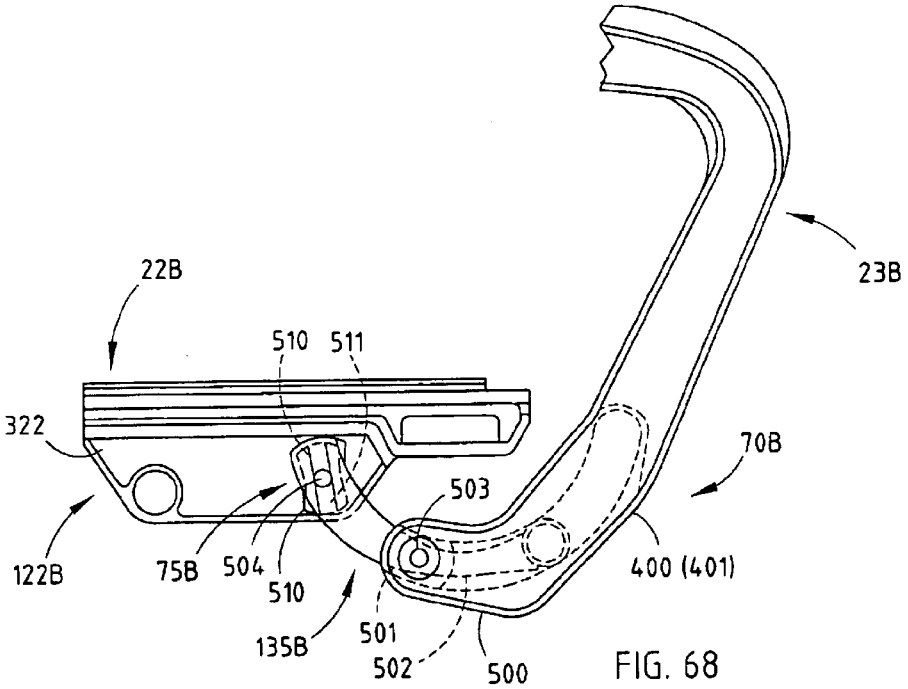
Figure 69:
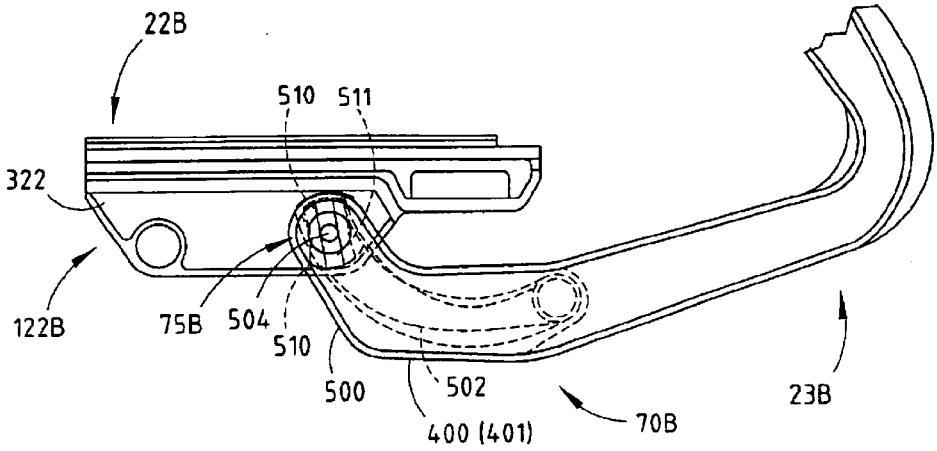

The leg 745 (FIG. 102) defines a C-shaped cross section with an inwardly open cavity 750 at its lower end that is shaped to telescopingly receive a structural body (see body 502, and FIGS. 67–69). The body (502) forms the structure for pivotal attachment to the seat side frame members (130D) and further forms the structure for pivotal attachment to ends of the rear compliant support (137D). The leg 745 has a top wall 751, side wall 752 and bottom wall 753. The wall 751 (FIG. 105) transitions continuously and smoothly from its lower section 751A through its middle section 751B and upward around the corner defined by the leg 745, where its upper section 751C forms an integral part of the structure of the back side frame member 659. Notably, in the lower section 751A, the cross section of the leg 745 defines an inwardly facing open C-shape. (See FIG. 108.) A rib 755 is added as required for extra stiffness. In the middle section 751B, the cross section of the leg 745 defines a downwardly facing open C-shape. (See FIG. 107.) In the upper section 751C, the cross section of the leg 745 defines a forwardly facing open C-shape. (See FIG. 106.) The transition that allows the cross section to change from inwardly facing, to downwardly facing, and then to forwardly facing, is important for the structure of the present back frame 656 for several reasons. The particular shape of leg 745 with its smooth changes in cross section (including especially wall 751) distributes stress well, and results in a very robust and durable arrangement. Further, the arrangement allows the wall thicknesses to be maintained at relatively constant thicknesses, which greatly facilitates molding and dimensional consistency of parts. Further, it allows features to be integrated into the back frame 656 as molded. For example, the cavity 750 can be molded integrally into the back frame 656 without complex molding dies and without substantial secondary processes being required. Also, the sleek and flowing aesthetics of the back frame are maintained, and the use of material is both minimized and optimized.

Although an office chair is illustrated, it is specifically contemplated that the present inventive concepts are useful in other seating units other than office chairs. It is also contemplated that the present inventive concepts are useful in non-chair furniture and other applications where movement of a first structure relative to a second structure is desired, particularly where simultaneous coordinated or synchronized movement is desired and/or where a bias force is desired or adjustable stop is desired.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a base, a seat, a back, and a control operably supporting the seat and the back on the base for synchronous movement as the back is moved between upright and recline positions;

the control including a housing, a first mechanism providing a biasing supporting force to the back during recline, and a booster spring mechanism for increasing the supporting force;

an on/off selector device for selectively activating and deactivating the booster spring mechanism includes a stop member slidably mounted to the housing and that is movable to a self-sustaining disengaged first position for deactivating the booster spring mechanism and an engaged second position for activating the booster spring mechanism; and the booster spring mechanism operably connected to the back for rotation therewith during recline of the back, the booster spring mechanism defining an axis of rotation and including an arm extending from the axis of rotation that freely rotates when the stop member is in the disengaged first position, but that when in the second position, engages the stop member to tension the booster spring mechanism upon recline of the back.

2. The seating unit defined in claim 1, wherein the on/off selector device includes a cable for moving the stop member between the engaged and disengaged positions.

3. The seating unit defined in claim 2, wherein the control further includes a link that rotates with the back during recline, and wherein the stop member includes a first step shaped to operably selectively engage the link to limit recline of the back when the link is moved to a third position.

4. The seating unit defined in claim 3, wherein the first step, when engaged with the link, limits the back to a partial recline position.

5. The seating unit defined in claim 4, wherein the stop member includes a second step that, when engaged with the link, limits the back to a zero recline.

6. The seating unit defined in claim 5, wherein the on/off selector device includes a manually operable hand control.

7. The seating unit defined in claim 6, wherein the hand control includes a detent device operably engaging the hand control.

8. The seating unit defined in claim 1, wherein the stop member is slidably mounted within the housing for lateral sliding movement.

9. The seating unit defined in claim 1, including a link operably coupled to the base and to the seat.

10. The seating unit defined in claim 1, including a pivot pin keyed to and supporting the link; and wherein the booster spring mechanism includes a torsion spring keyed to the pivot pin, the torsion spring having a protrusion, and wherein the on/off selector device engages the protrusion to activate the torsion spring.

11. In a seating unit having a base, a seat, a back adapted to pivot between upright and reclined positions, an energy mechanism for biasing the back toward the upright position, a first adjustment mechanism for adjusting a first control member on the chair, and a second mechanism for adjusting a second control member on the chair, the improvement comprising:

a single actuator operably coupled to both the first adjustment mechanism and the second mechanism selectively operating one of said mechanisms when in a first position and selectively operating both of said mechanisms when in a second position.

12. The seating unit defined in claim 11, wherein the first mechanism includes an energy adjustment mechanism for biasing the back, and the second mechanism includes a back stop mechanism for limiting recline of the back.

13. The seating unit defined in claim 12, wherein the actuator includes a stop member that, when in a first position is totally disengaged, but when in a second operative position, engages both the energy adjustment mechanism and back stop mechanism.

14. The seating unit defined in claim 12, wherein the stop member is movable to a disabled position where the actuator disengages from the energy adjustment mechanism and from the back stop mechanism.

15. A seating unit comprising:

a base, a back, and an underseat control operably coupled to and supporting the back for movement between upright and reclined positions, the control including a housing, an adjustable component, a stop member engaging the adjustable component, and an actuator adjusting the stop member into engagement with the adjustable component;

the actuator including a handle operating the stop member and an over-torque mechanism connecting the handle to the stop member; and the over-torque mechanism releasing and preventing damage to the stop member and to the actuator and to the adjustable component when a damaging excessive force is transmitted by the handle but when the stop member is prevented from moving.

16. The seating unit defined in claim 15, including a cable having a first end connected to the stop member and a second end connected to the handle.

17. The seating unit defined in claim 15, including a detent associated with the handle and operably engaging the handle to generate uneven forces upon rotation of the handle so as to provide a detented feel to a seated user.

18. The seating unit defined in claim 15, wherein the over-torque mechanism operates in two directions.

19. The seating unit defined in claim 15, wherein the actuator includes a detent for holding the handle in a newly selected position even though the adjustable component temporarily cannot be moved, and wherein the over-torque mechanism is configured to bias the adjustable component to a position corresponding to the newly selected position when the adjustable component is able to be moved.

20. The seating unit defined in claim 15, wherein the underseat control includes a housing with walls defining a cavity opening downwardly and a cover for closing the cavity; the stop member being positioned within the cavity and adjustably mounted on at least one rod therein.

* * * * *

UNITED STATES PATENT AND TRADEMARK OFFICE

CERTIFICATE OF CORRECTION

PATENT NO. : 6,932,430 B2
APPLICATION NO. : 10/792309
DATED : August 23, 2005
INVENTOR(S) : Adam C. Bedford et al.

It is certified that error appears in the above-identified patent and that said Letters Patent is hereby corrected as shown below:

Title Page,

Page 1, (75) Inventors:

"Adam C. Bedford, Rockford, MI (US); Robert J. Battey, Middleville, MI (US); David A. Bodnar, Ada, MI (US); Jonathan B. Hadley, Holland, MI (US); Jeffrey A. Hall, Grand Rapids, MI (US); Kurt R. Heidmann, Grand Rapids, MI (US); Eric Johnson, Hudsonville, MI (US); Gary Lee Karsen, Wyoming, MI (US); Gordon J. Peterson, Rockford, MI (US)"

should be -- Adam C. Bedford, Rockford, MI (US); David A. Bodnar, Ada, MI (US); Kurt R. Heidmann, Grand Rapids, MI (US); Gary Lee Karsen, Wyoming, MI (US)--.

Signed and Sealed this

Eighteenth Day of September, 2007

JON W. DUDAS
*Director of the United States Patent and Trademark Office*